US006144353A

United States Patent [19]

McKnight

[11] Patent Number: 6,144,353

[45] Date of Patent: Nov. 7, 2000

[54] DISPLAY SYSTEM HAVING ELECTRODE MODULATION TO ALTER A STATE OF AN ELECTRO-OPTIC LAYER

[75] Inventor: Douglas McKnight, Boulder, Colo.

[73] Assignee: Colorado MicroDisplay, Inc., Boulder, Colo.

[21] Appl. No.: 08/920,603

[22] Filed: Aug. 27, 1997

Related U.S. Application Data

[63] Continuation-in-part of application No. 08/801,994, Feb. 18, 1997, which is a continuation-in-part of application No. 08/770,233, Dec. 19, 1996.

[51] Int. Cl.[7] ..... G09G 3/36

[52] U.S. Cl. ..... 345/94; 345/208; 345/88; 349/86; 349/33

[58] Field of Search ..... 345/94–95, 97, 345/96, 208, 88; 349/96, 86–87, 33

[56] References Cited

U.S. PATENT DOCUMENTS

| | | | |
|---|---|---|---|
| H2 | 12/1985 | Soloway | 340/701 |
| H1320 | 6/1994 | Kieronski | 359/48 |

(List continued on next page.)

FOREIGN PATENT DOCUMENTS

| | | | |
|---|---|---|---|
| 0298255 | 1/1989 | European Pat. Off. . | |
| 0336351 | 10/1989 | European Pat. Off. . | |
| 0373565 | 6/1990 | European Pat. Off. . | |
| 0437238 | 7/1991 | European Pat. Off. . | |
| 0622655 | 11/1994 | European Pat. Off. . | |
| 0632426 | 4/1995 | European Pat. Off. . | |
| 0660297 | 6/1995 | European Pat. Off. . | |
| 0 825583A2 | 2/1998 | European Pat. Off. | G09G 3/26 |
| 0 827 130A2 | 3/1998 | European Pat. Off. | G09G 3/36 |

(List continued on next page.)

OTHER PUBLICATIONS

H. Okada, et al., "An 8.4–in. TFT–LCD System for a Note–Size Computer Using 3–Bit Digital Data Drivers," *Japan Display* (1992), pp. 475–478.

PCT International Search Report (PCT/US 97/23963) mailed May 18, 1998.

PCT International Search Report (PCT/US 97/22000) mailed May 18, 1998.

PCT International Search Report (PCT/US 97/21919) mailed May 7, 1998.

PCT International Search Report (PCT/US 97/21991) mailed May 7, 1998.

(List continued on next page.)

*Primary Examiner*—Richard A. Hjerpe
*Assistant Examiner*—Francis Nguyen
*Attorney, Agent, or Firm*—Blakely, Sokoloff, Taylor & Zafman

[57] ABSTRACT

Methods and apparatuses for display systems which modulate a control electrode to cause an electro-optic layer to be reset to a state in which display data is not viewable. In one embodiment of the invention, a display system includes a first substrate having a first plurality of pixel electrodes for receiving a first plurality of pixel data values representing a first image to be displayed. The display system further includes an electro-optic layer which is operatively coupled to the pixel electrodes and an electrode operatively coupled to the electro-optic layer. The electro-optic layer comprises a polymer dispersed liquid crystal material. The display system displays the first image and then applies a first control voltage to the electrode to alter a state of the electro-optic layer such that the first image substantially not displayed and then the display system displays a second image represented by a second plurality of pixel data values after the electrode receives a second control voltage. Various other apparatuses and methods are described.

47 Claims, 28 Drawing Sheets

U.S. PATENT DOCUMENTS

| | | | |
|---|---|---|---|
| 3,097,260 | 7/1963 | James | 178/5.4 |
| 3,507,982 | 4/1970 | Sugihara | 178/5.4 |
| 3,651,511 | 3/1972 | Andrews et al. | 340/324 R |
| 3,703,329 | 11/1972 | Castellano | 350/150 |
| 3,758,195 | 9/1973 | Hedman, Jr. et al. | 350/160 |
| 3,813,145 | 5/1974 | Hedman, Jr. et al. | 350/160 |
| 3,856,381 | 12/1974 | Hedman, Jr. et al. | 350/160 |
| 3,898,646 | 8/1975 | Washizuka et al. | 340/336 |
| 3,902,169 | 8/1975 | Washizuka | 340/336 |
| 3,938,134 | 2/1976 | Hackstein et al. | 340/324 M |
| 4,019,178 | 4/1977 | Hashimoto et al. | 340/324 |
| 4,082,430 | 4/1978 | Schulthess et al. | 350/333 |
| 4,090,219 | 5/1978 | Ernstoff et al. | 358/59 |
| 4,150,396 | 4/1979 | Hareng et al. | 358/60 |
| 4,240,113 | 12/1980 | Michael et al. | 358/180 |
| 4,315,258 | 2/1982 | McKnight et al. | 340/784 |
| 4,319,237 | 3/1982 | Matsuo et al. | 340/713 |
| 4,335,393 | 6/1982 | Pearson | 358/4 |
| 4,364,039 | 12/1982 | Penz | 340/784 |
| 4,378,955 | 4/1983 | Bleha, Jr. et al. | 350/334 |
| 4,385,806 | 5/1983 | Fergason | 350/347 |
| 4,416,514 | 11/1983 | Plummer | 350/335 |
| 4,432,610 | 2/1984 | Kobayashi et al. | 350/331 R |
| 4,449,123 | 5/1984 | Muranaga | 340/716 |
| 4,451,825 | 5/1984 | Hall et al. | 340/750 |
| 4,455,576 | 6/1984 | Hoshi | 358/230 |
| 4,464,018 | 8/1984 | Gagnon | 350/331 R |
| 4,487,480 | 12/1984 | Nonomura et al. | 350/335 |
| 4,566,758 | 1/1986 | Bos | 350/346 |
| 4,574,282 | 3/1986 | Crossland et al. | 340/784 |
| 4,582,396 | 4/1986 | Bos et al. | 350/347 |
| 4,595,259 | 6/1986 | Perregaux | 350/331 |
| 4,635,051 | 1/1987 | Bos | 340/757 |
| 4,652,087 | 3/1987 | Bos et al. | 350/332 |
| 4,652,912 | 3/1987 | Masubuchi | 358/59 |
| 4,675,667 | 6/1987 | Nakamura et al. | 340/784 |
| 4,676,602 | 6/1987 | Watanabe | 350/332 |
| 4,709,995 | 12/1987 | Kuribayashi et al. | 350/350 S |
| 4,716,403 | 12/1987 | Morozumi | 340/72 |
| 4,768,092 | 8/1988 | Ishikawa | 358/140 |
| 4,769,639 | 9/1988 | Kawamura et al. | 340/784 |
| 4,770,500 | 9/1988 | Kalmanash et al. | 350/347 E |
| 4,773,026 | 9/1988 | Takahara et al. | 364/518 |
| 4,808,991 | 2/1989 | Tachiuchi et al. | 340/793 |
| 4,822,142 | 4/1989 | Yasui | 350/332 |
| 4,827,255 | 5/1989 | Ishii | 340/793 |
| 4,836,654 | 6/1989 | Fujimura et al. | 350/346 |
| 4,838,655 | 6/1989 | Hunahata et al. | 350/335 |
| 4,842,379 | 6/1989 | Oishi et al. | 350/347 |
| 4,843,381 | 6/1989 | Baron | 340/784 |
| 4,855,724 | 8/1989 | Yang | 340/703 |
| 4,864,290 | 9/1989 | Waters | 340/793 |
| 4,864,538 | 9/1989 | Buzak | 365/128 |
| 4,870,396 | 9/1989 | Shields | 340/719 |
| 4,886,343 | 12/1989 | Johnson | 350/335 |
| 4,917,465 | 4/1990 | Conner et al. | 350/335 |
| 4,921,334 | 5/1990 | Akodes | 350/333 |
| 4,922,241 | 5/1990 | Inoue et al. | 340/784 |
| 4,936,656 | 6/1990 | Yamashita et al. | 350/333 |
| 4,946,260 | 8/1990 | Fujimura et al. | 350/346 |
| 4,950,058 | 8/1990 | Diem et al. | 350/333 |
| 4,952,032 | 8/1990 | Inoue et al. | 350/350 |
| 4,962,376 | 10/1990 | Inoue et al. | 340/784 |
| 4,964,699 | 10/1990 | Inoue | 350/332 |
| 4,980,775 | 12/1990 | Brody | 358/241 |
| 4,982,180 | 1/1991 | Seki et al. | 340/703 |
| 4,989,076 | 1/1991 | Owada et al. | 358/61 |
| 4,991,122 | 2/1991 | Sanders | 364/521 |
| 4,999,619 | 3/1991 | Te Velde | 340/784 |
| 5,010,326 | 4/1991 | Yamazaki et al. | 340/784 |
| 5,012,228 | 4/1991 | Masuda et al. | 340/702 |
| 5,032,007 | 7/1991 | Silverstein et al. | 350/335 |
| 5,039,983 | 8/1991 | Yoon | 340/703 |
| 5,068,649 | 11/1991 | Garrett | 340/793 |
| 5,077,533 | 12/1991 | Buzak | 340/794 |
| 5,092,665 | 3/1992 | Kanbe et al. | 359/56 |
| 5,093,652 | 3/1992 | Bull et al. | 340/701 |
| 5,101,197 | 3/1992 | Hix et al. | 340/784 |
| 5,105,183 | 4/1992 | Beckman | 340/717 |
| 5,105,265 | 4/1992 | Sato et al. | 358/60 |
| 5,107,353 | 4/1992 | Okumura | 359/55 |
| 5,115,305 | 5/1992 | Baur et al. | 358/60 |
| 5,117,224 | 5/1992 | Kawamura et al. | 340/703 |
| 5,119,084 | 6/1992 | Kawamura et al. | 340/784 |
| 5,122,783 | 6/1992 | Bassetti, Jr. | 340/701 |
| 5,124,818 | 6/1992 | Conner et al. | 359/53 |
| 5,126,865 | 6/1992 | Sarma | 359/59 |
| 5,128,782 | 7/1992 | Wood | 309/48 |
| 5,132,826 | 7/1992 | Johnson et al. | 359/93 |
| 5,172,108 | 12/1992 | Wakabayashi et al. | 340/793 |
| 5,172,222 | 12/1992 | Plantier et al. | 358/61 |
| 5,175,535 | 12/1992 | Yamazaki et al. | 340/784 |
| 5,185,602 | 2/1993 | Basetti, Jr. et al. | 340/793 |
| 5,187,603 | 2/1993 | Bos | 359/73 |
| 5,196,834 | 3/1993 | Edelson et al. | 340/703 |
| 5,200,844 | 4/1993 | Suvada | 359/40 |
| 5,202,676 | 4/1993 | Yamazaki | 340/784 |
| 5,204,659 | 4/1993 | Sarma | 340/784 |
| 5,214,417 | 5/1993 | Yamazaki | 340/784 |
| 5,225,823 | 7/1993 | Kanaly | 340/793 |
| 5,227,882 | 7/1993 | Kato | 358/160 |
| 5,227,904 | 7/1993 | Nakanowatari | 359/103 |
| 5,233,338 | 8/1993 | Surguy | 340/784 |
| 5,233,446 | 8/1993 | Inoue et al. | 359/55 |
| 5,237,435 | 8/1993 | Kurematsu et al. | 359/41 |
| 5,245,450 | 9/1993 | Ukai et al. | 359/55 |
| 5,245,455 | 9/1993 | Sayyah et al. | 359/72 |
| 5,251,049 | 10/1993 | Sato et al. | 359/40 |
| 5,252,959 | 10/1993 | Kono | 345/147 |
| 5,264,835 | 11/1993 | Shaw et al. | 345/150 |
| 5,289,173 | 2/1994 | Numao | 345/87 |
| 5,293,534 | 3/1994 | Mihara | 359/84 |
| 5,296,953 | 3/1994 | Kanbe et al. | 359/56 |
| 5,299,039 | 3/1994 | Bohannon | 359/53 |
| 5,313,224 | 5/1994 | Singhal et al. | 345/89 |
| 5,327,229 | 7/1994 | Konno et al. | 348/742 |
| 5,337,068 | 8/1994 | Stewart et al. | 345/88 |
| 5,341,153 | 8/1994 | Benzschawel et al. | 345/152 |
| 5,347,382 | 9/1994 | Rumbaugh | 359/84 |
| 5,359,345 | 10/1994 | Hunter | 345/102 |
| 5,363,117 | 11/1994 | Matsuura et al. | 345/87 |
| 5,365,274 | 11/1994 | Seki et al. | 348/458 |
| 5,381,182 | 1/1995 | Miller et al. | 348/448 |
| 5,386,237 | 1/1995 | Knee | 348/458 |
| 5,396,261 | 3/1995 | Hastings, III | 345/92 |
| 5,410,422 | 4/1995 | Bos | 359/73 |
| 5,412,396 | 5/1995 | Nelson | 345/89 |
| 5,418,572 | 5/1995 | Nonweiler et al. | 348/446 |
| 5,424,780 | 6/1995 | Cooper | 348/428 |
| 5,426,526 | 6/1995 | Yamamoto et al. | 359/82 |
| 5,428,366 | 6/1995 | Eichenlaub | 345/102 |
| 5,444,494 | 8/1995 | Yamamoto et al. | 348/448 |
| 5,455,628 | 10/1995 | Bishop | 348/446 |
| 5,457,551 | 10/1995 | Culter et al. | 359/53 |
| 5,459,498 | 10/1995 | Scheffer et al. | 345/147 |
| 5,467,138 | 11/1995 | Gove | 348/452 |
| 5,471,249 | 11/1995 | Monta et al. | 348/445 |
| 5,473,339 | 12/1995 | Kanatani et al. | 345/87 |
| 5,479,188 | 12/1995 | Moriyama | 345/149 |
| 5,488,387 | 1/1996 | Maeda et al. | 345/89 |
| 5,488,389 | 1/1996 | Nakanishi et al. | 345/131 |
| 5,488,499 | 1/1996 | Tanaka et al. | 359/102 |

| | | | |
|---|---|---|---|
| 5,493,428 | 2/1996 | Kim | 359/54 |
| 5,495,265 | 2/1996 | Hartman et al. | 345/87 |
| 5,495,287 | 2/1996 | Kasai et al. | 345/89 |
| 5,499,036 | 3/1996 | Hauck | 345/3 |
| 5,499,037 | 3/1996 | Nakagawa et al. | 345/89 |
| 5,519,824 | 5/1996 | Lizzi | 395/150 |
| 5,521,727 | 5/1996 | Inaba et al. | 359/56 |
| 5,526,063 | 6/1996 | Joubert et al. | 348/744 |
| 5,528,262 | 6/1996 | McDowell et al. | 345/151 |
| 5,534,884 | 7/1996 | Mase et al. | 345/87 |
| 5,534,926 | 7/1996 | Ohki et al. | 348/385 |
| 5,534,936 | 7/1996 | Kim | 348/448 |
| 5,537,128 | 7/1996 | Keene et al. | 345/89 |
| 5,537,129 | 7/1996 | Okada et al. | 345/90 |
| 5,546,102 | 8/1996 | Scheffer et al. | 345/100 |
| 5,550,662 | 8/1996 | Bos | 359/73 |
| 5,552,801 | 9/1996 | Furuhashi et al. | 345/100 |
| 5,552,840 | 9/1996 | Ishii et al. | 348/751 |
| 5,555,035 | 9/1996 | Mead et al. | 348/757 |
| 5,561,442 | 10/1996 | Okada et al. | 345/94 |
| 5,566,010 | 10/1996 | Ishii et al. | 359/59 |
| 5,572,655 | 11/1996 | Tuljapurkar et al. | 395/788 |
| 5,579,027 | 11/1996 | Sakurai et al. | 345/100 |
| 5,581,383 | 12/1996 | Reichel et al. | 349/116 |
| 5,583,528 | 12/1996 | Ebihara | 345/58 |
| 5,583,534 | 12/1996 | Katakura et al. | 345/97 |
| 5,583,678 | 12/1996 | Nishino et al. | 349/118 |
| 5,594,464 | 1/1997 | Tanaka et al. | 345/94 |
| 5,598,285 | 1/1997 | Kondo et al. | 349/39 |
| 5,627,557 | 5/1997 | Yamaguchi et al. | 345/90 |
| 5,627,560 | 5/1997 | Verhulst | 345/97 |
| 5,640,259 | 6/1997 | Sawayama et al. | 349/33 |
| 5,642,129 | 6/1997 | Zavracky et al. | 345/100 |
| 5,721,597 | 2/1998 | Kakinuma et al. | 349/86 |

FOREIGN PATENT DOCUMENTS

| | | |
|---|---|---|
| 5651352 | 12/1981 | Japan . |
| 8220502 | 8/1996 | Japan . |
| 9101497 | 4/1997 | Japan . |
| 9-265073 | 10/1997 | Japan . |
| 8701468 | 3/1987 | WIPO . |
| 9103003 | 3/1991 | WIPO . |
| 9501701 | 1/1995 | WIPO . |
| 9534986 | 12/1995 | WIPO . |
| 9600479 | 1/1996 | WIPO . |

OTHER PUBLICATIONS

Uchida, Tatsuo, "Application and Device Modeling of Liquid Crystal Displays", Mol. Cryst. Liq. Cryst., vol. 123, 1985, pp 15–55.

Bahadur, Birendra, "Liquid Crystal Displays", Molecular Crystals and Liquid Crystals, vol. 109, No. 1, 1984, p. 32.

SID International Symposium, Digest of Technical Papers, vol. XVIII, 1987, pp 75–78.

Conference Record of 1980 Biennial Display Research Conference, 1980, pp177–179.

Wu, S., "Nematic Liquid Crystal Modulator with Response Time Less Than 100 $\mu$s At Room Temperature", Appl. Phys. Lett. 57 No. 10, Sep. 3, 1990, pp986–988.

Wu. S. et al., "High Speed Nematic Liquid Modulators", 3rd International Topical Meeting on Optis of LCs, Oct. 1–5, 1990, Italy, pp1–15.

Clark, N. et al, "Submicrosecond Bistable Electro–Optic Switching In Liquid Crystals", Appl. Phys. Lett. vol. 36, No. 11, Jun. 1, 1980, pp 899–901, Sayyah, K. et al., "Late–News Poster Color–Sequential Crystalline–Silicon LCLV–Based Projector for Consumer HDTV", Hughes Research Laboratories, Malibu, CA, SID 95' Digest, 1995, pp 520–523.

Okada, H. et al., "An 8.4–in. TFT–LCD System for a Note–Size Computer Using 3–Bit Digital Data Drivers", Japan Display 1992, pp 475–478.

Fujisawa, T. et al., "Electro–Optic Properties and Multiplexibility for Polymer Network Liquid Crystal Display (PN–LCD)", Japan Display, vol. 690 (1989), pp 690–693.

Electro-optic Curve for Normally White Liquid Crystal

DISPLAY SYSTEM HAVING ELECTRODE MODULATION TO ALTER A STATE OF AN ELECTRO-OPTIC LAYER

The present application is a continuation-in-part of co-pending U.S. patent application Ser. No. 08/801,994, which was filed on Feb. 18, 1997, which is a continuation-in-part of co-pending U.S. patent application Ser. No. 08/770,233, which was filed on Dec. 19, 1996 by the same inventor under the title "Display System Having Common Electrode Modulation". This present application hereby claims the benefit of these earlier filing dates under 35 U.S.C. §120.

BACKGROUND OF THE INVENTION

1. Field of the Invention

The present invention relates generally to a display system, such as a liquid crystal display system. The present invention also relates to a system for providing electrical driving of an electrode of a display system. More particularly, the invention relates to a system for electrically driving an electrode of a display system to various voltages in a controlled phase relationship to the update of pixel data.

2. Background of the Related Art

A class of display systems operate by electrically addressing a thin, intervening layer of electro-optic material, such as liquid crystal, which is positioned between two substrates. In these display systems, it is important to achieve good display characteristics including: color purity, high contrast, high brightness, and a fast response.

High independence of frames or subframes ensures the lack of coupling between intensity values at a given pixel from one frame to the next. For example, if a pixel is to be at its brightest gray level during a first frame and then at its darkest gray level at the next frame, then a high independence would ensure that this is possible whereas a low independence would cause the pixel to appear brighter than the darkest gray level during the second frame. This coupling can cause problems such as motion smearing. High frame-to-frame independence is important whether or not the display is a color or black-and-white (monochrome) or gray-scale display.

The level of contrast achievable is determined by the range of intensity attainable between the brightest gray level and the darkest gray level for a given pixel within a given frame or subframe.

In addition to contrast, it is desirable that the display be capable of displaying a bright image since brighter images are perceived as having a higher quality by a user.

Finally, the speed of display is determined by its ability to display one frame after the other at a high rate. If visual motion is to be displayed, flicker and other problems can be avoided only if the full color frames are displayed at a rate of at least 30 Hz and preferably 60 Hz or faster.

This speed requirement becomes even more stringent if the display does not contain a red, green, and blue pixel all at one pixel location (in other words, red, green and blue subpixels for each pixel location) but instead only has a single pixel. One type of such a display is a color sequential liquid crystal display as discussed in "Color-Sequential Crystalline-Silicon LCLV based Projector for Consumer HDTV" by Sayyah, Forber, and Efrom in SID digest (1995) pages 520–523. In those types of displays, if a display requires the sequential display of the red, green, and blue subframes, those subframes must be displayed at yet a rate higher than 90 HZ and preferable greater than 180 HZ to avoid flicker. For color sequential displays, high frame or subframe independence is required to display images with good color purity.

Any of the general display systems that operate by electrically addressing a thin, intervening layer of electro-optic material, such as liquid crystal, which is positioned between two substrates include the following characteristics. At least one of the two substrates is transparent or translucent to light and one of the substrates includes a plurality of pixel electrodes. Each pixel electrode corresponds to one pixel (or one subpixel) of the display, and each of the former may be driven independently to certain voltages so as to control the intervening electro-optic layer in such a way as to cause an image to be displayed on the electro-optic layer of the display. Sometimes each pixel can include a color triad of pixel electrodes. The second substrate of such a prior art display system has a single electrode, known as the common electrode or cover glass electrode, which serves to provide a reference voltage so that the pixel electrodes can develop an electric field across the intervening layer of electro-optic material.

One example of such a system is a color thin film transistor (TFT) liquid crystal display. These displays are used in many notebook-sized portable computers. Colors are generated in these displays by using RGB pixel triads in which each pixel of the triad controls the amount of light passing through its corresponding red, green, or blue color filter. These color filters are one of the most costly components of a TFT display.

The major obstacle of display systems of this type is that the results of replicating the pixel electrodes, data wire, and thin film transistors, three times at each color pixel are increased cost and reduced light transmission, requiring more peripheral backlights and increased power consumption.

The other issues of high frame-to-frame independence, high contrast, and brightness become even more difficult to achieve as display rates increase.

Many approaches have been implemented to improve display characteristics of the above type displays. One common approach involves the use of a common electrode driving circuit and driving that common electrode with as flat a common electrode rectangular driving voltage as possible. By doing so, the voltage across the liquid crystal portion at that pixel is more constant, which in turn should yield improved contrast and pixel brightness.

For example, U.S. Pat. No. 5,537,129 discloses a display system with a common electrode which attempts to achieve a flat rectangular common electrode driving voltage. Referring to FIG. 2 of that patent, a common electrode 24 is connected to its driving circuit 20 through a resistor 3*b*. This corrects for resistive losses at 3*a* and capacitive coupling to the common electrode 24 from pixels and data wires. This ensures that detection device 21 with a high input impedance can be used to make a correction so the output voltage appears to be more rectangular-like. FIGS. 5, 9*b*, 11(*c*), and 11(*d*) of that U.S. patent all show the desired rectangular waveforms.

Another example of this is shown with U.S. Pat. No. 5,561,442, which shows that with the properly applied common electrode voltage Vc(t) when coordinated with the previous gate wire voltage Vs(t) and the current gate wire voltage Vg(t), can yield a flat rectangular voltage V(t)−Vc(t) across the liquid crystal ($C_{LC}$). This scheme involves a complicated modulation scheme coordinating modulation voltages at gate wires in relation to the modulation of the voltage at the common electrode in order to achieve their desired flat rectangular modulation of voltage across the liquid crystal.

Another approach to improving display systems which use an electro-optic material, such as a liquid crystal, is to use a miniature display with a reflective substrate. The image generated by the reflective substrate is magnified for either direct viewing or projected viewing. An advantage of this type of miniature display relative to large screen TFT liquid crystal displays is that the yield achieved in manufacturing these miniature displays is significantly higher than the yield achieved when manufacturing large screen TFT or other types of large screen liquid crystal displays. One drawback with miniature displays, however, is that the small size often places constraints on the optics used to magnify the image. For example, if it is desired to build a miniature display in a miniature housing, the optical paths between optical elements is relatively short, and this causes a number of optical problems. These problems increase when polarized light is required to be used with liquid crystal displays as is often required. The requirement of polarized light often requires a polarizing beamsplitter to be placed into the optical system. It is often difficult to obtain enough working distance between the last element in the lens of the miniature display system and the display on the reflective substrate in order to include a beamsplitting element.

The polarizers also tend to significantly reduce the effective amount of light from the illuminator because the polarizers tend to transmit only a portion of the light generated by the illuminator.

One approach to avoid these problems with miniature displays is to use polymer dispersed liquid crystal materials as the electro-optic layer in the miniature display. If polymer dispersed liquid crystals (PDLC) are used, then polarized light is not required and thus the efficiency of the use of light from the illuminator is greatly increased. Moreover, these systems do not require a beamsplitter and thus do not place as much constraints on the design of an optical system in a small head mounted miniature display system which uses reflective substrates.

A polymer dispersed liquid crystal comprises a polymer matrix which contains small inclusions of liquid crystal material. There is no global alignment present without the application of an electric field, so the director alignments of the individual inclusions of liquid crystal material are randomly oriented with respect to one another. This is shown in FIG. 19A which shows the polymer 1905 containing five inclusions 1907*a,* 1907*b,* 1907*c,* 1907*d,* and 1907*e,* each of which contain liquid crystal material 1909. No electric field is present between the common electrode (e.g. cover glass electrode) 1903 and the pixel electrodes 1911*a,* 1911*b,* and 1911*c* on the substrate. It is noted that within each inclusion of liquid crystal material, the liquid crystal material itself may be aligned within the inclusion, although this is not shown in FIG. 19A. The random alignment of the individual inclusions of liquid crystal material relative to each other causes a scattering of incident light. Thus light directed through the display or at least through the electro-optic layer is scattered.

The alignment of the liquid crystal material in all of the inclusions can be controlled by the application of an electric field. This is shown in FIG. 19B in which an electric field of +X volts is applied between the common electrode 1903 and the pixel electrodes 1911*a,* 1911*b,* and 1911*c.* If all the inclusion directors are made to align parallel to each other and, for example, parallel to the direction of incident light, a suitable choice of refractive index of the liquid crystal material and the polymer can cause the scattering to be substantially reduced. A modulator can thus be made by using an optical system which is sensitive to scatter. Unlike many other liquid crystal effects, the scattering effect does not require the incident light to be polarized. These types of liquid crystal displays which utilize scattering are often useful in certain display applications, especially projection display systems, because the polarizers are a major source of light loss. The scattering mechanism also lends itself to systems which use imaging optics after the liquid crystal display. These optics typically contain a mechanism which is sensitive to the scattering effects in the PDLC layer. This may be an aperture or obstruction, for example.

While miniature or larger display systems may use PDLC material for an electro-optic layer, these materials have the drawback of traditionally being relatively slow in response time and also requiring high voltages in order to achieve a change in optical state in the electro-optic layer.

SUMMARY OF THE INVENTION

The present invention provides various methods and apparatuses for controlling a voltage on an electrode which is used to alter the state of an electro-optic material, such as a polymer dispersed liquid crystal layer, such that display data cannot be viewed even if pixel electrodes contain pixel data thereon. This control voltage is typically provided in a controlled phase relationship relative to the update of pixel data in order to achieve, at least in some embodiments of the present invention, frame-to-frame independence, even at high rates of display.

A display system in one embodiment of the present invention includes a first substrate having a first plurality of pixel electrodes for receiving a first plurality of pixel data values representing a first image to be displayed and also includes an electro-optic layer which is operatively coupled to the pixel electrodes and an electrode operatively coupled to the electro-optic layer. The electro-optic layer includes a polymer dispersed liquid crystal material. This display system displays the first image and then applies a first control voltage to the electrode to alter a state of the electro-optic layer such that the first image is substantially not viewable and thus not displayed, and then the display system displays a second image represented by a second plurality of pixel data values after the electrode receives a second control voltage.

Typically, at least in some embodiments of the present invention, the electro-optic layer is a polymer dispersed liquid crystal material and the electrode is a common cover glass electrode. This common cover glass electrode and the first substrate forms a structure around the polymer dispersed liquid crystal layer such that the first substrate is below the liquid crystal layer and the common cover glass electrode is above the liquid crystal layer. At least in some embodiments, the first control voltage causes the polymer dispersed liquid crystal layer to alter its light altering state to turn the display "dark" even if pixel data on the pixel electrodes is still present and would otherwise cause the display to appear white or some other color other than black. When the first control voltage is applied to the electrode, the polymer dispersed liquid crystal (PDLC) material is placed into a first light altering state such that light is not substantially scattered when passing through the PDLC material. By arranging the illumination source at an angle relative to the substrate and the PDLC material, the light from the illumination source is reflected off the PDLC material without scattering (when the first control voltage is applied) and this reflected light does not enter a collection angle of an imaging optical system which is designed to collect light from the PDLC material to generate an image. After the display has been set in a state such that the first image is not viewable, then the display system displays a second image by causing the electrode to receive a second control voltage which releases the liquid crystal material from its state in which substantially no display data is viewable. The second control voltage, when applied to the electrode, allows the PDLC material to enter a second light altering state in which light is capable of being scattered as it passes through the PDLC material. Typically, at least some pixels in the display system will scatter light which directs the scattered light toward the collection angle of the imaging optical system so that an image is displayed. Normally, non-polarized light may be directed to the substrate since polarization is not normally required in this display system.

There are numerous alternative embodiments of the present invention. For example, the cover glass electrode may exist in separate segments and these segments may be controlled separately such that while one segment is displaying a portion of an image, the other segment is being loaded with pixel data for another portion of the same image and at the same time this other portion is not displaying data because its control electrode in that segment is causing the liquid crystal material in that segment to obscure the data such that it is not viewable.

The present invention may be used in either time sequential color systems or in color systems which employ a triad of subpixels for each pixel. Moreover, the present invention may be employed with or without frame buffering for the next frame while the current frame is being displayed, where this frame buffering may be provided in pixel buffers which are disposed in the same substrate which includes the pixel electrodes. Moreover, the present invention may be used in liquid crystal display devices which are of the reflective type, or alternatively may be used in liquid crystal display devices which are of the transmissive type. Furthermore, the electrode modulation of the present invention may be employed in a system wherein the electrode which performs the modulation (in order to drive the liquid crystal to a state in which display data is not substantially viewable) is disposed in the same substrate as the pixel electrodes. The present invention in certain embodiments may also include compensating electrodes disposed in the same substrate with the pixel electrodes which compensate for the action of the control electrodes which are causing the display to be not viewable according to certain embodiments of the present invention.

At least some embodiments of the present invention provide various advantages which are described below, although it will be appreciated that certain embodiments of the present invention may only provide some, if any, of these advantages depending on the implementation of the embodiment. For example, the present invention may be used to provide for a display system in which the pixel outputs on the display are simultaneously updated with new data rather than being updated on a row-by-row basis when no frame buffering is used. Moreover, the invention may be used to provide a display system in which there is high frame-to-frame independence, even at high frame rate frequencies. Another advantage of the present invention, at least in some embodiments, is that by simultaneously varying the voltage which drives the control electrode and the voltages which drive the pixel electrodes, a larger average voltage difference can be achieved across the layer of electro-optic material, thereby improving brightness. In another embodiment of the present invention, a voltage greater that the maximum and minimum voltages allowed for driving the pixel electrodes can be used as the control voltage signal applied to the control electrode. This advantage may be useful in a situation where the liquid crystal electro-optic effect has a threshold below which no optical effect occurs. Another advantage of the present invention in certain embodiments is that if the control electrode voltage is modulated with a burst of relatively high frequency oscillation, a dual-frequency liquid crystal display can be driven rapidly.

BRIEF DESCRIPTION OF THE DRAWINGS

The various embodiments of the present invention will be described in detail with reference to the following drawings in which like reference numerals refer to like elements.

FIG. 9A also shows the intensity of certain pixels over time relative to the waveforms shown in FIG. 9A.

DETAILED DESCRIPTION

The following description provides examples of the present invention. It will be appreciated, however, that other examples of the present invention will become apparent to those in the art upon examination of this description. Thus, the present description and the accompanying drawings are for purposes of illustration and are not to be used to construe the invention in a restrictive manner.

Figure 1A:
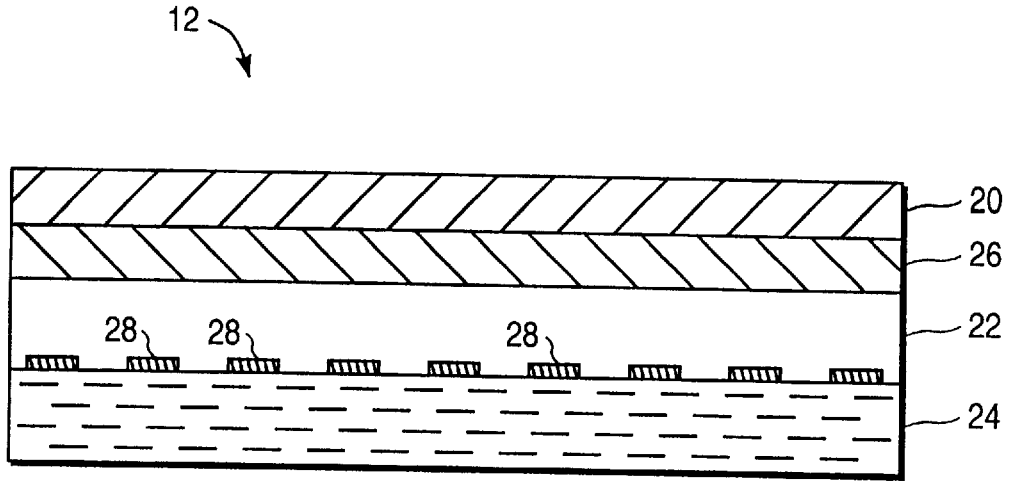
FIG. 1A shows a cross-sectional view and FIG. 1B shows a perspective view of an image display system according to one embodiment of the invention.
Figure 1B:
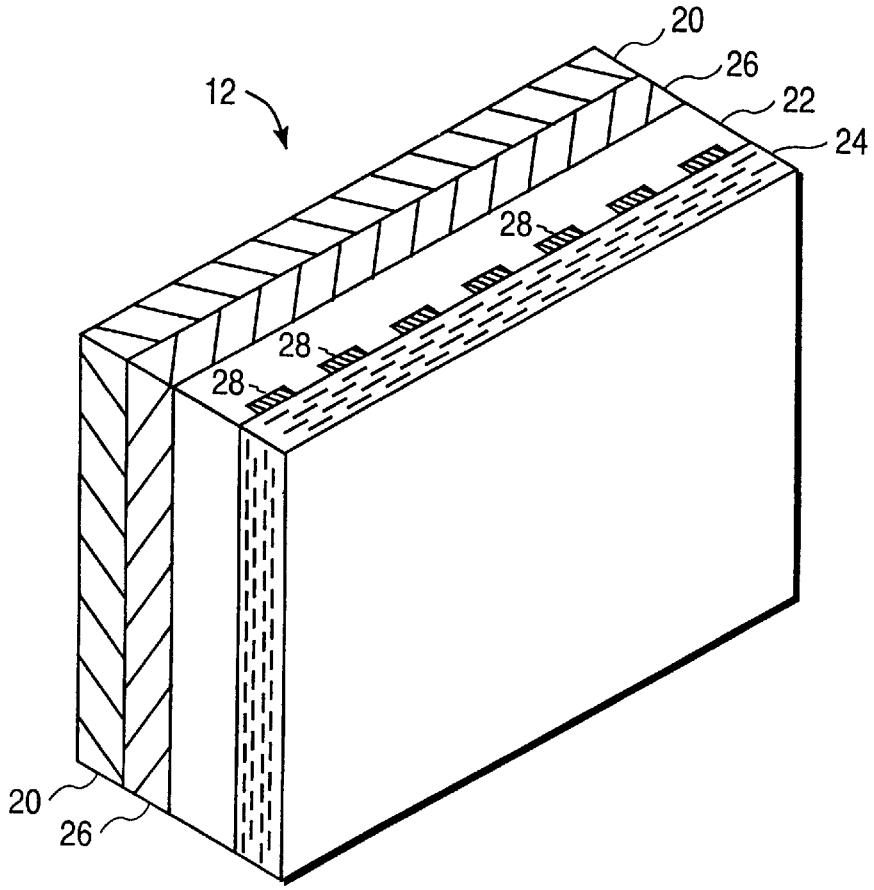

FIG. 1A shows a cross-sectional view of a display system 12 according to one embodiment of the present invention, in which an electro-optic layer 22 is disposed between a first substrate 20 and a second substrate 24. First substrate 20 has a single control electrode known as a common electrode 26 or a cover glass electrode 26. The second substrate has a plurality of pixel electrodes 28 each of which periodically acquires updated image data in an independent manner. Each pixel electrode 28 retains the image data required for a given period of time or duration, after which the acquired image data is replaced with new image data. A voltage applied to each pixel electrode relative to a voltage on the common electrode 26 will cause a voltage to appear across the liquid crystal material ($V_{LC}$) which will then control the light altering properties of the liquid crystal such that the liquid crystal may be selectively placed in at least two light altering states. Typically these states include either allowing light to pass through the display system or not allowing the light to pass through the display system. At least one of the first substrate 20 and the second substrate 24 is transparent or translucent to light. According to one embodiment of the invention, the electro-optic layer 22 may comprise liquid crystal material, and the display system 12 may comprise a liquid crystal display. It will be appreciated that other layers may also be present in the structure of the display system 12, such as alignment layers or optical coatings (e.g. anti-reflective coatings)) and that other layers may be used with the display system 12, such as a polarizing layer or layers. FIG. 1B shows a prospective view of the same display system shown in FIG. 1A. The display system 12 may be a thin film transistor (TFT) system which may be a transmissive type liquid crystal display device or it may be a reflective type liquid crystal display device such as a liquid crystal on silicon substrate device, such as that described in U.S. Pat. No. 5,426,526, which is hereby incorporated herein by reference.

Figure 2A:
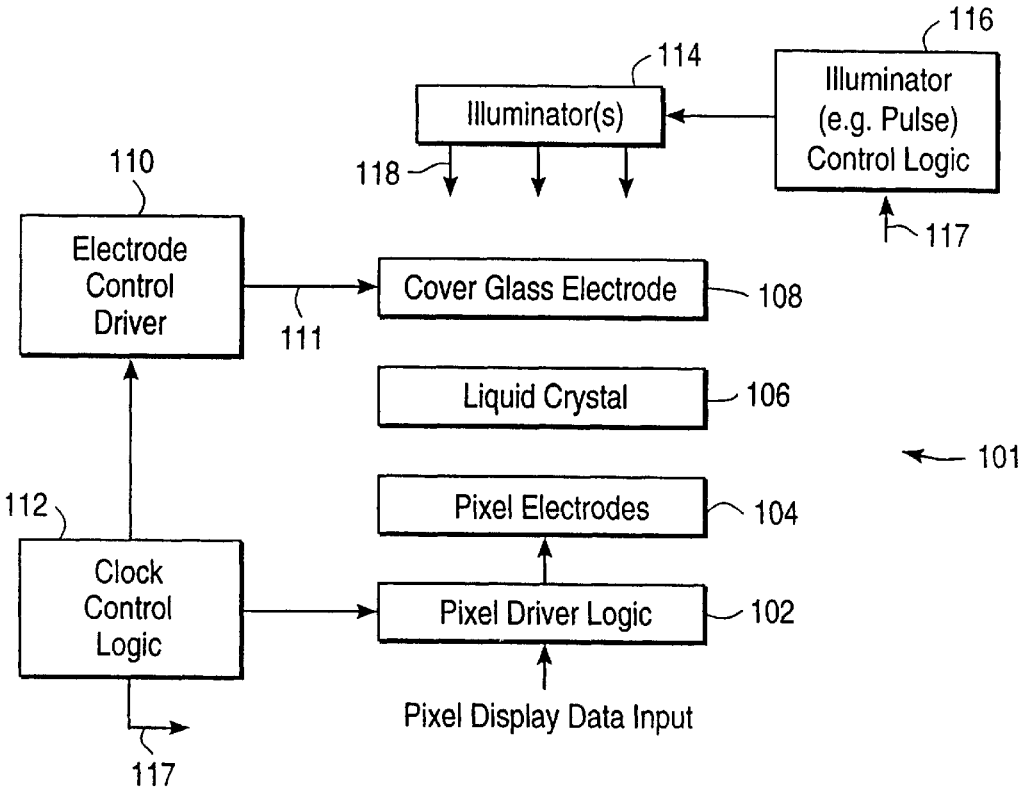
FIG. 2A shows a block diagram representation of a system according to one embodiment of the present invention; this embodiment is a reflective-type liquid crystal display, and it will be appreciated that transmissive-type liquid crystal displays may also be implemented according to the present invention.

FIG. 2A shows a display system 101 according to one embodiment of the present invention. This embodiment employs a reflective type liquid crystal on silicon display system which includes pixel driver logic 102, pixel electrodes 104, a liquid crystal layer 106, and a cover glass electrode 108. The system also includes clock control logic 112, an electrode control driver 110, as well as illuminator 114 and the illuminator control logic 116.

In the system 101, the illuminator 114 may provide white light in the case of a spatial colored display system or it may provide in a controlled time sequence three different color lights (e.g., a red light, and then a green light, and then a blue light each provided separately). The illuminator 114 provides this light 118 through the control of the illuminator control logic 116 which receives clocking signals or control signals 117 from the clock control logic 112. The clock control logic 112 also controls the electrode control driver 110 in order to provide the proper modulated control signal waveforms 111 to the cover glass electrode 108. At the same time, control clock logic 112 also provides clocking signals to the pixel driver logic 102 or it may receive signals from the pixel driver logic 102 in order to coordinate a controlled phase relationship between the control voltage signals applied to the cover glass electrode and the timing of loading and displaying of pixel data onto and through the pixel electrodes 104. The various modes of operation of this system 101 will be described below according to the various embodiments of the present invention.

Figure 2B:
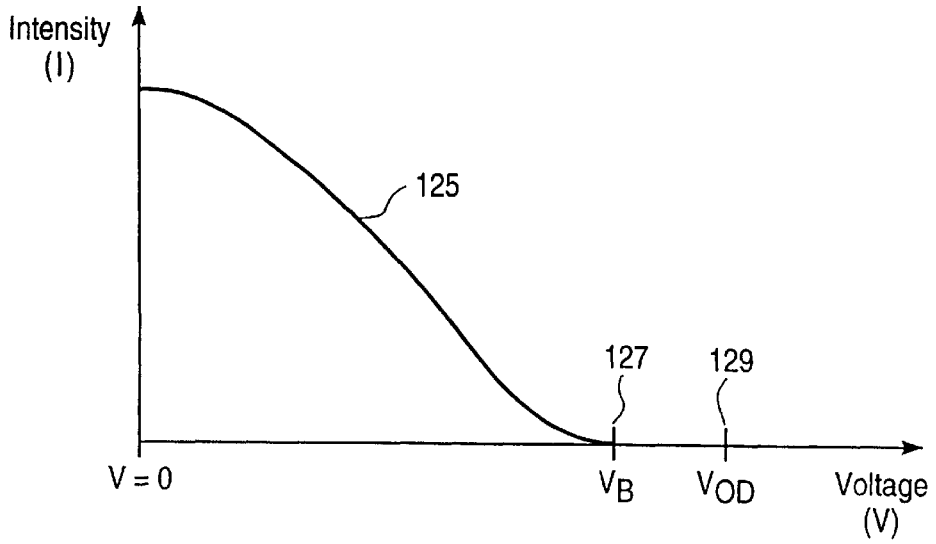
FIG. 2B shows an electro-optic curve for an example of a normally white liquid crystal.

FIG. 2B shows an intensity versus voltage graph displaying an electro-optic curve for a normally white liquid crystal cell configuration. This curve 125 has the highest intensity at the lowest voltage, which may be zero volts. That is, the light altering state of this liquid crystal is such that the most light is transmitted through the liquid crystal at this lowest voltage state. As the voltage across the liquid crystal increases, the intensity of the light transmitted through the liquid crystal decreases to the point where no light is transmitted at voltage point 127 which has been referred to as the holding to black voltage or $V_B$ 127. According to the present invention, an electrode, such as the cover glass electrode, may be applied a voltage relative to the voltages on the various pixel electrodes such that throughout the liquid crystal layer or at least segments thereof, the voltage across the liquid crystal layer is at or exceeds $V_B$. According to certain embodiments of the present invention, the voltage applied to this control electrode may be such that the voltage across the liquid crystal is at point 129, which is an overdrive voltage or $V_{OD}$. This overdrive voltage may be used to rapidly drive the liquid crystal display material to a state in which light does not transmit through it such that the display data is otherwise not viewable even if the display data is stored on the pixel electrodes.

Figure 2C:
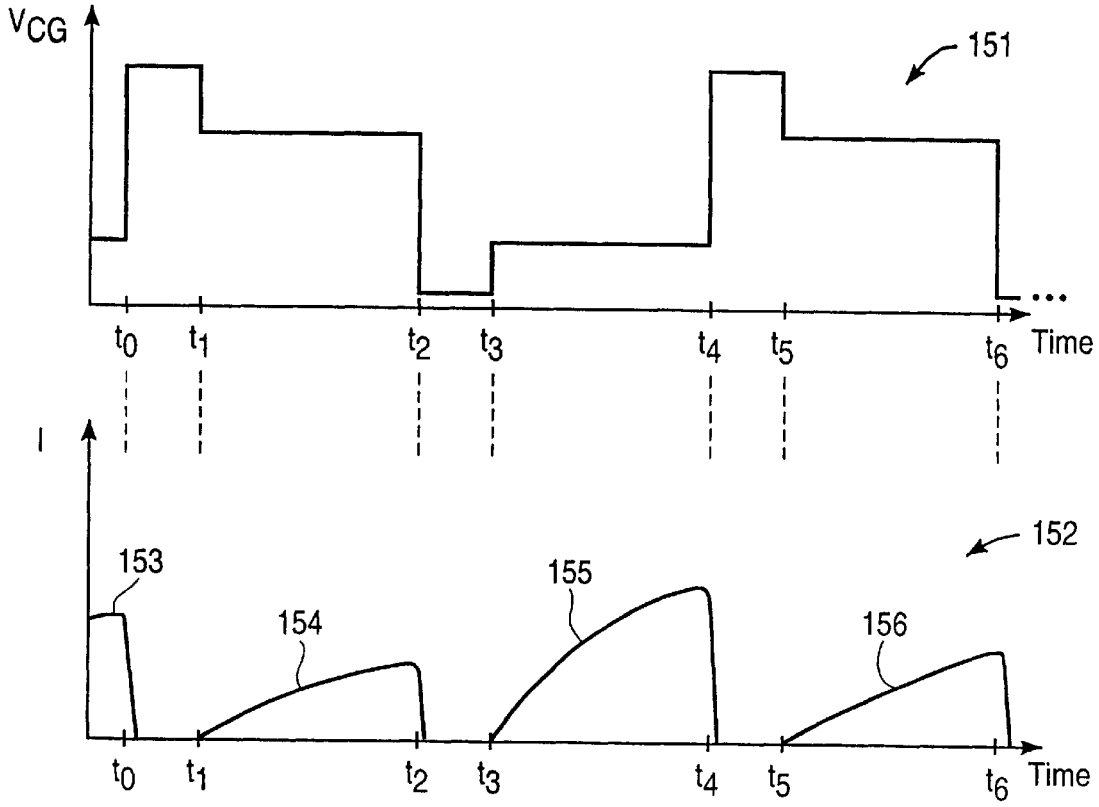
FIG. 2C shows a waveform for a cover glass modulation according to the present invention in conjunction with an intensity versus time graph depicting the behavior of a liquid crystal material under the control of the cover glass waveform also shown in FIG. 2C.

FIG. 2C shows two time related graphs which indicate the relationship between the control voltage applied to the control electrode, such as the cover glass electrode, and the intensity of the pixels in a liquid crystal display of the present invention. The voltage waveform 151 of FIG. 2C shows the control signal applied to the electrode, and the intensity waveforms 152 of FIG. 2C shows the corresponding intensity waveforms at the corresponding times. At time to the voltage applied to the electrode (shown, for example, as $V_{CG}$ in the example where the electrode is the cover glass electrode) is ramped up to a point at which the voltage across the liquid crystal is at least at $V_B$. This causes the intensity of the pixel to drop rapidly as shown by the pixel intensity curve 153. Then between the times $t_0$ and $t_1$ the next pixel display data may be loaded onto the pixel electrode while the display is held in a state in which display data is not visible due to the voltage applied to the control electrode such that the voltage across the liquid crystal ($V_{LC}$) is at or exceeds $V_B$. At time $t_1$ the voltage on the control electrode is reduced, as shown in the voltage waveform 151, such that the voltage across the liquid crystal is less than $V_B$. At this point, it is now possible to display and view the pixel data because the pixel electrodes can now control the state of the liquid crystal. At this point beginning at time $t_1$, the liquid crystal begins to return to a light altering state as shown by the pixel intensity curve 154. Typically, the liquid crystal material will be relaxing to a light altering state which allows more light to pass through. As shown by the pixel intensity curve 154, the liquid crystal may continually relax throughout the entire time period $t_1$ through $t_2$ and may not "plateau" or otherwise reach a steady state. This effect will be discussed further below, but it will be noted that with the present invention this is not necessarily a disadvantage because all such pixels may be producing the same effect and yet the viewer can still see the various gradations of color or gray-scale in the image. At time $t_2$, a first control voltage is again applied to the control electrode such as the cover glass electrode to again drive rapidly the liquid crystal material to a state in which the display data is not visible as shown in the waveform 152 between times $t_2$ and $t_3$. At time $t_3$, the voltage on the control electrode is changed from the first control voltage to a second control voltage such that display data may be visible as shown by the pixel intensity curve 155 between times $t_3$ and $t_4$. It will be appreciated that the control voltage waveform 151 which is applied to the control electrode is a DC balanced signal (around some level) and that over time it averages to that DC level. It will be appreciated that the present invention may be used with DC balanced control signals or without DC balanced control signals, but that there are advantages of using DC balanced control signals.

Figure 2D:
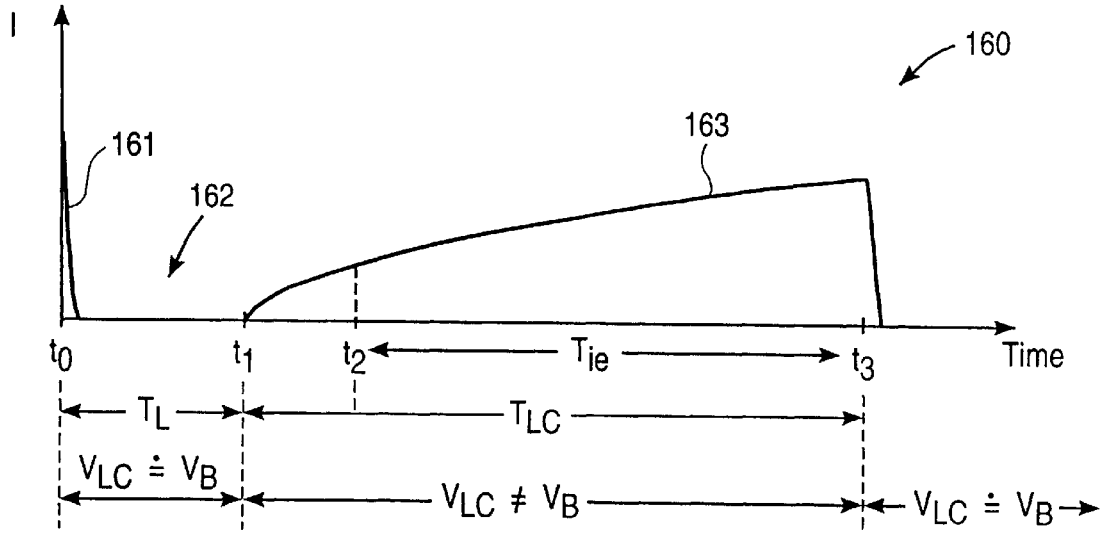
FIG. 2D shows in further detail a portion of the intensity versus time graph for a liquid crystal under the control of a cover glass electrode or other electrode modulated according to the present invention.

FIG. 2D shows in further detail one frame or subframe of a method of the present invention. In particular, a pixel intensity waveform 160 is shown in FIG. 2D as having three portions or curves 161, 162, and 163. Curve 161 illustrates the rapid drive to black of the liquid crystal material upon the application of a control voltage to the control electrode which causes the voltage across the liquid crystal to be approximately equal to $V_B$. During the time in which this control voltage is applied to the control electrode, the pixel intensity is at its lowest as shown by curve 162. It will be appreciated that rather than driving the liquid crystal material entirely to black, the liquid crystal may be driven substantially to a dark state such that the image may be barely discernible. In this alternative embodiment, there still may be substantial benefits derived from driving a liquid crystal state such that the display data is substantially not viewable in order to achieve frame-to-frame independence.

During the time between $t_0$ and $t_1$, the next pixel data may be loaded into the pixel electrode as indicated by the time $T_L$. This is also the time during which the display is kept in its dark state by keeping the voltage across the liquid crystal preferably at or above $V_B$. At time $t_1$, the control voltage on the control electrode is released to a second control voltage such that the voltage across the liquid crystal changes, thereby allowing the liquid crystal to relax to various light altering states and allowing display data to be viewable. This is shown by the pixel intensity curve 163 which indicates the intensity of the pixel rising as the liquid crystal continues to relax during the relaxation time designated as TLC which occurs between times $t_1$ and $t_3$. According to various embodiments of the present invention, it may be desirable to provide illumination during the entire time from $t_1$ to $t_3$ or only a portion of the time such as that shown in FIG. 2D. In particular, FIG. 2D shows illumination of the pixel only during the times $t_2$ through $t_3$. In another embodiment, pulses of light during portions of time within the period $t_2$ through $t_3$ may be provided rather than continuously illuminating the display from time $t_2$ through $t_3$. The frame or subframe cycle ends at $t_3$ when the first control voltage is again applied to the control electrode such that the voltage across the liquid crystal is substantially at $V_B$ (or preferably at or above $V_B$).

Figure 3A:
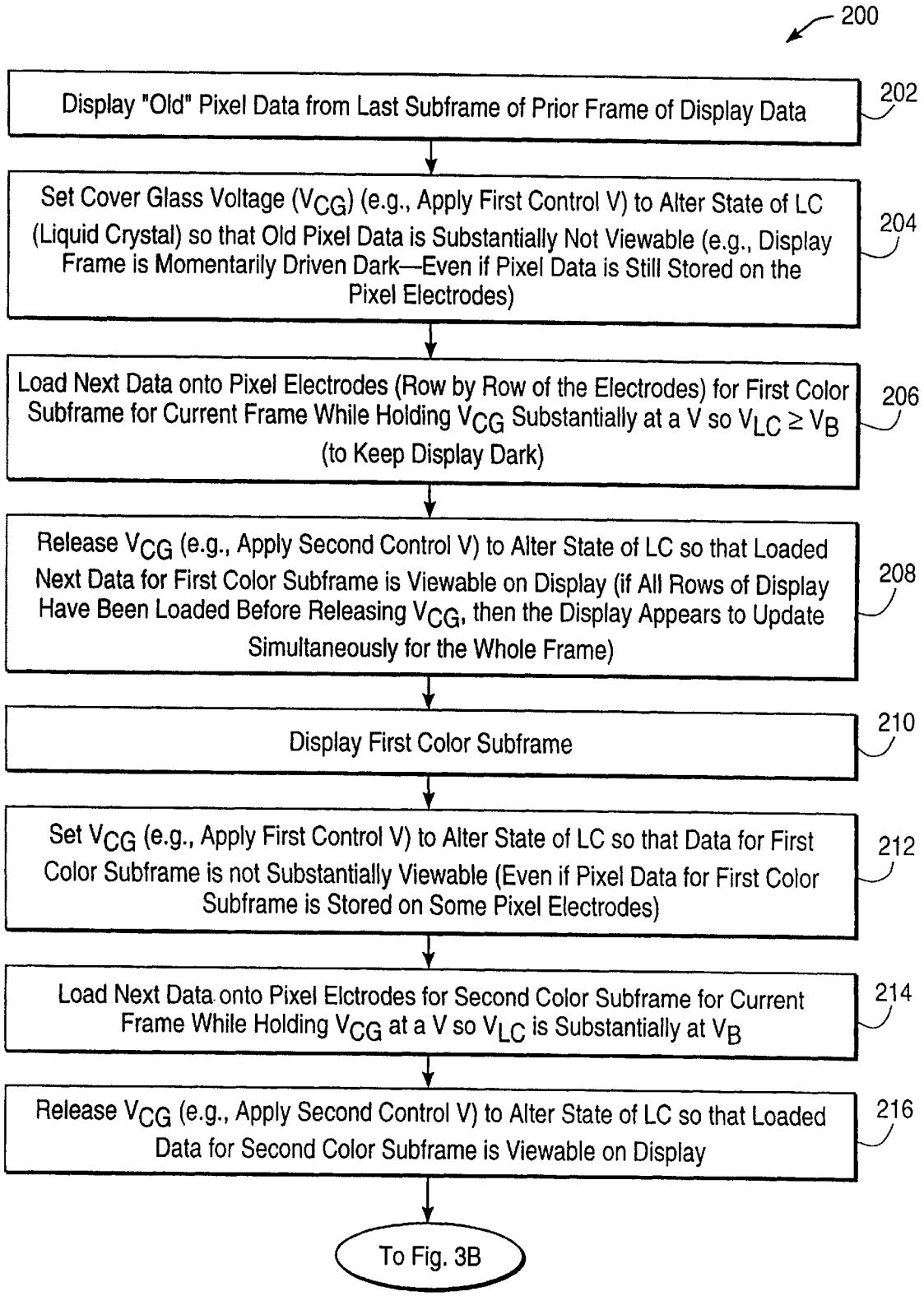
FIGS. 3A and 3B depict a flowchart illustrating a time sequential liquid crystal display system of the present invention without frame buffering of new pixel data while old pixel data is being displayed.
Figure 3B:
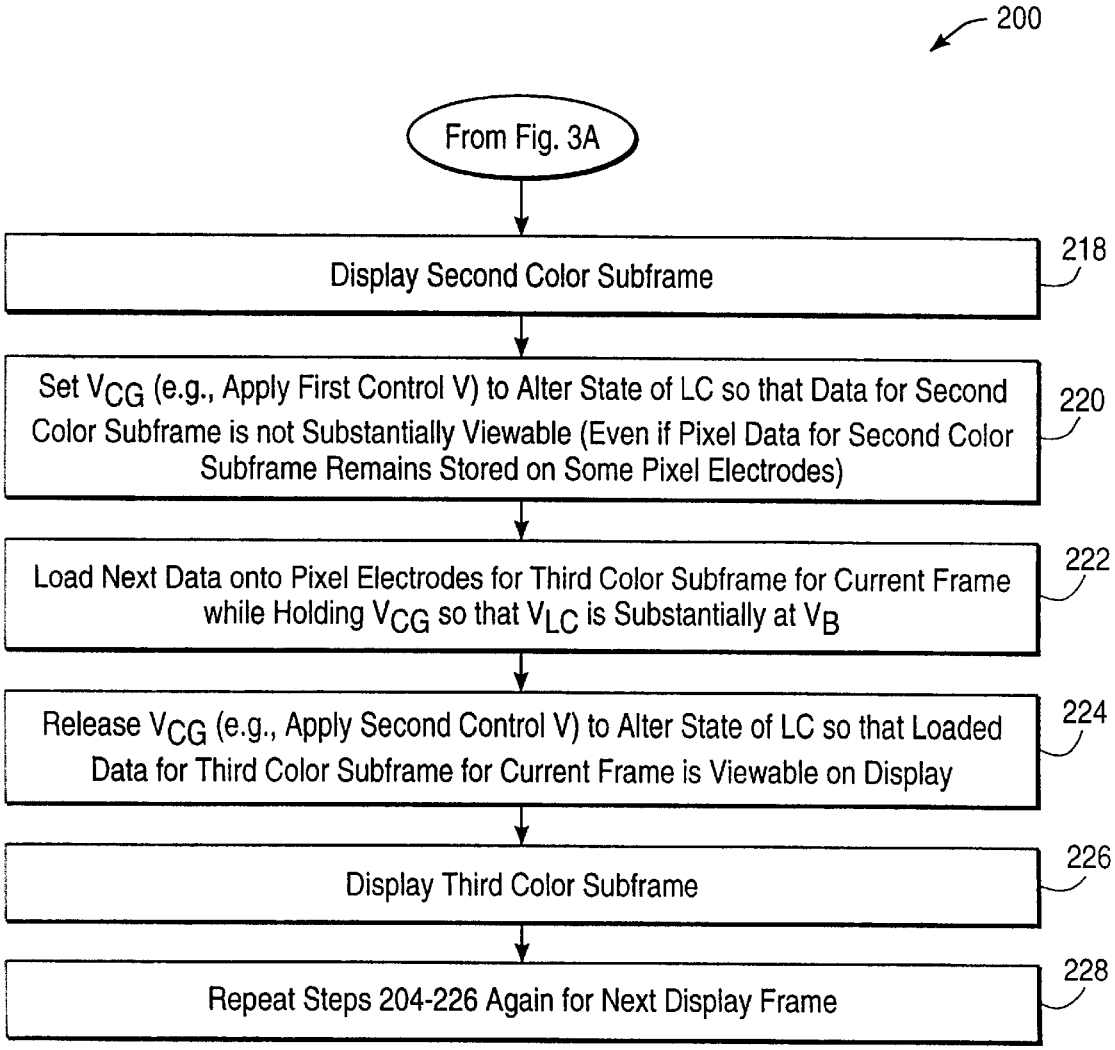
Figure 4A:
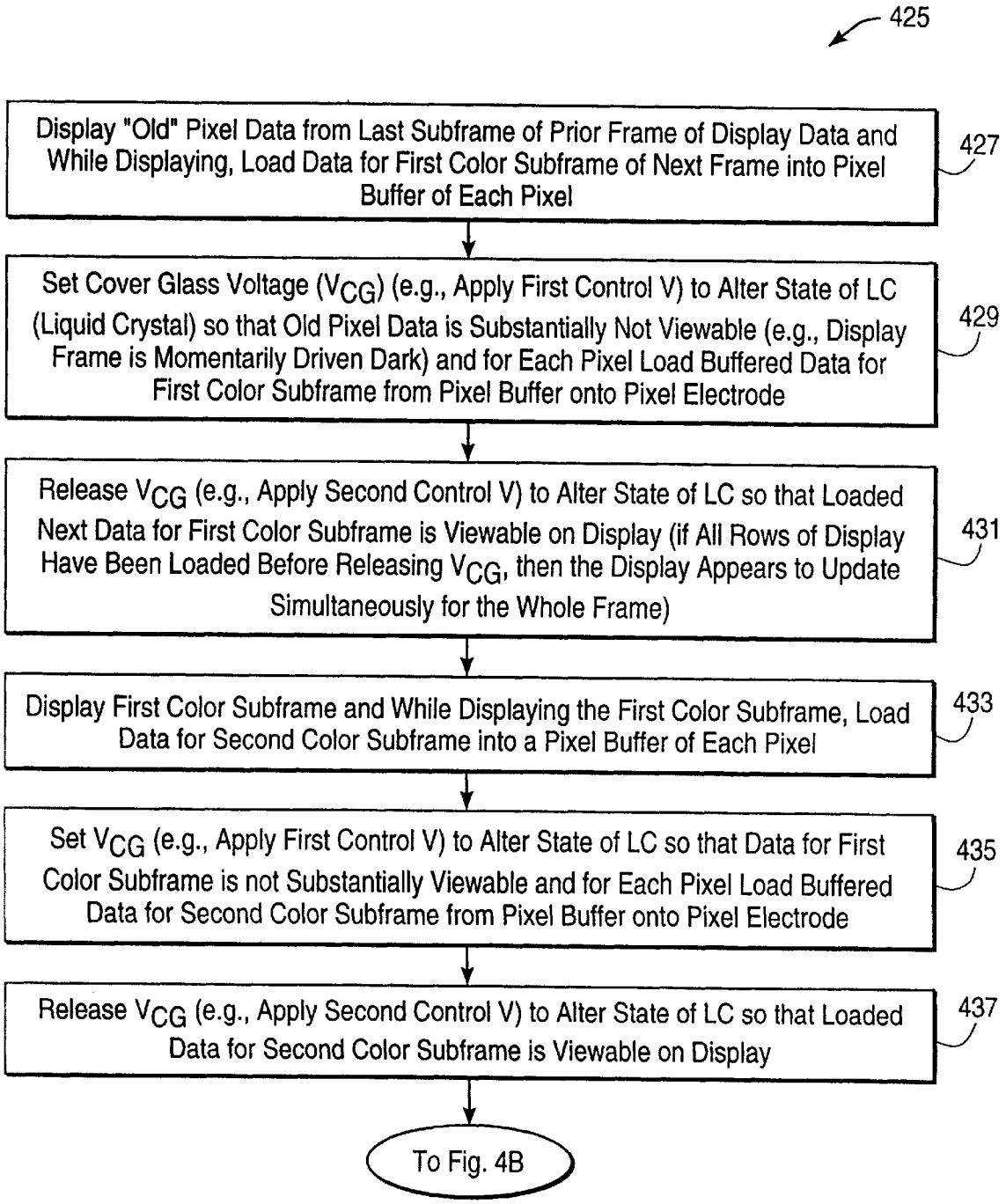
FIGS. 4A and 4B depict a flowchart illustrating an embodiment of the present invention which uses time sequential color subframes with frame buffering.
Figure 4B:
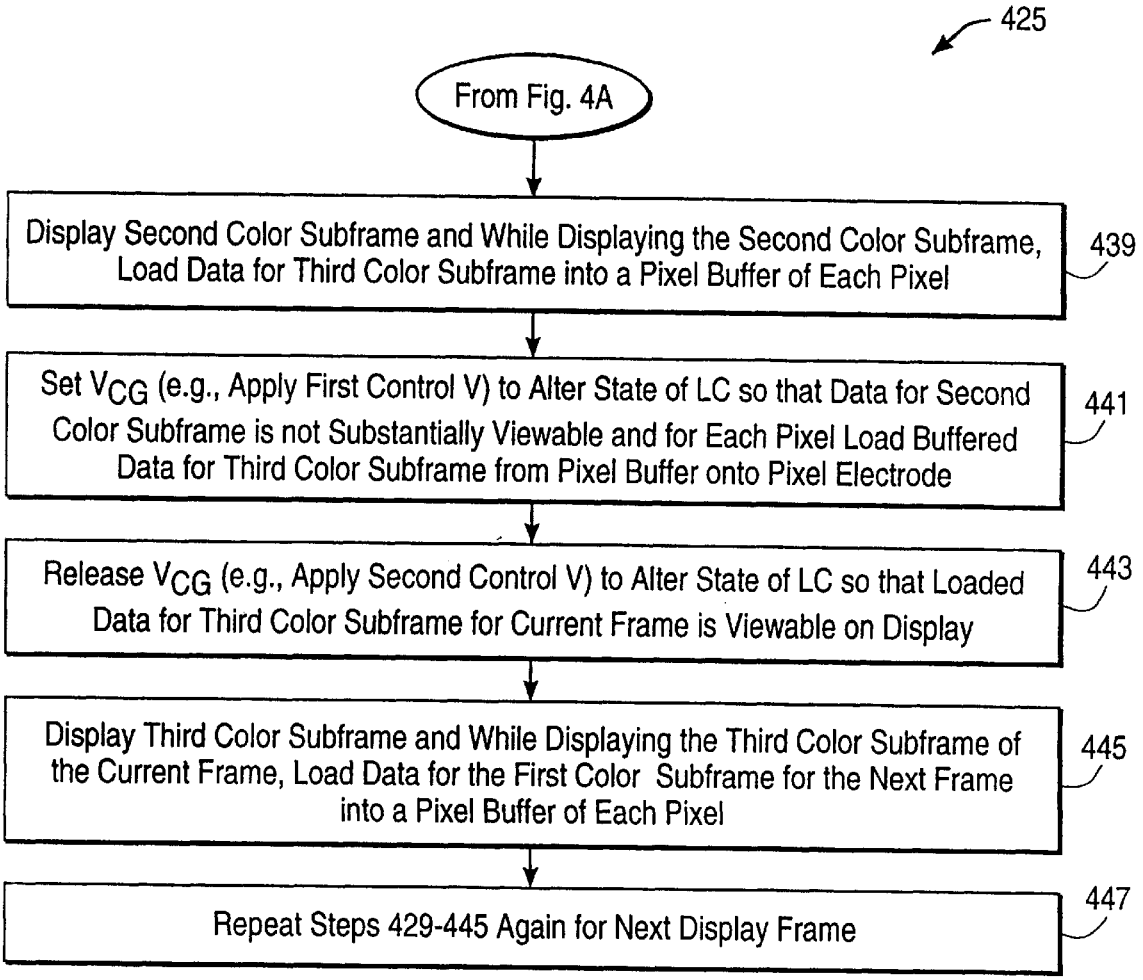

FIGS. 3A and 3B show a particular method of the present invention which is used in a time sequential color display system without any frame buffering in pixel buffers associated with pixel electrodes on the same substrate. FIGS. 4A and 4B show a similar system but with such frame buffering. The method shown in FIGS. 3A and 3B will be described first.

The method 200 may be considered to begin in step 202 in which "old" pixel data may be displayed from the last subframe of the prior frame of display data. Following the end of that display time, in step 204, the cover glass voltage is set by applying a first control voltage to alter the state of the liquid crystal so that the old pixel data is substantially not viewable, even if some of the pixel data is still stored on the pixel electrodes. Typically, the first control voltage applied to the control electrode such as a cover glass electrode is such that relative to the pixel electrode voltages, there will be at least $V_B$ volts across the liquid crystal. In step 206, the next pixel data is loaded onto the pixel electrodes for the first color subframe for the current frame while continuing to hold the voltage of the control electrode substantially at a voltage so that the voltage across the liquid crystal is at least at $V_B$. In this manner, the pixel electrodes are loaded with new data while the display is kept substantially dark. It will be appreciated that typically the data is loaded row by row of the pixel electrodes which correspond to rows on the display, one row at a time. Next, in step 208, the voltage on the control electrode is changed in order to release the state of the liquid crystal so that the loaded next data for the first color subframe (which was loaded in step 206) is now viewable on the display. If all the rows of the display have been loaded before releasing the voltage on the control electrode, then the display appears to update simultaneously for the whole frame. Then in step 210 the first color subframe is displayed for some time. One advantage of the prior sequence of steps is that there is a period of darkness between the old frame and the new frame such that now the frames have more frame-to-frame independence and hence the image appears better to a user. Moreover, even though the pixel data was loaded row by row onto the electrodes rather than simultaneously onto the electrodes for one frame, the display will still appear to update simultaneously for the whole frame because the releasing of the voltage on the control electrode at one time causes the liquid crystal to suddenly be able to change its "pixel" states for the whole liquid crystal layer simultaneously for the whole frame. The simultaneous nature of the liquid crystal's response provides a major advantage because it means that the liquid crystal does not have to complete switching (from a prior light altering state to a new light altering state) before it can be illuminated. Thus, the display system can be illuminated before the liquid crystal finishes switching (or completing its trajectories) and yet the display will still appear uniform across the display.

Next in step 212 the voltage on the control electrode is again set (e.g. by applying the first control voltage) to alter the state of the liquid crystal so the data for the first color subframe is substantially not viewable (even if pixel data for the first color subframe is stored on some pixel electrodes). Next in step 214, the next pixel data is loaded onto the pixel electrodes for the second color subframe for the current frame while maintaining the voltage on the control electrode so that the voltage across the liquid crystal is substantially or approximately at $V_B$. In step 216, the second control voltage is applied to the control electrode to allow the liquid crystal to relax so that the loaded data for the second color subframe is viewable on the display. Then in step 218 the second color subframe is displayed for some time. Typically this will include illuminating the display either with continuous illumination or with pulses of illumination as described herein. In step 220 the liquid crystal is again driven to a state in which the pixel data is not viewable. In this case, the data for the second color subframe is made to be substantially not viewable, even if the pixel data for the second color subframe remains stored on some of the pixel electrodes. Then in step 222, the next data is loaded onto the pixel electrodes for the third color subframe for the current frame while holding the voltage on the control electrode so that the voltage across the liquid crystal is substantially at $V_B$. Then at step 224, the voltage on the control electrode is released (e.g. applying a second control voltage) to alter the state of the liquid crystal so that the loaded data for the third color subframe for the current frame is now viewable on the display. Then in step 226, the third color subframe is displayed while illuminating the display system. It will also be appreciated that a similar illumination step may occur in step 210. In step 228, the method repeats steps 204–226 (inclusive) again for the next display frame. This continues for each frame as data is supplied to the system.

Figure 6A:
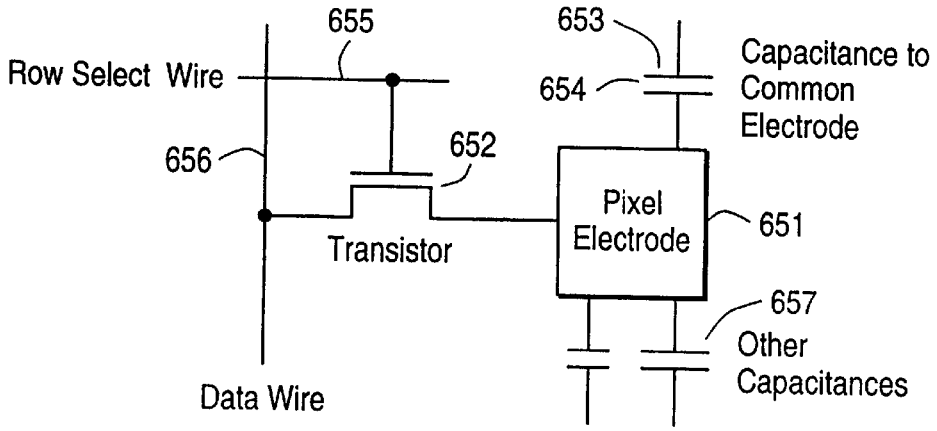
FIG. 6A illustrates an embodiment of a pixel circuit which may be used with the present invention.
Figure 6B:
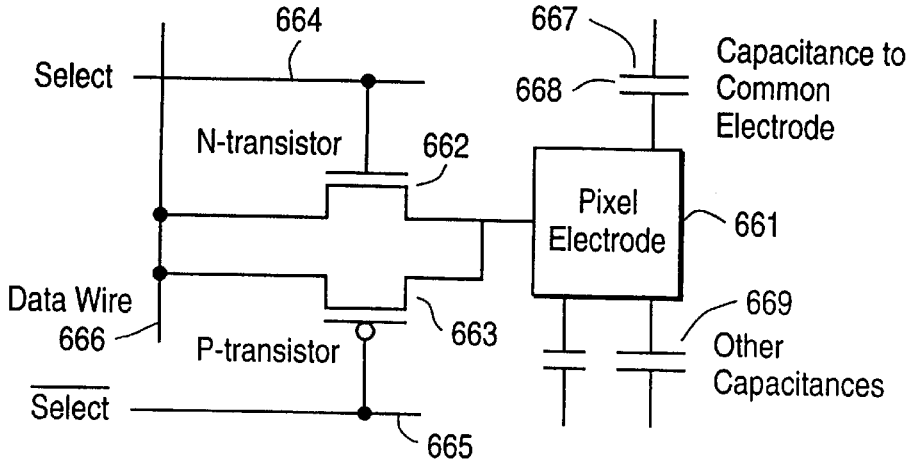
FIG. 6B illustrates an embodiment of a pixel circuit which may also be used with embodiments of the present invention.
Figure 6C:
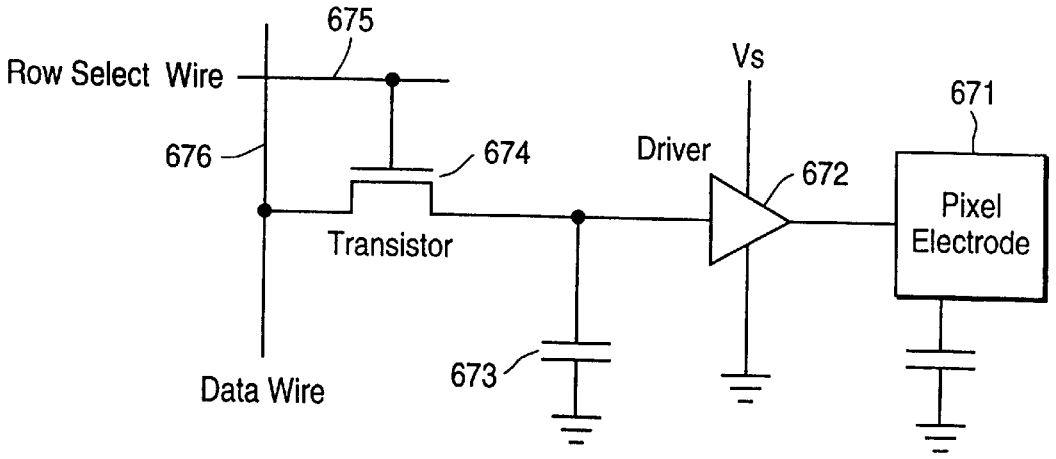
FIG. 6C shows yet another embodiment of a pixel circuit which may be used with embodiments of the present invention.
Figure 6D:
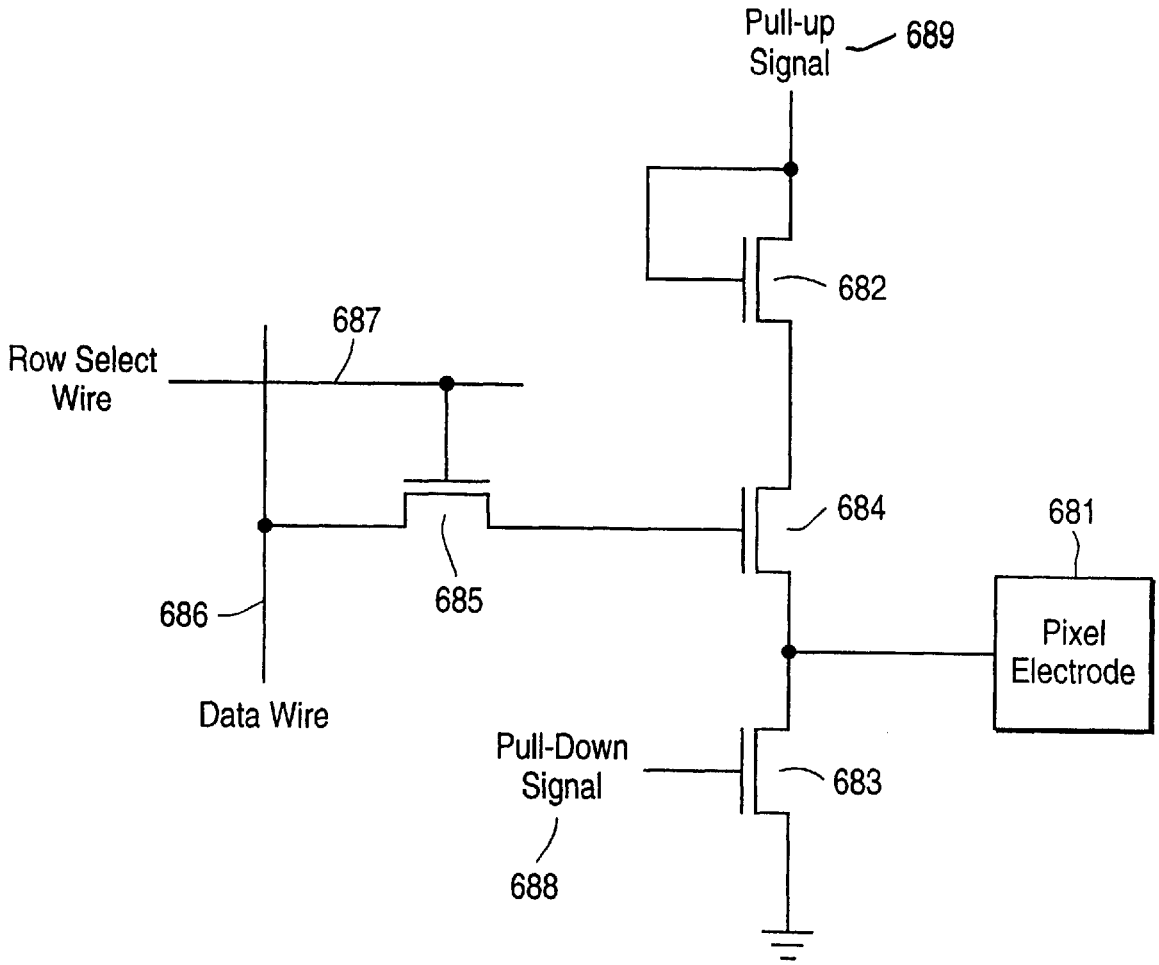
FIG. 6D illustrates a pixel circuit having a pixel buffer which is capable of storing the new pixel data value while the old pixel data value is being displayed; the circuit is capable of storing an analog value in the pixel buffer, and it will be appreciated that a plurality of these pixel circuits arranged in an array provides an analog frame buffer.

The method 425 shown in FIGS. 4A and 4B is similar to the method 200 except that the system of this embodiment uses a pixel frame buffer to store the next frame of pixel data while displaying the current pixel data. That is, while the display step occurs, the pixel buffers which will store the next pixel data are being loaded during the displaying of the current frame. Typically, this may be implemented in a system where the pixel buffer for a particular pixel electrode is located substantially under the pixel mirror electrode. This is described in further detail in U.S. Pat. No. 5,426,526. A particular pixel circuit for performing the pixel-by-pixel frame buffering in a pixel buffer associated with its respective pixel electrode is shown in FIG. 6D herein.

The method 425 begins at step 427 in which old pixel data from the last subframe of the prior frame of display data is displayed; while displaying this old pixel data, data for the first color subframe of the next frame is loaded into a pixel buffer for each pixel. According to one embodiment of the present invention, the pixel buffer stores analog pixel information, and the circuit of FIG. 6D may be employed for this purpose. In step 429, the control electrode, such as the cover glass electrode, is set at a voltage (e.g. by applying a first control voltage) to alter the state of the liquid crystal so that the old pixel data (for the last subframe of the prior frame) is substantially not viewable. Also during this step 429, for each pixel, buffered data stored in each pixel buffer for the first color subframe is loaded from the pixel buffer onto the pixel electrode. In step 431, the voltage on the control electrode is altered so that the state of the liquid crystal may relax thereby allowing the loaded pixel data for the first color subframe to be viewable on the display. If all the rows of the display have been loaded before releasing the control electrode by applying the second control voltage, then the display appears to update substantially simultaneously for the whole frame. Typically, with a frame buffer capability of the system described herein one would normally load all rows of the display although this is not necessarily required for certain embodiments of the invention. In step 433, the first color subframe is displayed and while displaying the first color subframe, data for the second color subframe is loaded into a pixel buffer for each pixel. In step 435, the control electrode, such as the cover glass electrode, receives the first control voltage which alters the state of the liquid crystal so that data for the first color subframe is substantially not viewable; also during this step 435, buffered data for the second color subframe which has been loaded into the pixel buffers is now loaded from the pixel buffer onto the pixel electrode. In step 437, the voltage on the control electrode is changed to "release" the liquid crystal from the state in which it was held in step 435 so that the loaded data for the second color subframe is viewable on the display. In step 439, the second color subframe is displayed and while displaying the second color subframe, data for the third color subframe is loaded into a pixel buffer for each pixel. In step 441, a first control voltage is applied to the control electrode, such as the cover glass electrode, in order to alter the state of the liquid crystal so that data for the second color subframe is substantially not viewable; also during this step 441, pixel data for the third color subframe is loaded from the pixel buffer of each pixel onto the corresponding pixel electrode of each pixel. In step 443, the voltage on the control electrode is changed (e.g. by applying the second control voltage) to alter the state of the liquid crystal so that the loaded data for the third color subframe for the current frame is viewable on the display. Then in step 445, the third color subframe is displayed, and while displaying the third color subframe of the current frame, data for the first color subframe for the next frame is loaded into a pixel buffer of each pixel. In step 447, the method repeats steps 429–445 (inclusive) for the next display frame and this continues for each display frame which is received by the display system of the present invention.

Figure 5:
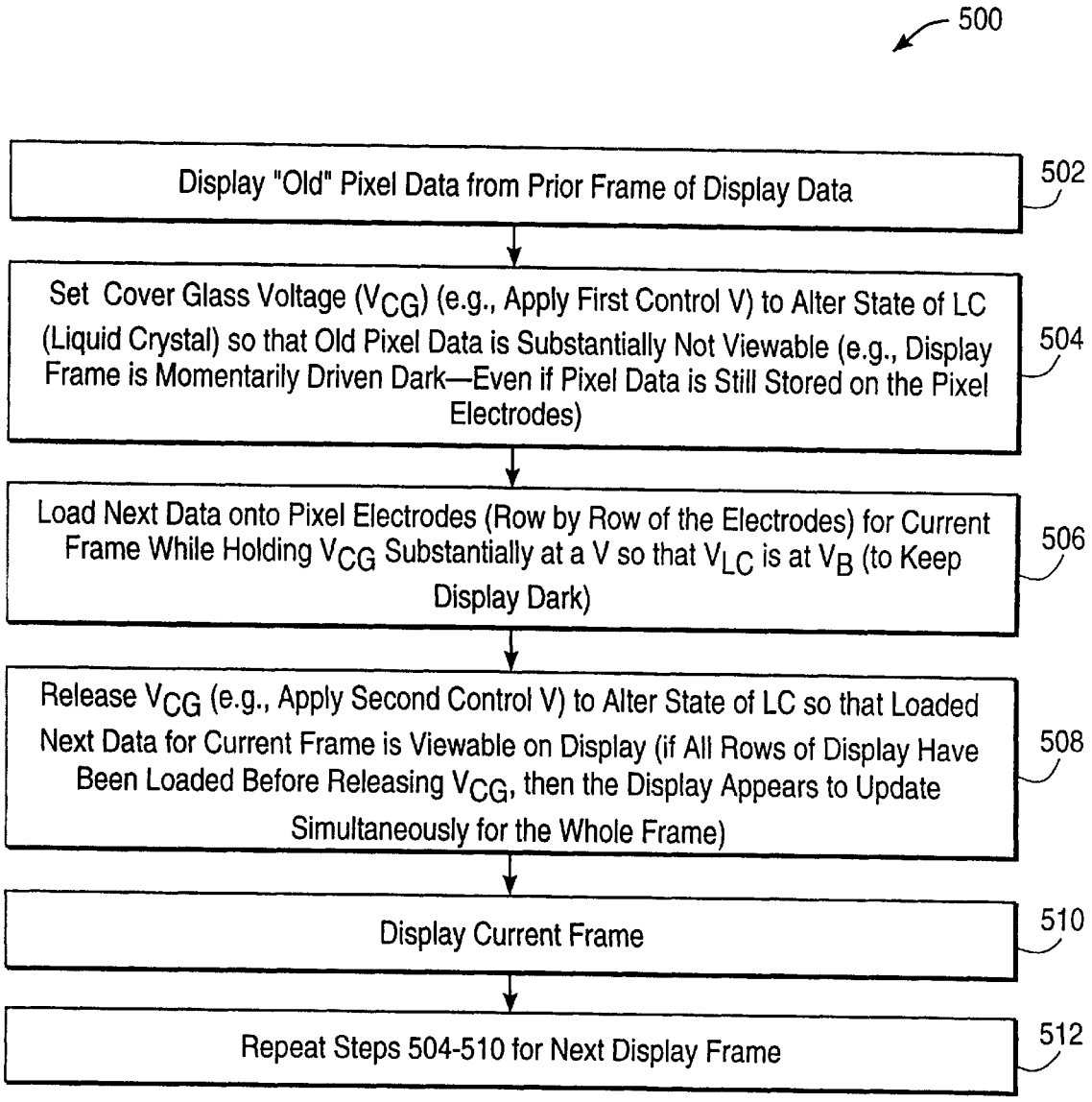
FIG. 5 illustrates an embodiment of the present invention which uses a spatial color display wherein each pixel includes three subpixels, each displaying a particular light component.

FIG. 5 shows a method 500 according to another embodiment of the present invention. This embodiment utilizes a system having a spatial color first substrate, wherein for each pixel there are three subpixels which provide the three signals for three primary colors, such as red, green and blue. These spatial color systems are well known in the prior art. The present invention provides an advantage in these systems in that simultaneous update may be achieved while also providing frame-to-frame independence without having to incorporate a pixel buffer for each pixel to thereby provide a frame buffer on the same substrate with the pixel electrodes. Method 500 begins in step 502 in which "old" pixel data from the prior frame of display data is displayed in the display system. Then in step 504, the control electrode receives a control voltage which alters the state of the liquid crystals such that the old pixel data is substantially not viewable even if the pixel data is stored on at least some of the pixel electrodes. As a result, typically in most embodiments of the present innovation the display frame is momentarily driven dark. In step 506, the next data for each pixel is now loaded onto the pixel electrodes in a row-by-row manner as in the prior art for the current frame while continuing to keep the voltage on the control electrode substantially at a voltage so that the voltage across the liquid crystal is preferably at or above $V_B$. Then in step 508 the voltage on the control electrode is changed to the second control voltage to thereby allow the liquid crystal to change its state so that the loaded next data (loaded in step 506) for the current frame is now viewable on the display. If all of the rows of the display have been loaded before releasing the voltage on the control electrode, then the display appears to update simultaneously for the whole frame even though the pixel electrodes were updated simultaneously only on each row at a time. Then in step 510, the current frame is displayed for some duration. Step 512 involves the repeating of steps 504–510 (inclusive) for the next display frame. In this manner, a spatial color display system may achieve improved frame-to-frame independence while at the same time achieving simultaneous update for the whole frame without having frame buffering on the same substrate as the pixel electrodes.

FIGS. 6A, 6B, 6C and 6D show various pixel circuits which may be employed with the present invention. For example, the circuits of FIGS. 6A, 6B, and 6C may be employed where no frame buffering on the pixel electrode substrate is required. Each of these circuits include at least one pixel electrode, such as pixel electrodes 651, 661, or 671, and further include control transistors which are used to selectively load the pixel electrode. These control transistors are shown as FET's 652 of FIG. 6A, 662 and 663 of FIG. 6B, and 674 of FIG. 6C. The operation of these pixel circuits is well known in the art, and it will be appreciated that there is an array of such circuits wherein the array includes a plurality of rows of the pixel circuits where each row includes a plurality of columns of the pixel circuits.

FIG. 6D shows a pixel circuit which may be used with certain embodiments of the present invention which require pixel buffering in pixel buffers located on the same substrate with the pixel electrodes. The pixel circuit of FIG. 6D includes a conventional row select wire 687 and a data or column wire 686 and also includes a control or pass transistor 685. This pixel circuit further includes a pullup FET 682 and a pulldown FET 683 as well as a voltage follower FET 684. This pixel circuit of FIG. 6D operates in the following manner: while old pixel data values are being held or stored on the pixel electrode 681 (with the pulldown signal 688 being kept low such that the FET 683 is off) a new pixel data value is loaded into the pixel circuit or cell by applying a high row select signal on row select wire 687 and concurrently applying the pixel data value on data wire 686. In this condition, the FET 685 passes the pixel data value, which is preferably an analog pixel data value, through to the gate of the FET 684 which should not be in a conducting state at this point since the pullup signal is kept low so that substantially no current is flowing through the source/drain electrodes of either FET 682 or FET 684. After loading the next pixel data value onto the gate of FET 684, the FET 685 is turned off by driving the row select wire 687 low. This will keep the new pixel data value stored on the gate of FET 684 while data wire 686 applies another new pixel data value to a pixel cell in the same column but a different row. Then, near the end of the display of the old pixel value on pixel electrode 681, the pulldown signal 688 is asserted high, thereby tuning on PET 683 which then discharges any charge on the pixel electrode 681. Then the pulldown signal 688 is turned low again to turn off the FET 683 and then the pullup signal is asserted high to turn on the FET 682. This causes the FET 684 to pull up its source node which is coupled to the pixel electrode 681 to within one threshold value of the pixel data value (preferably an analog pixel data value) stored on the gate of the FET 684. After this pullup occurs, the pullup signal is deasserted to a low value to cause no current flow through the FETs 682 and 684 thereby allowing the value stored on the pixel electrode 681 to control the display state of the liquid crystal in the proximity of the pixel electrode 681. It will be appreciated that an array (in rows and columns) of pixel circuits of the type shown in FIG. 6D will provide, in one embodiment, an analog frame buffer in the same integrated circuit (monocrystalline silicon) substrate as the pixel electrodes. Moreover, each such pixel circuit may be fabricated such that it is disposed under each pixel electrode, which in one embodiment may be a reflective mirror for a reflective type liquid crystal display.

Figure 7A:
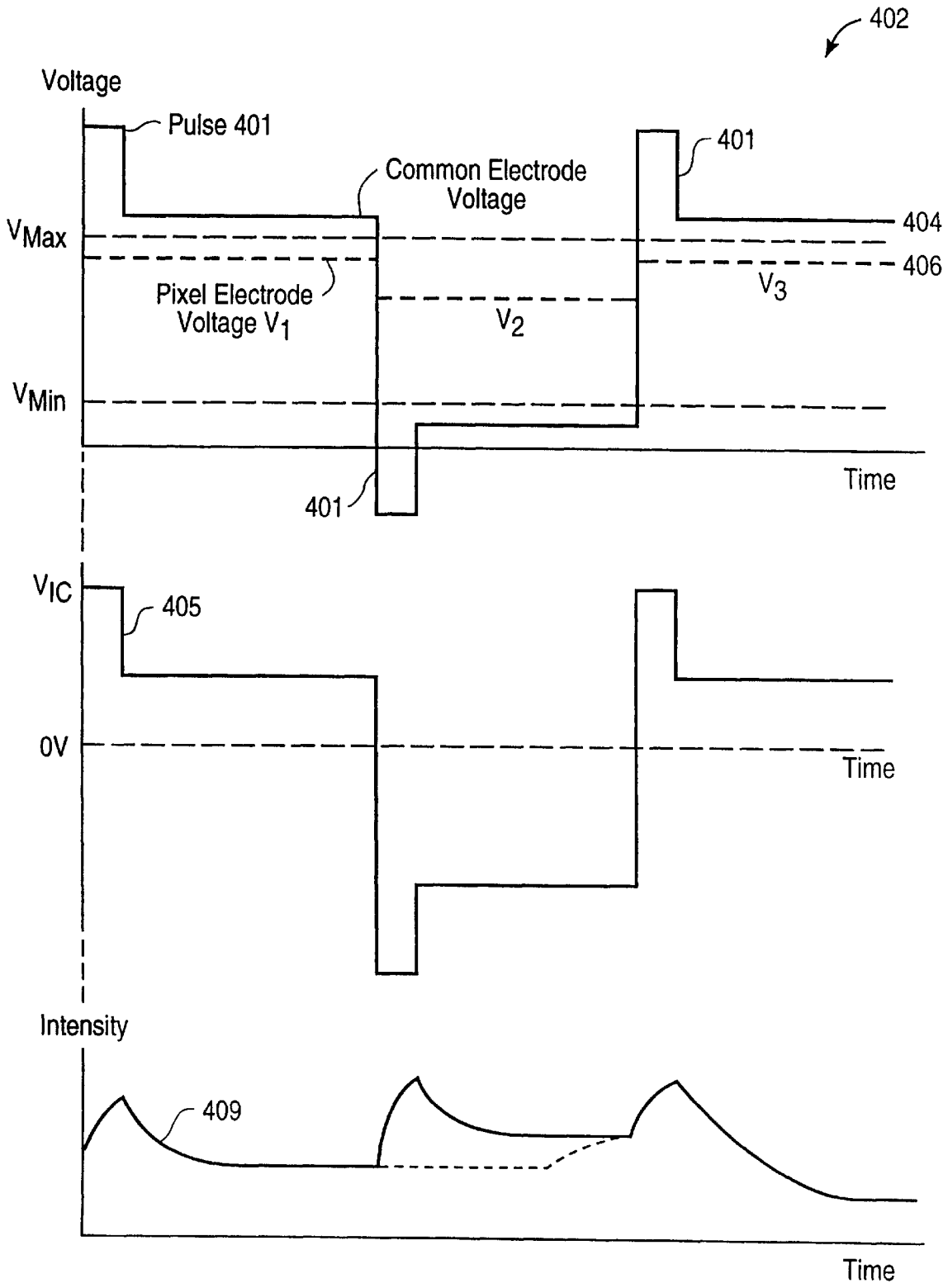
FIG. 7A shows the effects of modulating the electrode voltage modulation with a signal that is not a rectangular waveform, according to an embodiment of the invention in which the upper panel shows the electrode voltage and the pixel electrode voltage with respect to time when an overdrive pulse is applied, and the middle panel shows the voltage across the electro-optic layer (e.g. liquid crystal layer) for such modulation of the electrode and the lower panel shows the intensity output from the pixel A using the overdrive pulse (solid line) and without the overdrive pulse (dashed line).

FIG. 7A shows an example of a liquid crystal pixel switching between gray levels or color levels. This figure depicts the optical response from a single pixel (pixel A) switching between levels over three frame periods. In this example, the liquid crystal is driven toward a bright state by increasing voltage, and the DC balance is affected on a frame-by-frame basis. The figure shows the effects of modulating the common electrode voltage modulation with a pulse which is designed to alter the light altering state of the liquid crystal such that display data is not usefully viewable. In this instance, rather than being driven dark, the display is driven whiter and yet the display data is not usefully viewable as the whole display will be driven brighter. It will be appreciated that it will generally be preferable to not illuminate or view the display during the state in which the display is driven whiter by the pulses 401.

Referring to FIG. 7A, the upper section of this figure shows the voltages at the control electrode or common electrode and the pixel electrode voltage with respect to time when the pulse 401 is applied. The middle section of FIG. 7A shows voltage across the liquid crystal for such modulation of the common electrode voltage, and the lower section of FIG. 7A shows the intensity output from pixel A with the pulse 401 and without the pulse 401 (where the response without the pulse 401 is shown by the dashed line). The pulse 401 need not be limited to a flat pulse, and it can be positive or negative with respect to ground and can even alternate between positive and negative as shown in FIG. 7A. It will be appreciated that this pulse is similar to the pulse on the voltage waveform 151 which occurs between times $t_0$ and $t_1$ of FIG. 2C.

The amplitude and duration of the pulse 401 of FIG. 7A at the beginning of a frame period are chosen such that the pulse momentarily drives the liquid crystal beyond the target gray value. For sequential display as described above, the duration of the pulse can be from a fraction of a millisecond to over one millisecond and the amplitude can be any value that yields a pulse 405 with a voltage level $V_{LC}$ across the liquid crystal layer which is sufficiently large to produce an intensity surge 409 at pixel A. In an alternative embodiment, of course, the liquid crystal may be driven dark rather than driven bright. Since the pulse 401 is applied to all pixels which share the electrode, it results in an increased switching time between one gray level and a lower gray level. It has the advantage that the time switching between one gray level and a slightly increased gray level is not limited by the observed delay, and slow response in such situations (this is indicated by the dashed line in FIG. 7A). Indeed, the upper limit for the time taken for any transition is now bounded by the relaxation time after the pulse. One consequence of this pulse is that, depending on its polarity, the voltage across the electro-optic layer may be momentarily (transiently) increased or decreased immediately following that pulse. In one embodiment, the additional or superimposed pulse may be temporarily close to the update or acquisition of image data on the pixel electrodes.

Figure 7B:
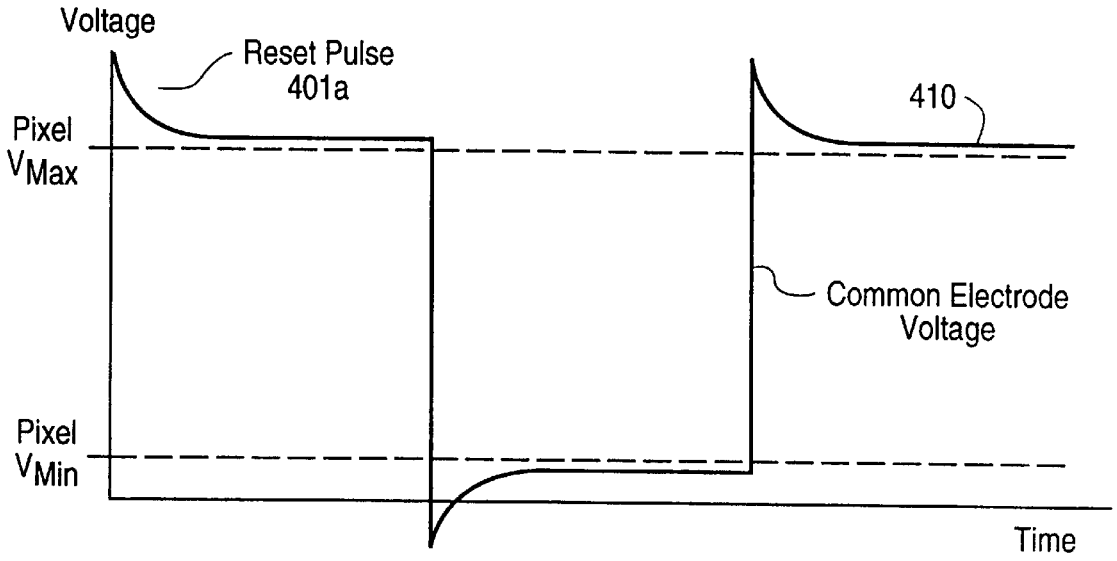
FIG. 7B shows a waveform of the modulation of electrode which may be used to drive the electro-optic layer to a state in which display data is not visible, wherein the waveform uses a reset spike rather than a rectangular pulse.

FIG. 7B shows another approach to modulating the control electrode, such as a common cover glass electrode for a sequential display device using a pulse with a voltage that peaks with an exponential type decay. The pulse may, for example, be added near the time at which all the pixels are updated.

Figure 7C:
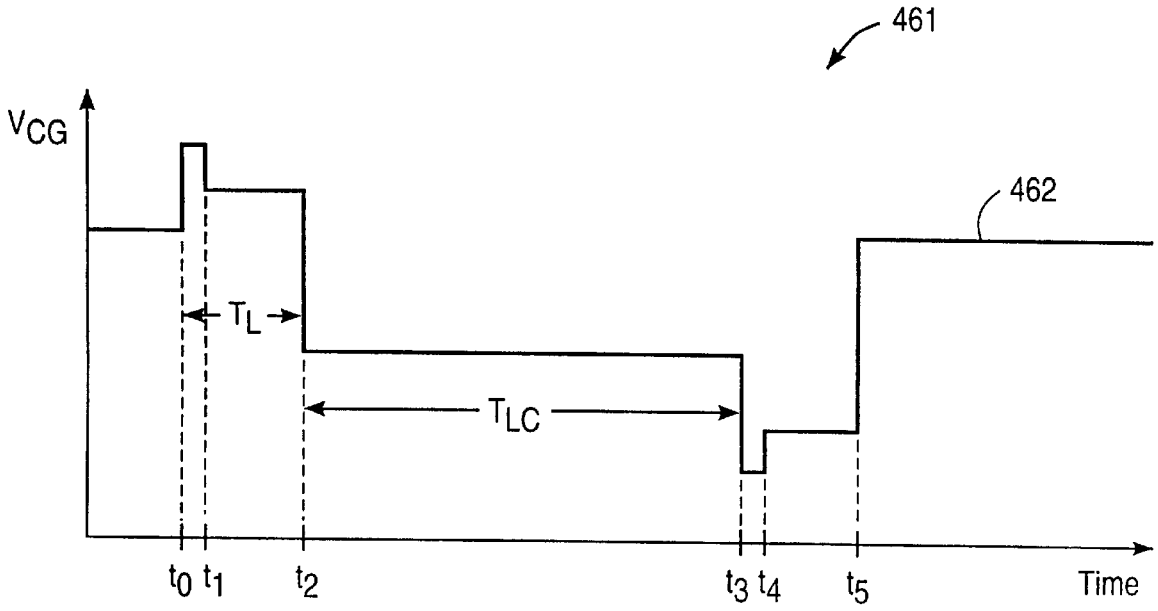
FIG. 7C illustrates a waveform for an electrode modulation which may be used to place the electro-optic layer into a state in which the display data is not visible according to one embodiment of the present invention.

FIG. 7C shows another alternative embodiment for modulating the voltage on the control electrode. The modulation pattern 461 has a voltage waveform 462 that includes several components as shown in this voltage versus time diagram. A frame cycle begins at time to in which the voltage on the control electrode is ramped to a high enough voltage such that $V_{LC}$ is driven close to $V_{OD}$ (see FIG. 2B). This voltage state continues during the duration between time $t_0$ and time $t_1$. This causes the liquid crystal to be rapidly driven to a state in which the display data is not viewable. Then from time $t_1$ to $t_2$, the voltage on the control electrode is changed so that instead of overdriving the liquid crystal layer, it is held at a voltage such as $V_B$ (see FIG. 2B). The time from time $t_0$ to $t_2$ may be utilized by the display system to load all the pixel electrodes with new display data for the current frame (and effectively erasing the old display data) then at time $t_2$ the pixel data may begin to be displayed. Typically, all pixel electrodes would have been loaded by the beginning of time $t_2$ and thus all liquid crystal can begin the transition from the altered state which existed during the time between $t_0$ and $t_2$ to a relaxed state. The relaxation of the liquid crystal is allowed to occur between times $t_2$ and $t_3$ which is also the time in which the image data is being displayed at least part of this time period. Typically, the time between $t_2$ and $t_3$ includes illumination of the display for at least a portion of the time if not all the time. Moreover, rather than illuminating continuously through a portion of the time between $t_2$ and $t_3$, pulses of illumination may be applied. The modulation scheme of FIG. 7C thus achieves an advantage of rapidly driving the crystal to an altered state in which the display data is not viewable while then relaxing it but still keeping it not viewable. This increases the response time of the device thereby allowing the frame rate of the display device to be driven at higher frequencies, subject to the amount of time it takes to load the pixel electrodes in the frame. The cycle beginning at time $t_3$ continues except the polarity of the signals has changed due to the fact that the control voltage signal applied to the control electrode is DC balanced around some DC level (shown here as some level other than zero volts). It will be appreciated that DC balancing is performed in order to attempt to provide a DC balanced signal to the liquid crystal such that the DC balance level of the liquid crystal is approximately zero volts.

Figure 8A:
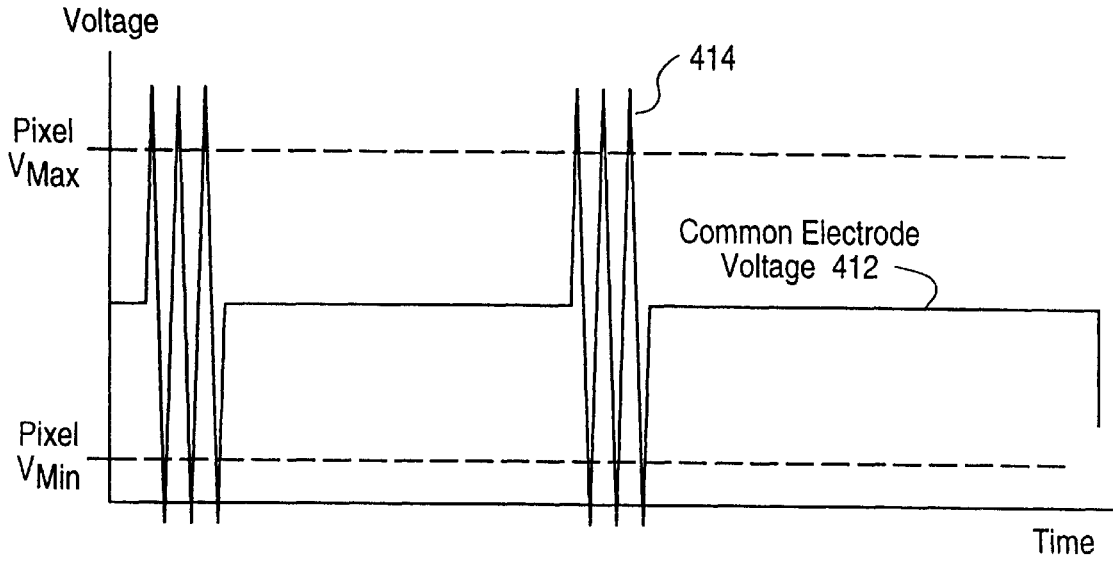
FIGS. 8A and 8B are schematic representations showing waveforms for electrode modulation which include bursts of relatively high frequency oscillation.
Figure 8B:
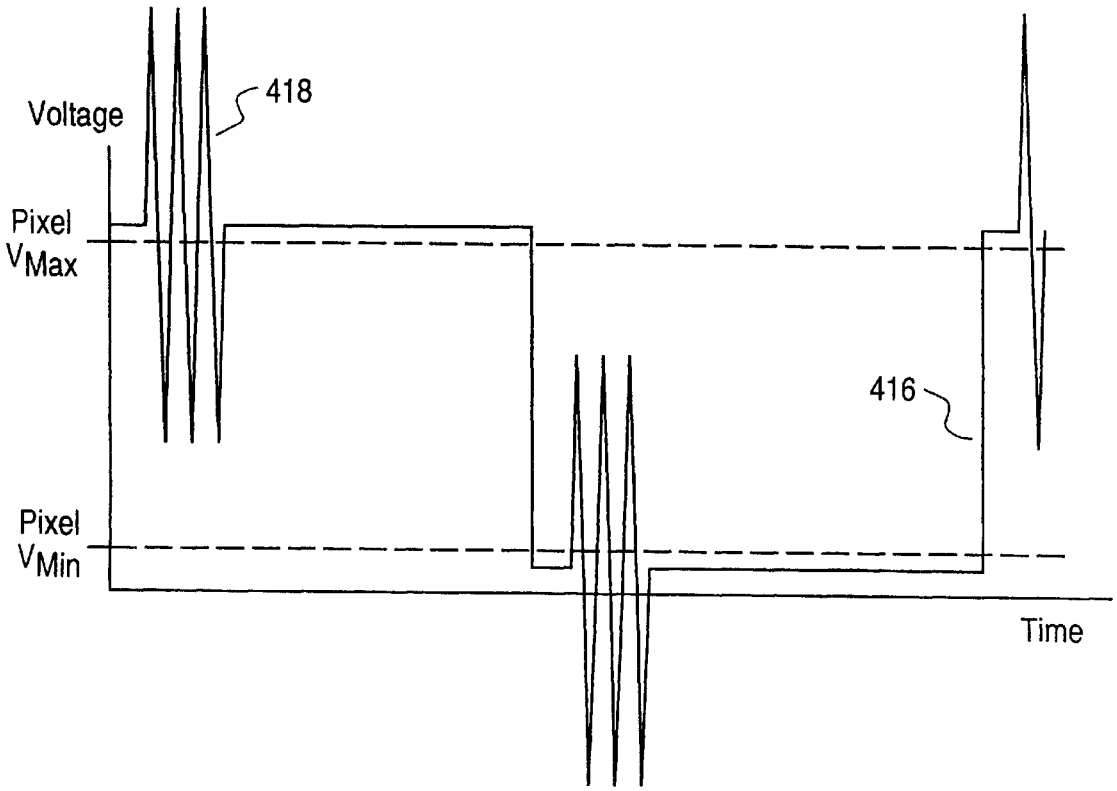

FIGS. 8A and 8B illustrate another embodiment of the present invention in which the control voltage which is applied to the control electrode is modulated with a burst of a relatively high frequency oscillation (e.g. 5 kHz to 100 kHz). Such a scheme would be useful for driving dual-frequency liquid crystal materials in those types of displays where below the crossover frequency the liquid crystal material has a positive dielectric anisotropy, and above the crossover frequency it has a negative dielectric anisotropy.

As an example of the usefulness of a display system featuring such a scheme, consider the following scenario. An image is written to display system 12 by applying a pattern of voltages to the array of pixel electrodes 28. Common electrode 26 is modulated according to an embodiment of the invention as described above, or alternatively, may be clamped at a given voltage while each pixel of electro-optic layer 22 switches to the desired state. Then after the image has been viewed, it is desired to rapidly reset each pixel of the electro-optic layer 22 to an off state in preparation for the acquisition of the next set of image data such that the old image data is not viewable while acquiring the new set of image data or if acquired already, may be separated from the prior frame by momentarily blanking the display. This can be achieved by using a dual-frequency electro-optic liquid crystal material and performing this reset, or drive to off function, by applying a short period of high frequency voltage signal to the common electrode 26. It will be appreciated that if an AC signal is used to hold the liquid crystal to a state in which the display (pixel) data is substantially not viewable (e.g. a "dark" state), then it is preferred to synchronize the phase of the AC signal with the phase of writing pixel data to each row of pixel electrodes so as to equalize between rows the effect of capacitive coupling between the control electrode (e.g. the common electrode) and the pixel electrodes.

Within the basic scheme for electrode modulation of the present invention, in which the electrode voltage has a close temporal relationship with the update of image data to the pixel electrodes, there exists a number of variations concerning the nature of the modulation. For example, in one embodiment of the invention, relatively short pulses may be applied to an otherwise DC control electrode voltage. Here the modulation may consist of pulses of shorter duration than that of the image data on the pixels. In another embodiment of the control electrode voltage modulation scheme according to the present invention, the pulse duration applied to the control electrode may be of longer duration than that of image data on the pixels. In this latter case, the time period with which the image data remains on the pixels is shorter that the refresh period.

According to another embodiment of the invention, the control electrode voltage modulation may comprise bursts of relatively high frequency alternating current (AC) modulation. In another embodiment, the control electrode voltage modulation may comprise one burst of relatively high frequency modulation for each update of image data to the pixel electrodes.

Figure 9A:
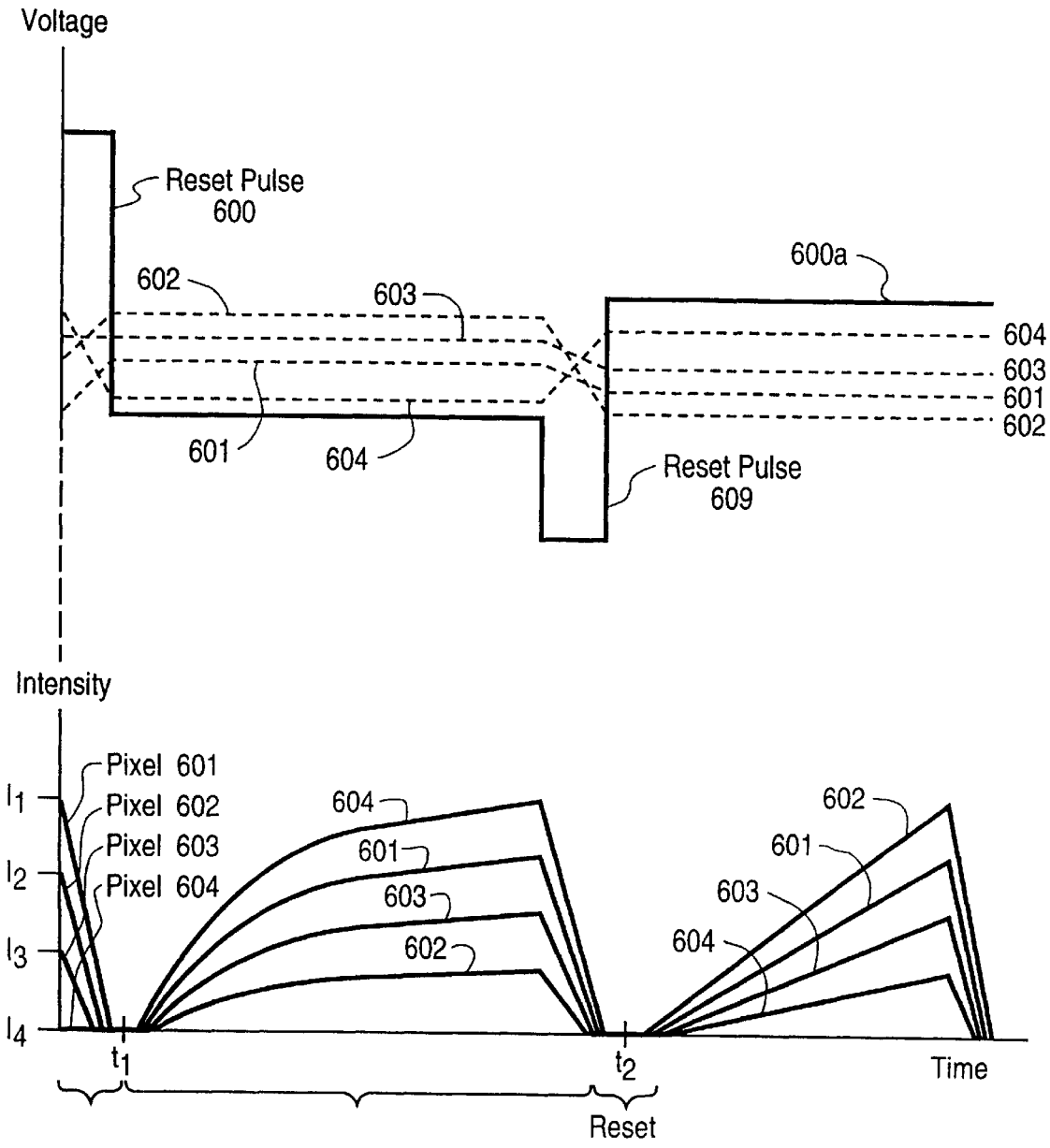
FIG. 9A is a waveform illustration indicating the electrode modulation voltages and the pixel electrode voltages over time using a frame buffering system; the electrode modulation shown in FIG. 9A includes a reset pulse which is designed to place the electro-optic layer into a state in which the display data on the pixel electrodes is not viewable.

As shown in FIG. 9A, according to a further embodiment of the present invention, the common electrode voltage can be modulated with a pulse to achieve a rapid "drive to dark" of the electro-optic material or liquid crystal despite any pixel data stored on the pixel electrodes during the drive to dark state. Certain liquid crystal cell configurations can be constructed which are normally white, and require addressing by a voltage to drive the cell to a dark state. According to this embodiment, this voltage addressing can be done by driving the common electrode to a voltage sufficiently different from the pixel voltage to achieve a rapid drive to dark. Gray or color levels are subsequently established by allowing the liquid crystal to relax back and generate different gray or color levels depending on the voltage on the pixel electrode. It will be appreciated that gray may be considered a color for the purposes of the present invention. The embodiment shown in FIG. 9A also utilizes a pixel frame buffer which stores the next pixel data in a pixel buffer while the current pixel data is being displayed.

The common electrode voltage can be over driven to get the electro-optic material very quickly to a dark state by using a voltage greater than the voltage required to hold a dark state.

An example of an electro-optic response which would be suitable for this embodiment is shown in FIG. 2B. The intensity output from a pixel decreases with the voltage applied across the electro-optic layer. The electro-optic curve shown here has a saturation response as the voltage is increased above the "black holding voltage", that is, the output remains dark for higher voltages. The present invention may also be used with liquid crystals having different electro-optic curves, such as one which is similar to that shown in FIG. 2B except that the curve 125 begins to rise again at some point after point 127 (e.g. perhaps before $V_{OD}$) rather than remaining flat, in which case $V_{OD}$ would not normally be applied to such a liquid crystal. Alternatively, a thick liquid crystal layer may be used which has a more complex curve, which curve 125 may be considered to be a portion of; in this case of a thick liquid crystal, the useful portion of the curve 125 may be used without allowing the crystal to relax completely to other portions of the complete, complex curve. It will also be appreciated that, for certain liquid crystals, different electro-optic (EO) curves may exist for different colors (e.g. a liquid crystal may have a first EO curve for one color (with a $V_B$ of $V_B$ EO1) and a second EO curve for another color (with a $V_B$ of $V_B$ EO2)). In this case, it is desirable to coordinate the control voltage applied to the control electrode relative to the color such that the control voltage matches the color and EO curves. In this case, care should be taken to make sure that the $V_B$ across the liquid crystal created by the electrode is sufficient to render the prior pixel data unviewable before the next pixel data is to be displayed.

The relaxation to the gray scales happens through a related family of curves which, even if the material slows down through temperature decrease, will still allow the viewing of gray or color levels. Subsequent images are independent of each other since there is a complete reset of the electro-optic material between each image.

A longer viewing time can be achieved in systems which employ time sequential color illumination or time sequential color filtration because, as the reset cycle makes color subframes independent of each other, the device can be viewed even as the material approaches the final gray or color level for a frame from the dark state. It may also be useful to view the pixels even during the rapid reset phase to gain more light throughput. A color sequential scheme is shown in FIG. 9B.

Figure 9B:
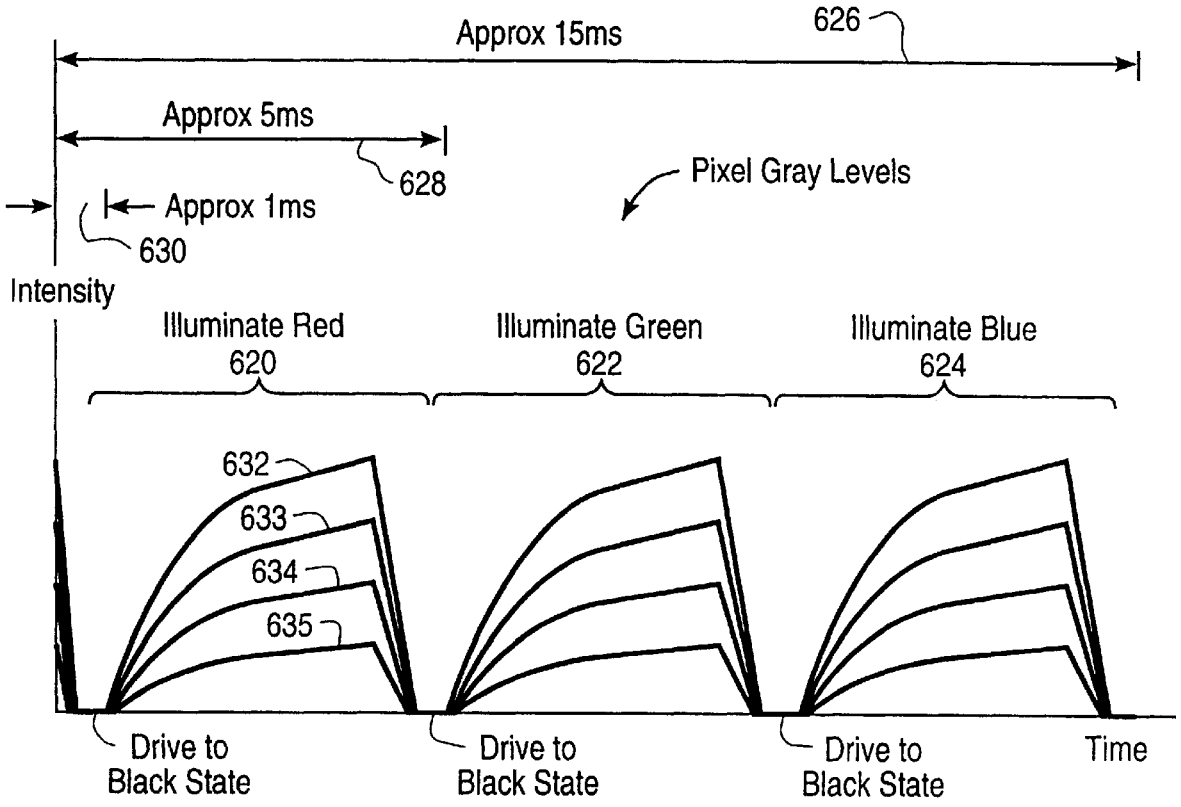
FIG. 9B illustrates a plurality of intensity versus time waveforms which illustrate the behavior of pixels in a time sequential color display system of the present invention which utilizes electrode modulation such that the electro-optic layer is placed in a state for a certain period of time in which the display data is not viewable.

In particular, FIG. 9B shows the rapid drive to dark after each color subframe. Each color subframe can have approximately a 5 ms duration in which it is illuminated continuously during the whole duration or continuously only a portion of the duration or illuminated with only non-contiguous pulses of illumination during the duration. A red subframe, green subframe, and blue subframe can be sequentially displayed within approximately 15 ms. These time periods are merely examples of durations that can achieve visual integration according to U.S. patent applications Ser. Nos. 08/505,654 and 08/605,999, the contents of which are incorporated herein by reference. It should be understood, however, that other durations could achieve this including subframe display durations less than 5 ms and even durations of 10 ms or more.

Referring to FIGS. 9A and 9B, a reset pulse 600 is applied to the pixel electrode for a small portion (here 1 ms) of the subframe duration (here 5 ms). Assume there are four pixels 601, 602, 603, and 604 with respective initial intensities of I1, I2, I3, I4 and with respective intensities of 1–4. Once reset pulse 600 is presented to pixels 601–604, their intensities 1–4 drop from I1–I4 to zero, respectively, i.e., they undergo a rapid drive to dark at time $t_1$. Note that the display does not show viewable data even though the pixel electrodes have pixel data values thereon. Also note that all pixel electrodes simultaneously receive updated pixel data values (As shown by the immediate and universal change at the very beginning of the pulse 600 and the pulse 609). This is because the display system of FIG. 9A uses pixel frame buffering, which is typically implemented by including a pixel buffer (e.g. analog pixel buffer) with each pixel electrode (e.g. as in FIG. 6D). The intensities 1–4 then increase to their respective gray color levels after the reset pulse stops. As depicted, pixel 604 is driven to the brightest gray or color level. The brightness of each pixel as it appears to an observer should be proportional to the area under each curve 1–4. A following reset pulse 609 then drives pixels 601–604 to dark at $t_2$. The following relaxation to gray or color levels is shown with slower intensity versus time transitions as might occur when pixels 601–604 are cold. As can be seen, frame (or subframe) independence is achieved for pixels 601–604 even if the pixels are cool. It will be appreciated that the use of a frame buffer (as in FIG. 9A) with the present invention potentially allows a short reset pulse to be applied (to make the prior frame substantially unviewable) without having to hold the reset pulse while the pixel electrodes are loaded. Since an entire frame of pixel data may be loaded from the frame buffer (of pixel buffers) onto the pixel electrodes by applying a load signal (e.g. appropriately applied pullup and pulldown signals as described for the pixel circuit of FIG. 6D) to all pixels, the time required for loading of pixel electrodes is much shorter than a non-frame buffer system which is loaded one (or two) rows at a time. Thus, the frame-to-frame independence may be achieved with a shorter reset pulse (and without the need for a longer hold pulse which is required to load the pixel electrodes).

Liquid crystal configurations can be considered which would not normally be suitable for some applications. For example, a thick cell may be easier to manufacture but will likely to have a response which is too slow. By overdriving to get a fast reset to dark, and then viewing gray scales or color levels as the cell relaxes, good performance can be achieved even if the cell never reaches its final state for that addressing voltage. The reset makes this viable because of frame independence.

This embodiment can be made to work with different types of DC balancing. Frame based, column based, row based or even pixel-by-pixel DC balancing can be implemented simply by clamping the common electrode at $(V_{max}-V_{min})/2$ and ensuring that subsequent drive to dark pulses are of alternate polarity. In that case, the liquid crystal is DC balanced by controlling only the data driven to the pixel electrodes.

Frame inversion DC balancing can also be implemented in a scheme which modulates the common electrode voltage. An example of this is shown in FIG. 9A. In general, DC balance can be maintained with this drive to dark scheme by ensuring that the pixel electrode data updates and the drive to dark pulse sequence are arranged so that over a number of update cycles, the voltage across the electro-optic later averages to a value close to zero.

The pixel electrodes can either be clamped at some known voltage during the reset period or they can be left in some arbitrary state if the common electrode drive is sufficiently high voltage.

As shown in FIGS. 9A and 9B, an initial reset can be applied with all pixels set to zero volts. The electro-optic device, e.g., a liquid crystal device, has all pixels go rapidly to dark. The pixels are then all set to their gray or color level voltages and the liquid crystal display begins to relax to the gray or color level corresponding to those voltages. The device can be viewed through this entire relaxation (and also though the next reset) because this image is not contaminated with the previous one. The next reset is shown with the pixels set to their highest voltage and the common electrode driven negative. The next image is shown with the common electrode set at the maximum pixel voltage and pixel electrodes below that. Hence, in this particular example DC balance is achieved on a frame-by-frame basis.

It is important to note in this embodiment of the present invention that it is possible to achieve essentially simultaneous drive to dark in the optical output of a large group of pixels, such as an image even if the pixels do not have the facility to perform a simultaneous update of their electrodes with new data. Furthermore, it is possible to make pixels appear to have the facility for simultaneous electrode voltage update by using the present invention.

Figure 10A:
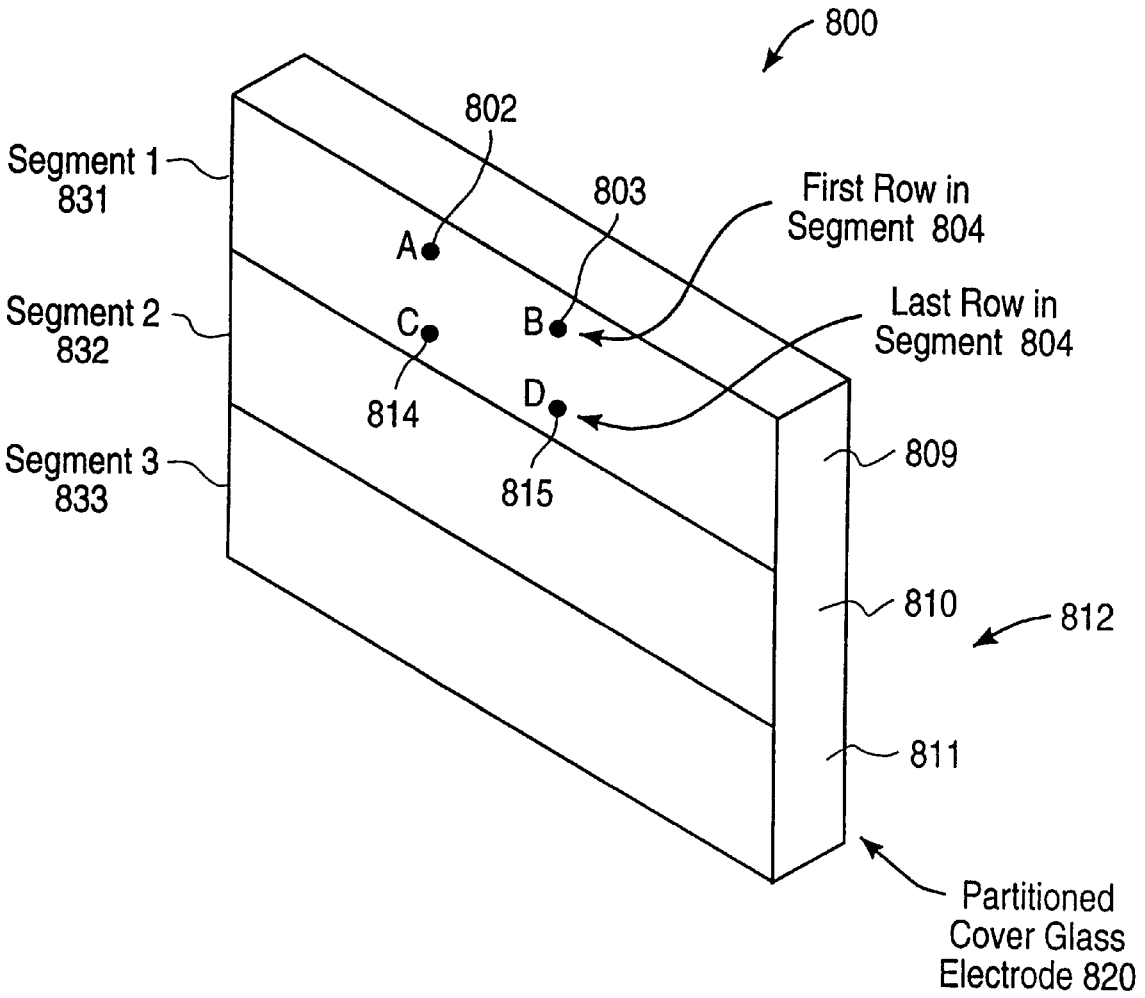
FIG. 10A illustrates an alternative embodiment of a cover glass electrode which has been segmented according to one embodiment of the present invention; other similar embodiments include the use of segmented control electrodes in the same substrate which include the pixel electrodes.

FIG. 10A shows a segmented display 800 made of an array of pixels which in this case have their electrode voltages updated one row at a time (or with a proper array layout, two rows at a time). Pixels 802 and 803 marked "A" and "B " are on a first row 804 of a segment 809 of array 812 and the pixels 814 and 815 marked "C" and "D" are on the last row 806 of segment 809. Second and third segments 810 and 811 of array 812 are also shown. It should be understood that any segmentation of array 812, which includes the pixel electrodes and other pixel cell circuitry, can be made and that resulting segments can have only a few pixels or a larger number of pixels and that these pixels can be in one or more rows. Whatever the segmentation of array 812, electrode 820 is segmented accordingly. Here, for example, electrode segments 831, 832, and 833 are arranged to correspond to first, second, and third segments 809, 810, and 811 (having three groups of pixel electrodes) of display array 812.

Figure 10B:
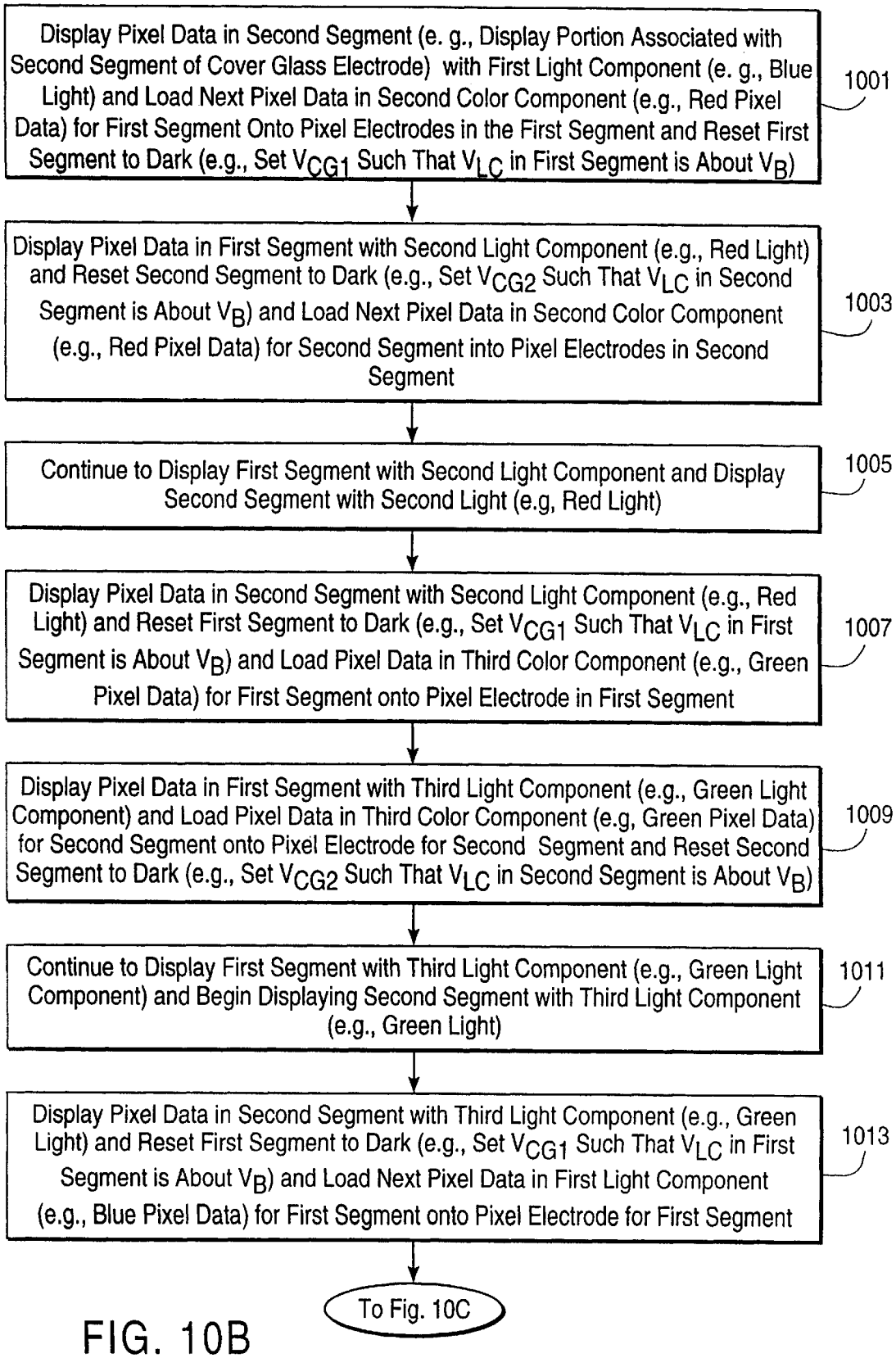
FIG. 10B and FIG. 10C illustrate a flowchart showing a time sequential color system having segmented control electrodes, such as segmented cover glass electrodes according to one embodiment of the present invention.
Figure 10C:
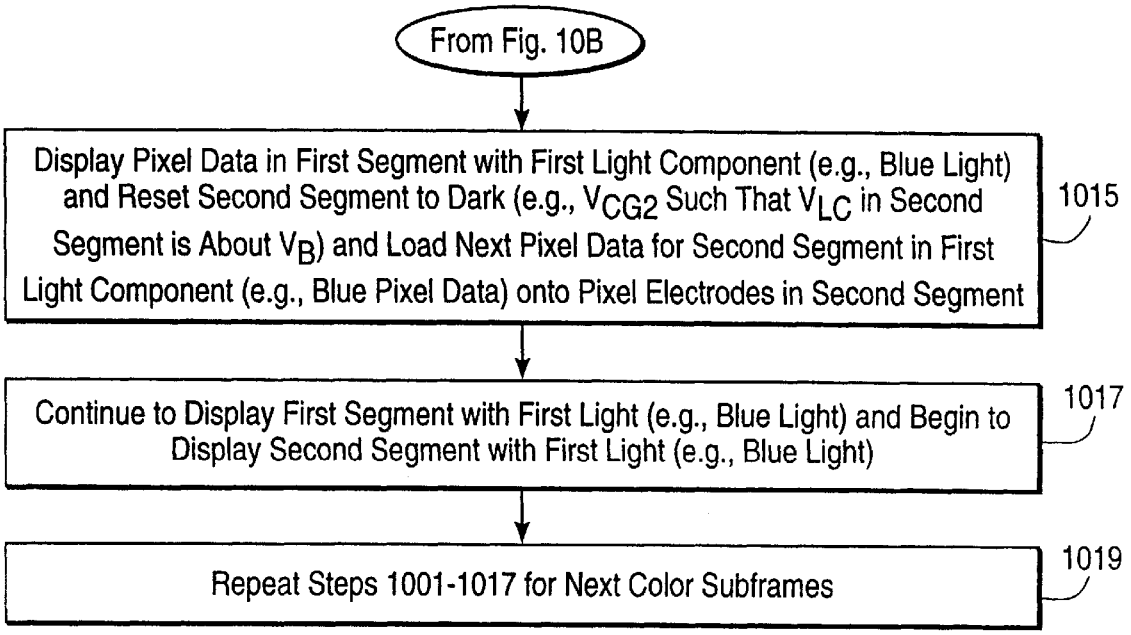
Figure 11:
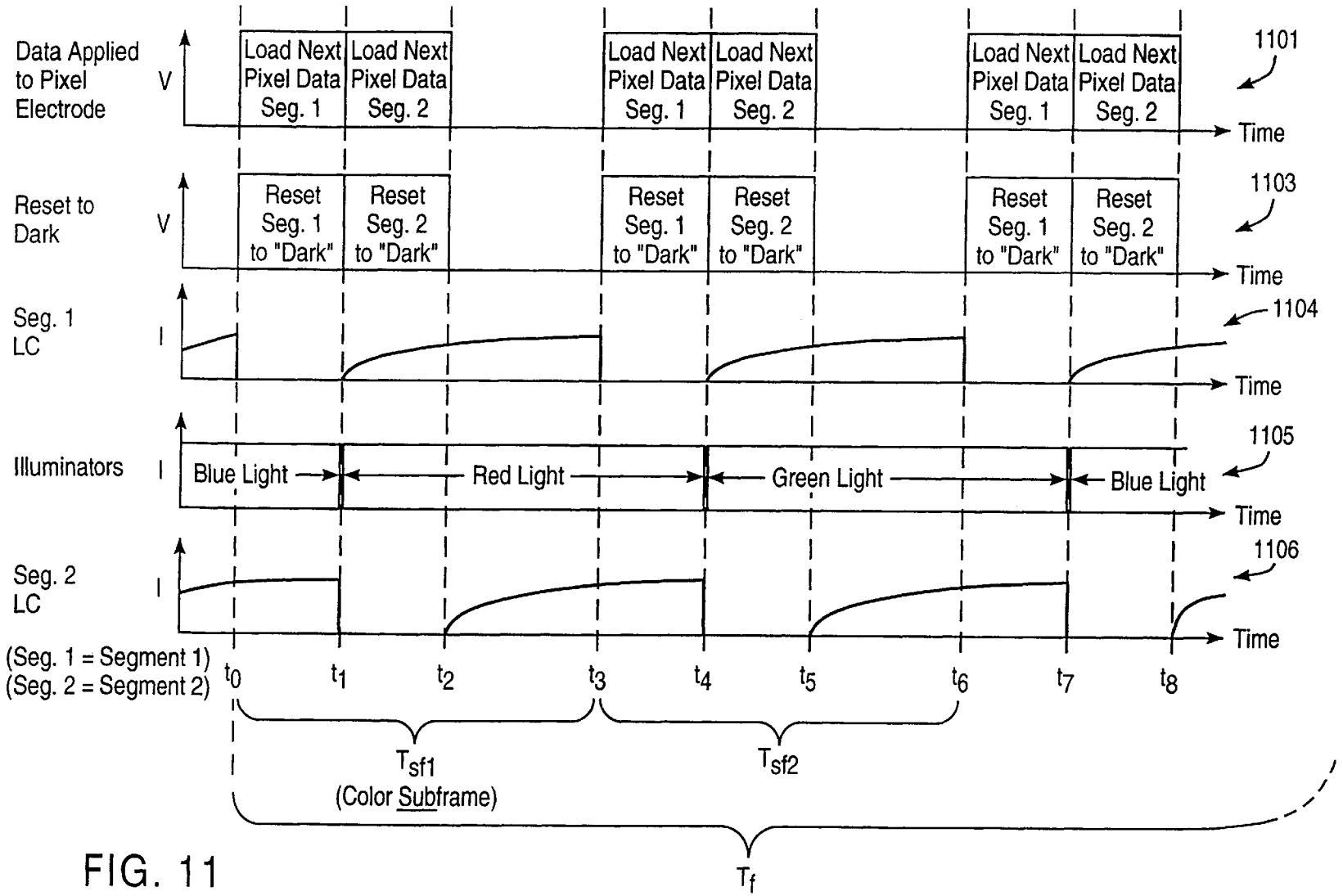
FIG. 11 illustrates a plurality of waveforms in a time sequential color system having segmented control electrodes.

FIGS. 10B and 10C show one embodiment of a method of the present invention using segmented control electrodes in a time sequential color display system of the present invention. The method begins in step 1001 in which normally three steps occur substantially contemporaneously in a preferred embodiment. It will be appreciated that these three steps need not occur substantially contemporaneously and may only partially overlap in time. However, to achieve numerous benefits from this method, it is preferred that these three steps occur substantially contemporaneously in time. These three steps include loading the next pixel data in the second color component (e.g. a red color component) for the first segment of the control electrode onto the pixel electrodes in the first segment. Also included is resetting the first segment to dark by setting the first segment control electrode to a voltage such that the associated liquid crystal material does not allow pixel data to be viewable. At the same time, pixel data in the second segment is displayed with a first light component, such as a blue light component. In step 1003, three processes are typically performed substantially contemporaneously according to the preferred implementation of the present invention. Step 1003 includes loading the next pixel data in the second color component (e.g. red pixel data) for the second segment onto the pixel electrodes in the second segment. Step 1003 also includes resetting the second segment to dark by applying the proper voltage to the control electrode of the second segment. Also at the same time, pixel data in the first segment is displayed with a second light component, such as red light. Then in step 1005, the system continues to display the first segment of the image with the second light component and begins to display in the second segment the data of the second segment with the second light component which is red as shown in FIG. 11. The processes performed in step 1001 occur between times $t_0$ and $t_1$ as shown in FIG. 11. The processes performed within step 1003 are performed within the times $t_1$ through $t_2$ in the waveforms shown in FIG. 11. The two display processes of step 1005 are performed during times $t_2$ through $t_3$ of FIG. 11.

FIG. 11 illustrates the action over time according to this method shown in FIGS. 10B and 10C for five different components of the system of the present invention. In particular, graph 1101 shows the actions taken relative to the pixel electrodes over time by showing the voltage versus time diagram of the pixel electrode and the loading of data onto the pixel electrode over time. Graph 1103 shows the voltage versus time control of the control electrodes having two separate segments in order to reset to dark the different portions of the liquid crystal layer. Graph 1104 shows an intensity versus time graph of a pixel in the first segment of the liquid crystal. Graph 1105 shows the operation of the three different light illuminators over time relative to the operation of the other components of the system as shown in FIG. 11. Graph 1106 shows the intensity over time of the liquid crystal in segment 2 of the liquid crystal layer.

Continuing with a description of FIGS. 10B and 10C, step 1007 comprises three operations which are typically performed substantially contemporaneously. These operations occur during the time period between times $t_3$ and $t_4$ as shown in FIG. 11. Next, step 1009 is performed in which three operations are performed substantially contemporaneously between times $t_4$ and $t_5$ of FIG. 11. Then in step 1011, the system continues to display the first segment with the third light component (e.g. green light) and begins to display the second segment with the third light component, such as green light. This is shown as occurring between times $t_5$ and $t_6$ in FIG. 11. It should be noted that the staggering of the different segments relative to a particular light component, such as a red light component, does not affect the overall appearance of the display as each segment receives an equal amount of display time and an equal amount of illumination. An advantage of this approach is that while maintaining the same amount of time for the liquid crystal to switch from one light altering state to another light altering state, the time required for loading the pixel data can be approximately doubled, thereby allowing freedom of design with respect to the driver electronics which is loading the pixel electrodes. For example, cheaper, slower electronics could be used rather than faster, more expensive driver electronics.

The method shown in FIGS. 10B and 10C continues in steps 1013, 1015, 1017, and finally 1019 as shown in these figures. Step 1013 occurs between time frames $t_6$ and $t_7$ of FIG. 11, and step 1015 occurs during time frames $t_7$ through $t_8$ of FIG. 11. Step 1017 occurs beyond time $t_8$ and before the next frame begins which may be considered time $t_0$.

The method shown in FIGS. 10B, 10C and 11 assumes the use of two equally sized segments where one segment displays one half of an image and the other segment displays the other half of the image. It can be shown that a two segment display has certain advantages and is therefore preferred for flood illumination. For example, such a display appears to maximize the time allowed for loading of pixel data while at the same time maintaining approximately the same amount of time for the liquid crystal to switch as with a single common control electrode, such as a cover glass common electrode. Flood illumination typically uses a source of light (e.g. one primary color in a time sequential system or "white" light in a spatial color system) which illuminates the entire display device (all segments) rather than some form of structured illumination, such as a scanned light source which illuminates only a portion at a time while the source is scanned across the display. A display system using a segmented filter or structured illumination may require more than two segments.

Figure 12:
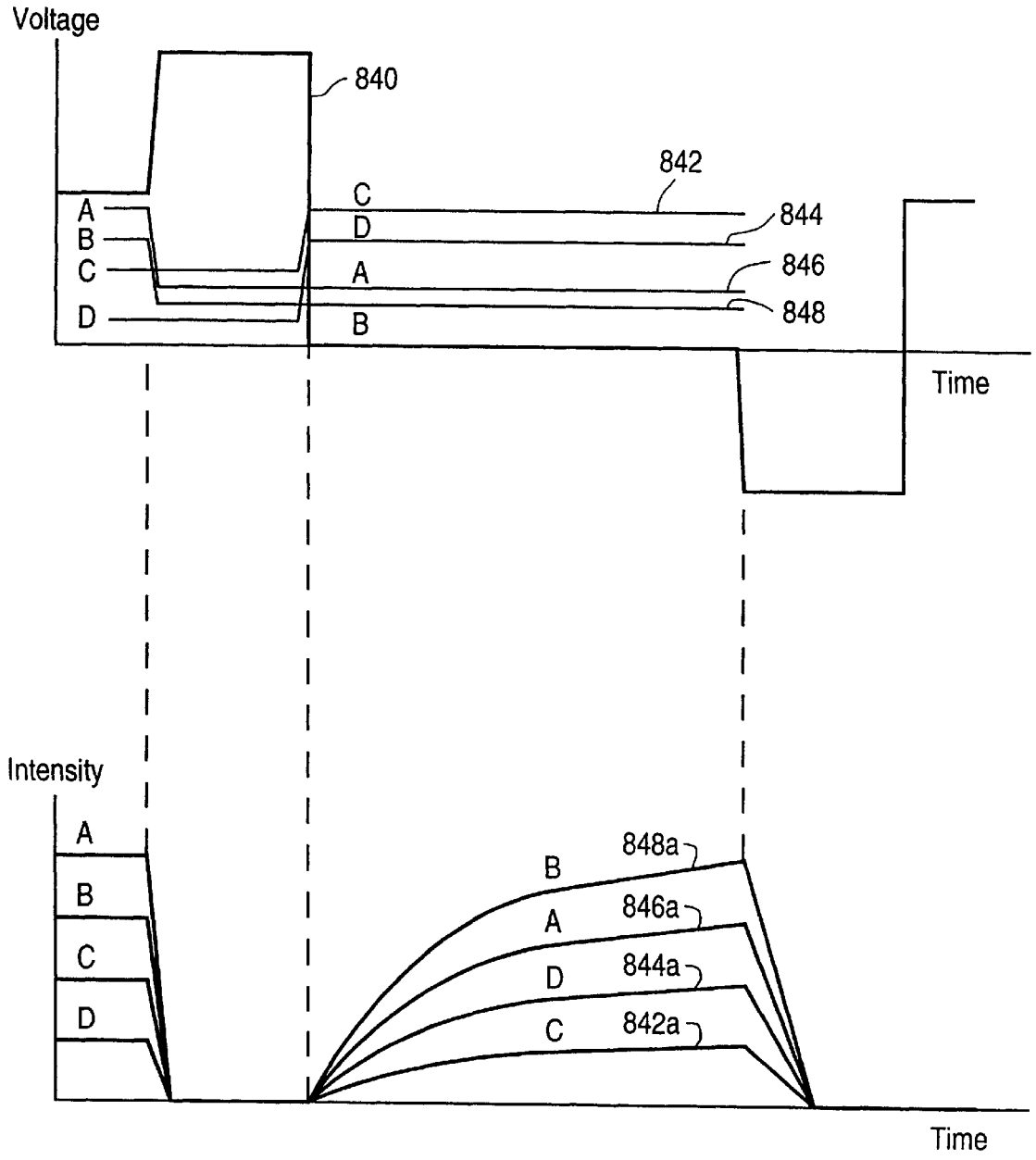
FIG. 12 shows in further detail a time sequential color system having a segmented control electrode for modulating a portion of the electro-optic layer.

FIG. 12 shows the action of four different pixels, A, B, C, and D relative to the control voltage applied to the control electrode which in the case of the embodiment of FIG. 11 is a segmented or partitioned electrode. These pixels A, B, C, and D of FIG. 12 are the same as pixels A, B, C, and D shown in FIG. 10A. Note in FIG. 12 how, during the reset period in which the pixel data is not viewable, the pixel electrodes for pixels A and B are updated substantially simultaneously at the beginning of the reset to dark period because these pixels are on the first row in the segment 804 and yet do not affect the display as shown in the bottom portion of FIG. 12 because of the control voltage applied to the control electrode as described above. Also note how the pixel electrodes for pixels C and D are updated near the end of the reset to dark phase.

The sequence shown in FIG. 12 begins with pixels "A", "B", "C", and "D" all having electrode voltages corresponding to an image which has been viewed and is about to be updated. A first segment common electrode voltage at first segment 831 of common electrode 820 is modulated to a high voltage to drive rapidly all the pixels to the dark state, independent of the voltage on the pixel electrodes. The pixel electrodes for pixels 802, 803, and 815 are then updated to their new voltage levels in the conventional one row at a time addressing scheme 831. When all the rows in this segment have been updated the common electrode is set to its next value for image display. In FIG. 12 this is shown as zero volts, but the value depends on the choice of DC balancing scheme used. Also, for liquid crystal driving, the drive to dark pulse is likely to alternate between positive and negative pulses to preserve DC balance. Note that all the pixels are driven to a dark state rapidly and simultaneously, and all the pixels begin their trajectory towards a gray level simultaneously, even though the pixel electrode voltages are updated one row at a time. Also note that the system of FIG. 12 does not employ pixel frame buffering (e.g. an array of pixel circuits with pixel buffers) as the pixel electrodes are not updated substantially simultaneously, Also, it will be appreciated that FIG. 12 also depicts the actions of a display system in which the control electrode is not segmented.

This display system with a segmented control electrode may be used to make all pixels under the segment appear to update simultaneously. This scheme could be used, for example, to generate time sequential color in a system which has a segmented color filter placed over the display, or which uses some form of structured illumination (e.g. scanning illumination rather than flood illumination). Also, the scheme may be used with some form of flood illumination, and this flood illumination may be continuous during a frame or subframe or non-contiguous pulses of illumination may be applied during a frame or subframes. This will be further illustrated with reference to FIGS. 13A, 13B, 13C, 14 and 15.

Figure 13A:
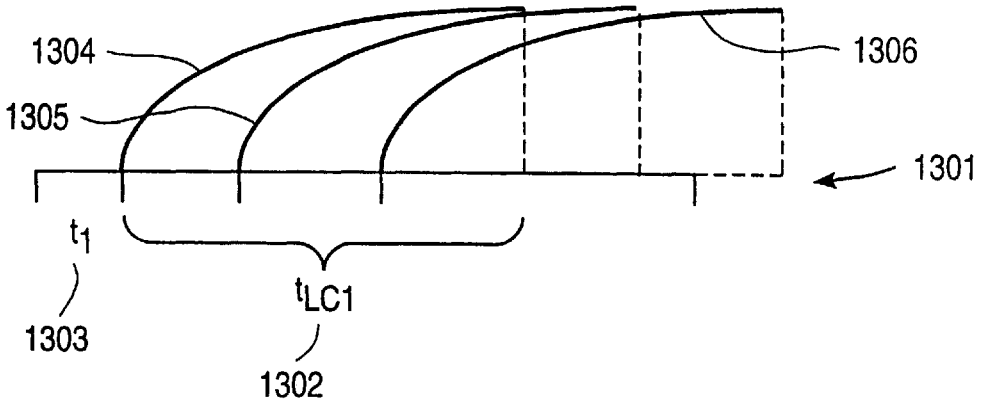
FIGS. 13A, 13B, and 13C illustrate various intensity versus time waveforms for various embodiments employing segmented electrodes for controlling a portion of the electro-optic layer.

It should be noted before discussing the illumination aspects that the present invention provides for a multiple segmented control electrode where there may be more than two segments. This is shown, for example, in FIG. 13A in which there are three segments which are separately loaded onto pixel electrodes and then displayed after releasing the appropriate control electrode for that segment. The embodiment shown in FIG. 13A shows an intensity versus time graph of three different pixels in three different segments of the display system. In particular, the graph 1301 shows a liquid crystal switching time $t_{LC1}$ which is under an intensity curve 1304 for a pixel in the first segment. This pixel was loaded during time $t_1$ shown as time 1303. Pixel intensity curve 1305 represents a pixel in a second segment which would be loaded after time $t_1$ ended. Finally, pixel intensity curve 1306 shows the intensity of a pixel in the third segment.

Figure 13B:
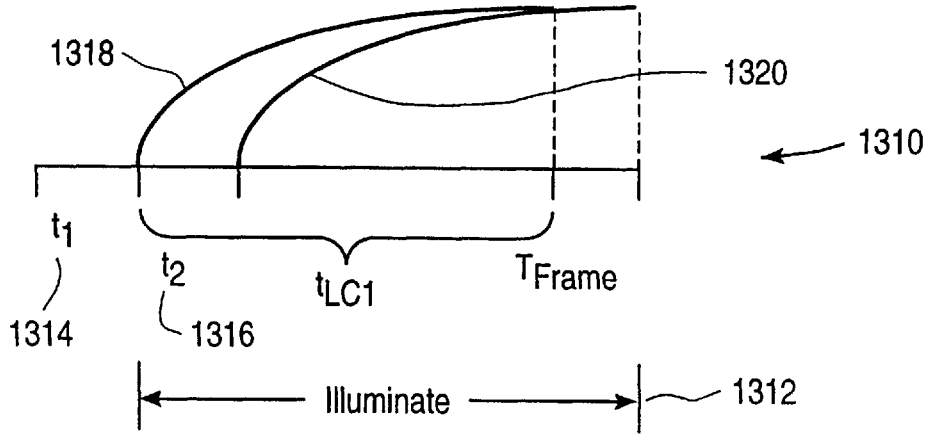

FIG. 13B in effect shows the combination of a portion of graph 1104 in FIG. 11 and a portion of graph 1106 during a particular color subframe where the two graphs 1104 and 1106 have been merged. The graph 1310 shown in FIG. 13B includes a pixel intensity curve 1318 for one pixel in the first segment and pixel intensity curve 1320 for a pixel in the second segment each of which have been loaded during their respective pixel loading times 1314 and 1316 onto their respective pixel electrodes. The illumination time is shown as being continuous illumination 1312. Note that in this embodiment of FIG. 13B, the loading time $t_1$ equals the loading time $t_2$, and the liquid crystal switching time is T frame-$t_1$. T frame is shown in bold. Illuminating the display through both liquid crystal trajectories guarantees both segments will have the same brightness and the same behavior under temperature change.

Figure 13C:
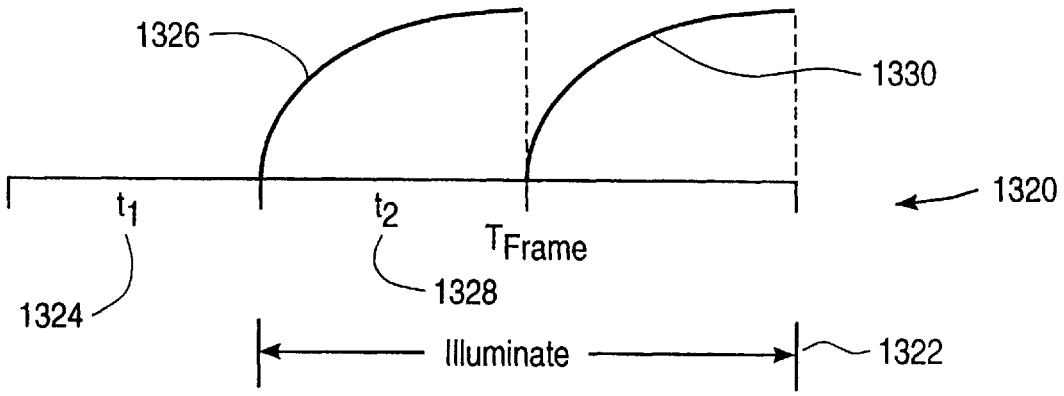

FIG. 13C illustrates an embodiment employing control electrode segments where the loading time has been slowed such that $t_1$ and $t_2$ become longer. The slowest possible data rate is achieved when $t_1$=$t_2$=tframe/2. This is illustrated in FIG. 13C. This example results in the trajectories (relaxation of the crystals toward their final light altering state) of the liquid crystal on the top and bottom halves of the array being completely separate in time. Flood illumination for the time Tframe can be used as before. It may, however, be advantageous to pulse illuminate close to the ends of the trajectory. This will maximize the perceived contrast by only illuminating the brightest part of the curve for the bright pixels. Depending on the properties of the illuminator, it may be that the brightness of the illuminator is also increased, too. This slowest addressing scheme can be thought of as viewing the bottom half of the image while the top half is being loaded, and then viewing the top half of the image while the bottom half is being loaded.

Figure 14:
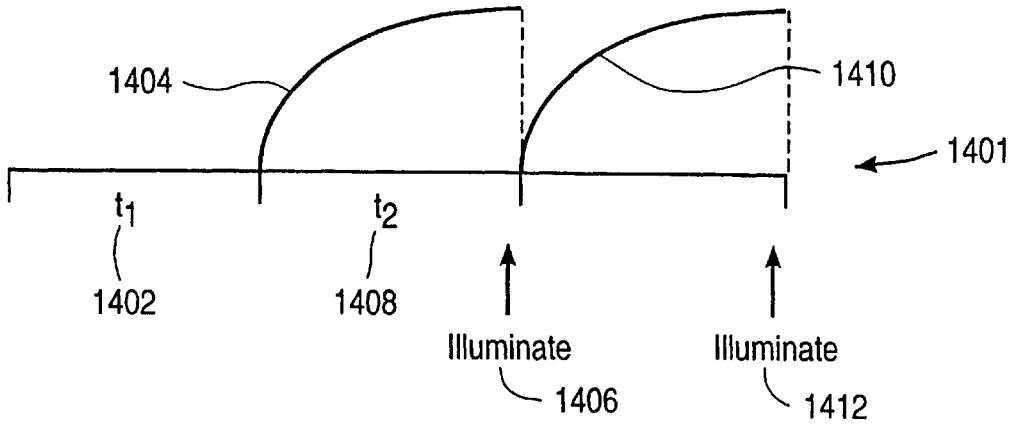
FIG. 14 shows another embodiment employing segmented electrodes and pulses of illumination rather than continuous illumination.

A scheme using pulse illumination with two pulses for each subframe in a time sequential system is shown in FIG. 14 where there is one pulse near the end of the display for the first segment and one pulse near the end of the display for the second segment. This scheme 1401 shown in FIG. 14 shows the trajectory of liquid crystals for one pixel 1404 after loading that pixel during time 1402 and also shows the trajectory of the liquid crystal for pixel 1410 after loading that pixel sometime during the time $t_2$ (shown as time 1408). The illumination pulses are not continuous and are separated by darkness.

Figure 15:
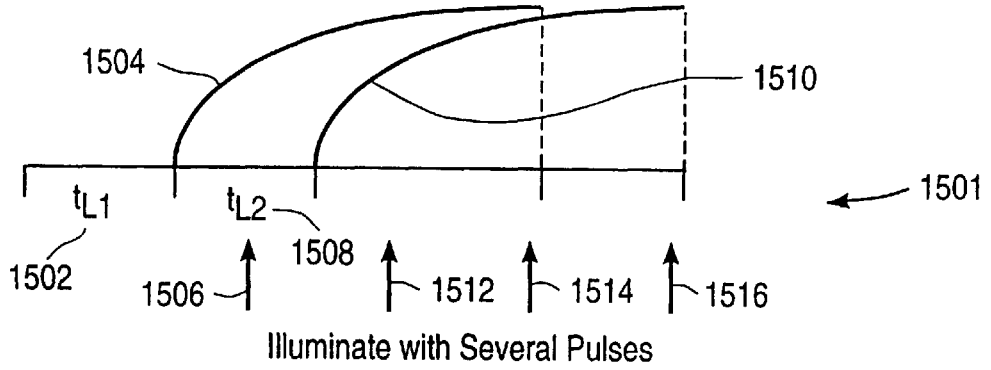
FIG. 15 shows another embodiment employing segmented control electrodes employing pulses of illumination.

FIG. 15 shows an example where more than two pulses per color subframe can be used. In this example shown in FIG. 15, $t_1$ and $t_2$ are shorter than the example shown in FIG. 14. For example, $t_1$ 1502 may equal $t_2$ 1506 as in the case of the embodiment shown in FIG. 11. Consequently, the liquid crystal material is allowed to progress up its switching curve for a longer time before it must be reset by the segmented control electrode. Pulse illumination (depending on the properties of the illuminator) may again be advantageous as compared to continuous illumination by sampling, on average, a better part of the liquid crystal switching dynamic. Positioning and time of the pulses is shown as follows. The rightmost pulse 1516 is positioned to illuminate the brightest part of the curve 1510 corresponding to the bottom segment. To maintain symmetry between both parts of the image, the corresponding part of the curve 1504 for the top part of the array is also illuminated with pulse 1514. Because, in this discussion, we are assuming flood illumination, that pulse also illuminates the liquid crystal on the bottom half of the array before it has reached its optimum state. Again, to maintain symmetry, we need to illuminate that corresponding part of the trajectory of the liquid crystal on the top half of the array represented by curve 1504. This determines the time of the earlier pulse 1512. Finally, to complete the symmetry, the pulse 1506 is also used. Now both curves 1504 and 1510 are illuminated identically, which in this example took four pulses. The number of pulses will depend on the timing of the liquid crystal trajectories. Note that in both cases the lowest contrast part of the curves is not illuminated.

It should be noted that a typical embodiment would employ control electrodes where the segments of the control electrodes are completely disconnected electrically from each other. In an alternative embodiment, the control electrode segments may be coupled by a high resistance. For example, in the case of a cover glass electrode, the manufacturing process of the cover glass electrode may at first produce a common electrode having one segment which is then used to create two segments by etching or otherwise creating a separation between the two segments; however, this separation may not be complete and rather be a high-resistance connection between the two segments. It should also be noted that a spatial color system may use multiple control electrode segments provided by the invention. That is, rather than using time sequential color, an aspect of the invention uses a spatial color (having 3 different color subpixels, and the corresponding structure, for each pixel) system with multiple segments defined by multiple control electrode segments.

Figure 16A:
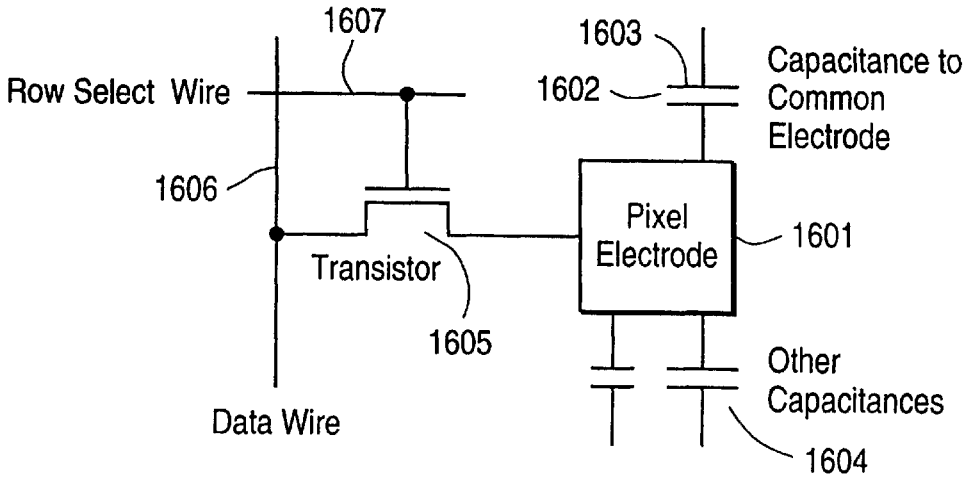
FIG. 16A shows a pixel circuit according to an embodiment of the present invention which employs compensating electrodes.
Figure 16B:
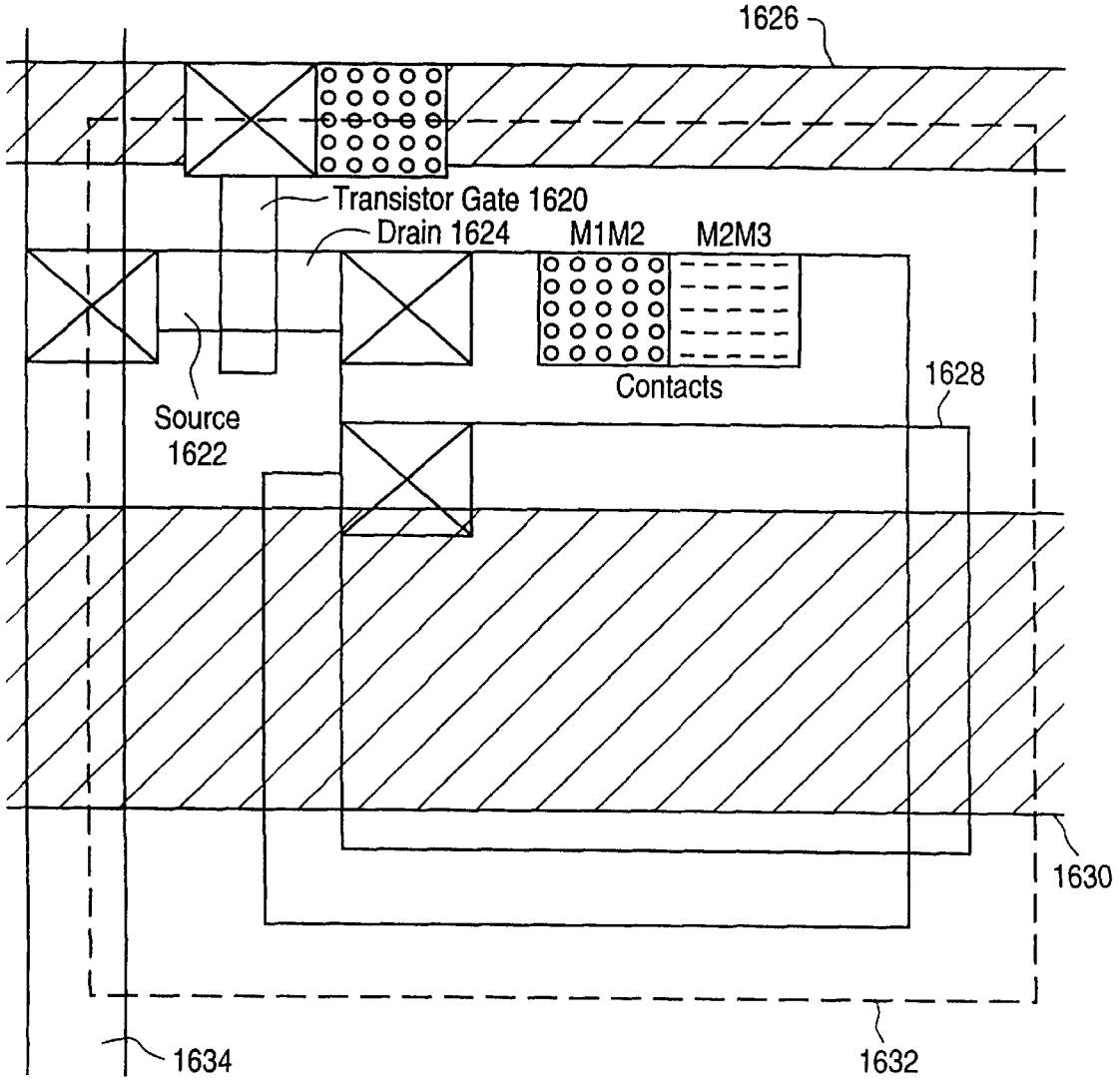
FIG. 16B shows a top view of a circuit layout of a pixel circuit according to one embodiment of the present invention having a compensating electrode in the pixel circuit in the same substrate as the pixel electrode.
Figure 16C:
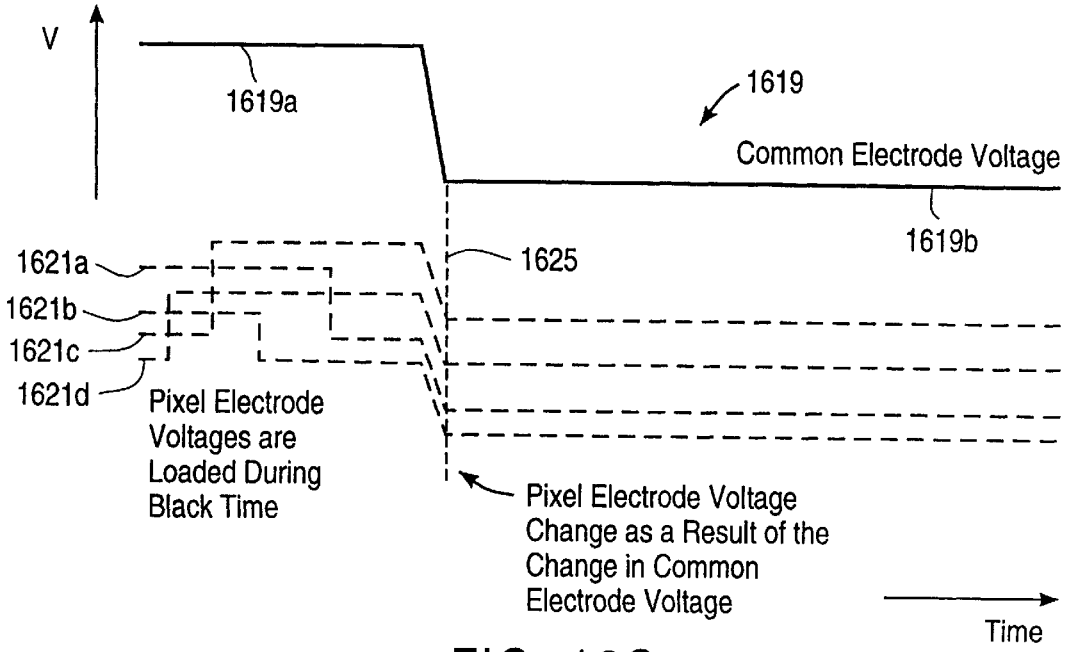
FIG. 16C illustrates a voltage versus time graph indicating the waveforms of pixel electrodes and the control electrode voltage which is used to modulate the electro-optic layer to drive it to a state in which display data is not visible.

An advantage of most embodiments of the present invention is that simple pixel circuits can be made to update their optical outputs simultaneously, even if the pixel electrodes cannot be updated simultaneously. An example of such a pixel circuit is shown in FIG. 6A which uses a signal transistor to load data onto a capacitor. The capacitance is usually formed between the pixel electrode and the control electrode which is often a common cover glass electrode, plus extra capacitance which can be obtained in a number of different ways, such as between the pixel electrode and a neighboring row select wire. This is illustrated in FIG. 16A by the other capacitances 1604. The methods by which the other capacitances are formed depends on the details of the construction of the pixel array. For example, if the pixel array is formed on a single crystal silicon substrate or chip in a commercial CMOS fabrication process, there are typically several interconnect layers available which may be metal or polysilicon. These layers can be arranged during the design of the pixel array to provide extra capacitance which is advantageous in order to prevent decay of the image. Another way in which extra capacitance can be formed in this type of fabrication process is to define a region of thin oxide between the conductive plate (usually polycrystalline silicon) and the substrate material which may be doped. This thin oxide capacitor has a higher capacitance per unit area than the other capacitors which can be arranged. In this manner, the simple pixel circuits such as that shown in FIG. 16A use capacitive storage to hold the electrode voltage on the pixel electrode until it is refreshed. Part of that capacitance is between the pixel electrode and the common electrode. A consequence of this is that when the common electrode voltage is changed, after the pixels have been loaded with data, to release the liquid crystal from the dark state described above, the capacitive coupling between the common electrode and the pixel electrode may cause a change in the pixel electrode voltage which may require some compensation. This change is shown in FIG. 16C which illustrates the common electrode voltage waveform 1619 having the reset portion 1619*a* and the release portions 1619*b* and four different pixel electrode voltages 1621*a*–1621*d* during the same time. Note that at the release point 1625, the pixel electrode voltages have changed as a result of the change in common electrode voltage.

The magnitude of the change in the pixel electrode voltage is determined by the magnitude of the change in common electrode voltage and the ratio of the capacitors shown in FIG. 16A, including capacitors 1604 and the capacitance to the common electrode. It is not necessarily seriously detrimental for the pixel electrodes to exhibit some coupling to the common electrode (or a segmented electrode if a segment electrode is used). If all the pixels have the same capacitive coupling to the cover glass electrode, and the same extra capacitance, then they will all exhibit the same voltage shift which doesn't cause a loss of uniformity. This coupling does lead to the dilution of the effect of the control electrode modulation scheme of the present invention, leading to a requirement for it to be swung through a greater voltage range. Another possible problem involves a situation where the pixel array is fabricated in a single crystal silicon CMOS process and if the pixels are addressed by a single in-channel transistor then the electrode is isolated by the reversed bias PN junction at the FET terminal connected to the pixel electrode. If the voltage on the pixel electrode was pulled sufficiently low to cause this junction to become forward biased then charge would flow to clamp the voltage of the pixels. This would limit the useful voltage range that could be used on the pixel electrodes.

Figure 16D:
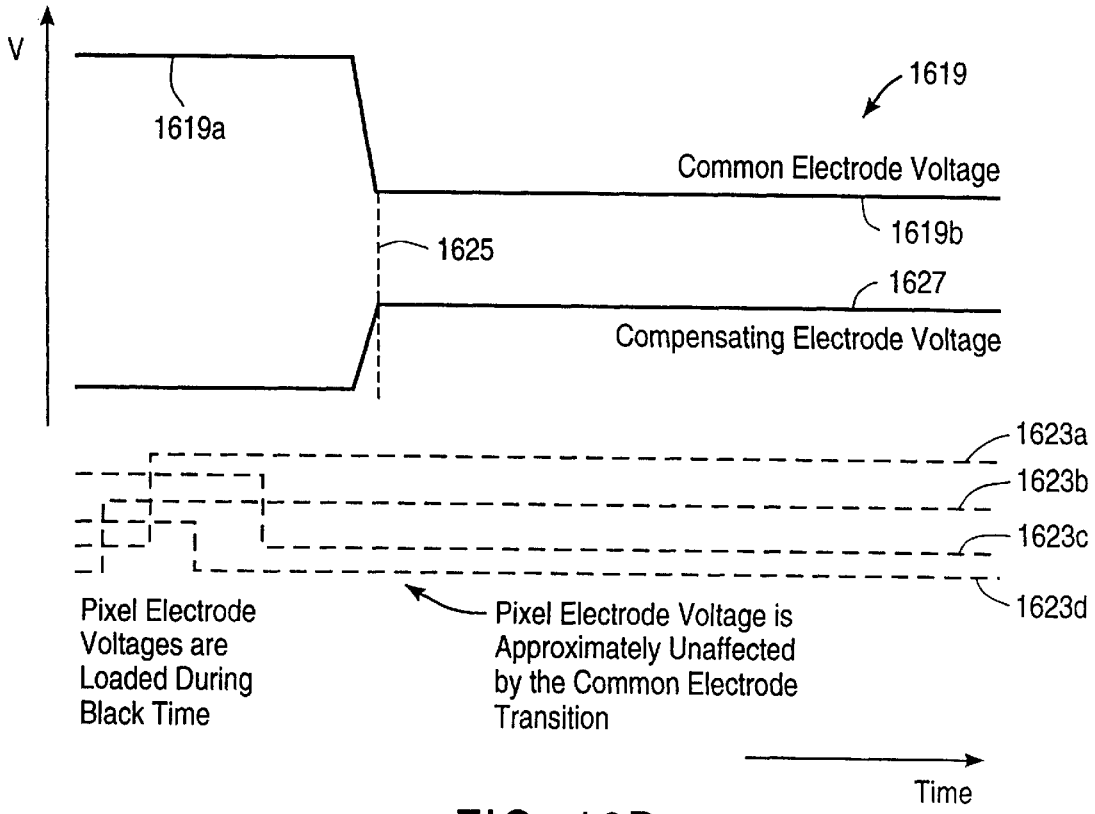
FIG. 16D illustrates the effect of a compensating electrode by showing the various waveforms of the pixel electrodes relative to the compensating electrode voltage and the control electrode voltage which is used to modulate the electro-optic layer.

One approach to this issue is to arrange for extra capacitances which are shown in FIG. 16A to be sufficiently large compared to the capacitance between the pixel electrode and the common electrode. If enough capacitance can be made available this method can allow the voltage movement of the electrode to be kept small enough to avoid detrimental effects. Another approach is to use a pixel circuit which has a buffer driving the pixel electrode. This is shown, for example, in FIG. 6D. Another approach is to explicitly arrange for one of the extra capacitors shown in FIG. 16A to be connected to a signal which can be switched in opposition to the common electrode or control electrode. This extra electrode may be considered a compensation electrode which receives a compensation signal. If the pixel array is implemented in the CMOS process, the data wire could be first level metal, and the gate wire could be a second level metal, and the pixel electrode could be a third level metal. This is shown in FIG. 16B where the pixel electrode 1632 is disposed over the compensation electrode 1630 which is disposed over the data wire in metal 1 which is 1634. The gate wire 1626 uses metal 2 and thus is at the same level as the compensation electrode 1630. The transistor 1605 of FIG. 16A is shown as having a gate 1620, a source 1622, and a drain 1624; it will be appreciated that the source 1622 and the drain 1624 are in the substrate. There are many layer combinations which are available to construct extra capacitance and FIG. 16B provides one example. It will be appreciated that the compensation electrode 1630 will be coupled to a driver circuit which drives a compensating electrode voltage 1627 in opposition to the common electrode voltage waveform 1619 shown in FIG. 16D. As also shown in FIG. 16D, the effect of the compensating electrode voltage is to maintain the pixel electrode voltage approximately unaffected by the common electrode voltage transition. The area of the overlap between the gate wire 1626 and the pixel electrode 1632 may be chosen so that the product of the capacitance between the pixel electrode and the common electrode, with the voltage swung by the common electrode, is approximately equal to the product of the capacitance between the pixel electrode and the compensation electrode, and the voltage that this wire was swung through in opposition to the common electrode transition. It will be appreciated that if the control electrode which in one embodiment is a common electrode is in fact segmented, then the compensating electrode 1630 should be segmented on the display as well in a corresponding manner.

In another aspect of the present invention, the compensating electrode may be used as a level shifting control in order to reset the liquid crystal material to a state in which display data is not visible as described above. That is, rather than using a cover glass electrode which may be a common electrode or a plurality of segments of electrodes, the electrodes similar to that electrode 1630 of FIG. 16B may be used to modulate the liquid crystal layer in a fashion to reset and to release it as shown in FIG. 2C above. In this manner, the segmentation of the control electrode for providing resetting and releasing of the liquid crystal layer according to the present invention becomes easier as it is done on the same substrate which includes the pixel electrodes rather than attempting to create segments in a common cover glass electrode. The pixel circuit shown in FIG. 16B may be used to provide such a control electrode such as electrode 1630 which would receive similar control signals as the cover glass electrode described above.

Figure 16E:
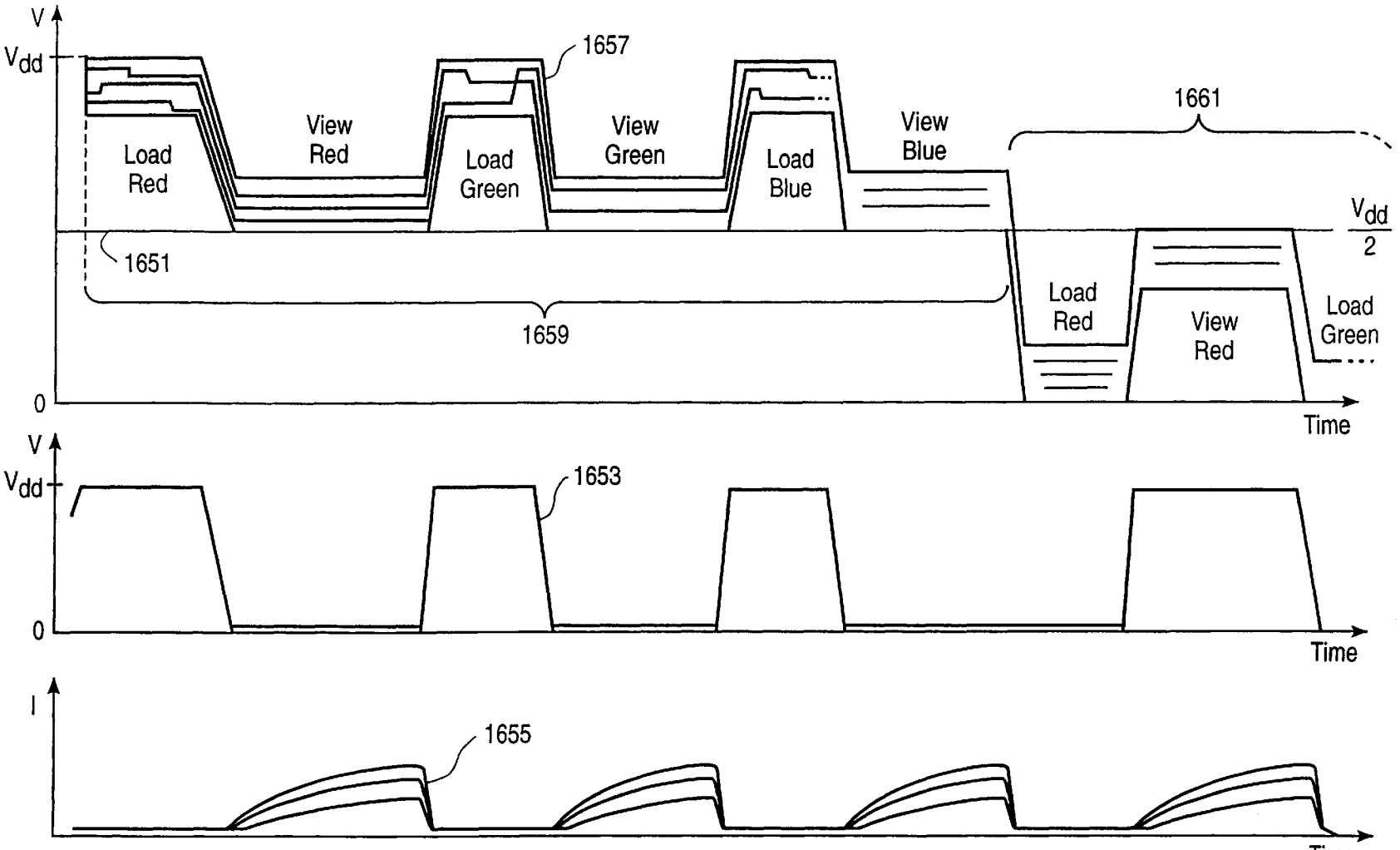
FIG. 16E shows a voltage versus time graph and a time related pixel intensity versus time graph according to one embodiment of the invention.

One example of using a control electrode in the same substrate as the pixel electrodes (such as electrode 1630) is shown in FIG. 16E. The example of FIG. 16E assumes that the cover glass electrode is fixed at $V_{dd}/2$ (shown as signal 1651) and that the pixel electrodes can be set to any value between zero volts and $V_{dd}$. The control electrodes in the substrate with the pixel electrodes are switched between one state (at $V_{dd}$) and another state (at V=0) as shown by waveform 1653. During one state of the control electrodes in one frame, the display data is substantially not viewable as shown by the waveforms 1655. During the released state of the control electrode, the display data is viewable as shown by the rising trajectories in the waveforms 1655. The pixel values are loaded onto the pixel electrodes during the reset state of the control electrodes while the display is held to a dark state, and upon the entry to the release state, the capacitive coupling between the control electrodes and the pixel electrodes simultaneously shifts the voltage of these pixel electrodes as shown by the pixel electrode waveforms 1657. The scheme of FIG. 16E uses time sequential color with three color subframes per frame and uses DC balancing between frames. Thus the reset state by the control electrodes in one frame 1659 occurs when the control electrodes are held at $V_{dd}$ and the released state in frame 1659 occurs when the control electrodes are held at zero volts. Similarly, the reset state by the control electrodes in frame 1661 occurs when the control electrodes are held at zero volts and the released state occurs when the control electrodes are at $V_{dd}$.

Some liquid crystal display systems utilize a frame sequential DC balancing scheme in which the liquid crystal is DC balanced by writing data such that the sequence of images is alternately written of positive and then negative polarity. Given that any pixel electrode of the display substrate can be driven to a voltage in the range between $V_{max}$ and $V_{min}$, if the common electrode is fixed at a voltage halfway between $V_{max}$ and $V_{min}$, then the maximum DC balanced signal that can be applied to the liquid crystal alternates between $+(V_{max}-V_{min})/2$ and $-(V_{max}-V_{min})/2$ in sequential frames, resulting in an RMS voltage of $(V_{max}-V_{min})/2$.

Figure 17:
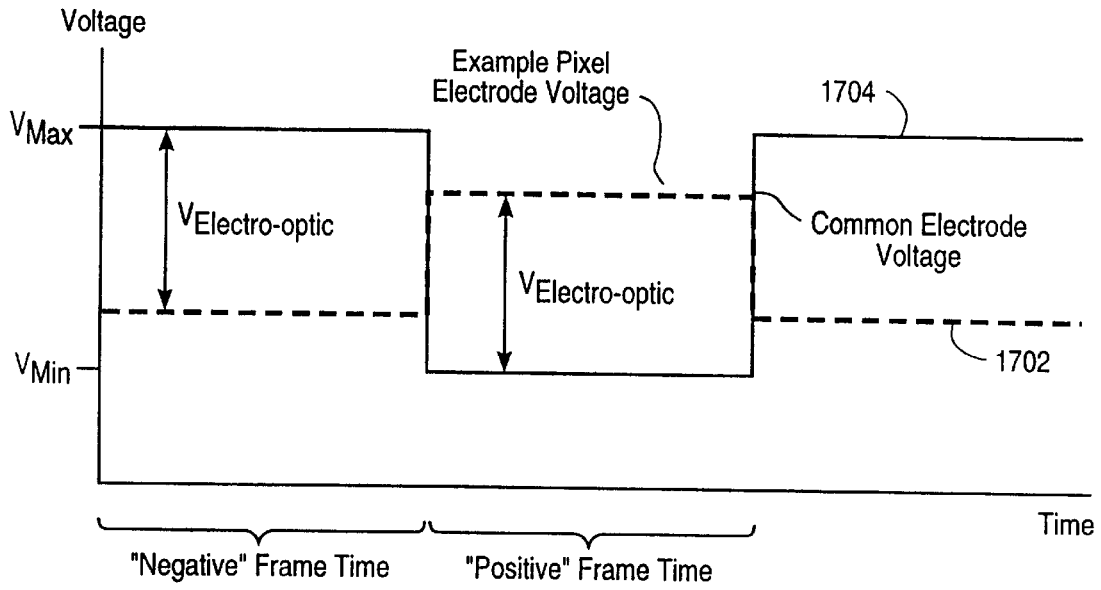
FIG. 17 illustrates control electrode modulation in a display system having frame buffering, such as analog frame buffering using a circuit such as that shown in FIG. 6D.

Several different forms of common electrode voltage modulation may be performed according to various embodiments of the present invention. With reference to FIG. 17, according to an embodiment of the invention which utilizes a pixel buffer with the pixel electrode (on the same substrate, e.g. as shown in FIG. 6D), voltage of common electrode 26 of display system 12 may be modulated between $V_{max}$ and $V_{min}$. By driving common electrode 26 to $V_{min}$ during the "positive" frame of such an electrical addressing scheme and to $V_{max}$ during the "negative" frame, the voltage of the maximum DC balanced RMS signal appearing across the electro-optic layer is doubled from $(V_{max}-V_{min})/2$ to $V_{max}-V_{min}$ (RMS).

For example, during the "positive" frame, a pixel which is to be driven to a bright state is assumed to require-a high voltage at the pixel electrode. (Note, however, that the opposite situation could also hold true, i.e. a high voltage of common electrode 26 could drive a pixel to the dark state, depending on the configuration of electro-optic layer or liquid crystal used.) According to the present invention, the common electrode may be driven to $V_{min}$ during the "positive" frame. Therefore, the voltage that can be presented across electro-optic layer 22 ranges from $V_{min}-V_{min}$ to $V_{max}-V_{min}$, and is identical to the voltage range available at a pixel electrode 28.

In the "negative" frame the common electrode is driven to $V_{max}$, and a bright state is achieved by driving the pixel electrode to a low voltage so as to maximize the voltage across electro-optic layer 22. In this case the voltage that can be presented across electro-optic layer 22 ranges from $V_{max}-V_{max}$ to $V_{min}-V_{max}$. In the example shown in FIG. 17 the pixel electrode is driven so that the voltage across the electro-optic layer is about ⅔ of the maximum available voltage. One subclass of display systems allows the pixel electrodes to be simultaneously updated with data corresponding to a new image. Such display systems are described in U.S. patent application Ser. No. 08/505,654, the contents of which are incorporated herein by reference and will be referred to as frame (subframe) sequential display devices. Since the pixels are simultaneously updated for this type of display, the pixel electrodes do not have to be driven to voltages other than their data voltages (and their inverses for DC balance) when the common electrode is modulated, which simplifies the drive circuitry, according to one embodiment of the invention.

This is different from a row-at-a-time update of the pixel electrode. One way this can be done in active matrix display is to drive the reference plates of the pixel data storage capacitors through a voltage sequence which mimics the common electrode voltage modulation. This could be done by driving all the row gate wires synchronously with the common electrode, at the cost of increased complexity and power dissipation. See for example U.S. Pat. No. 5,561,422, the contents of which are incorporated herein by reference.

Figure 18:
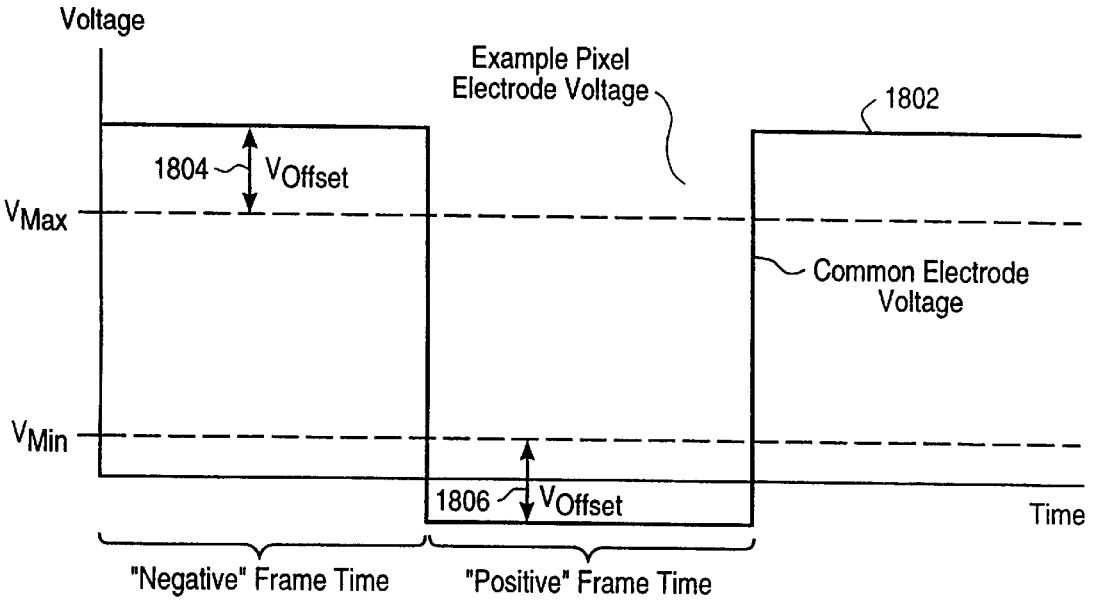
FIG. 18 illustrates a voltage versus time waveform of an electrode modulation signal which employs an offset in order to effect the electro-optic layer of the present invention; this embodiment may be used with analog frame buffering or other frame buffering which allows storage of new pixel data in the same substrate which includes the pixel electrodes which are causing the display of old pixel data.

According to another embodiment of the invention common electrode 26 is driven to voltages other than $V_{min}$ and $V_{max}$ in the phase relationship described above. For example, as shown in FIG. 18, common electrode 26 could be driven to a voltage less than $V_{min}$ (e.g. to $V_{min}-V_{offset}$) during the "positive" frame, and to a voltage greater than $V_{max}$ (e.g. to $V_{max}+V_{offset}$) during the "negative" frame. The result of such a scheme is that the voltage range that can be applied to electro-optic layer 22 is now shifted to $V_{offset}$ as the minimum addressing voltage, and to $V_{offset}+(V_{max}-V_{min})$ as the maximum addressing voltage.

The embodiment of the present invention exemplified by the schematic representation of FIG. 18 could find applications in situations where, for example, the liquid crystal electro-optic effect has a minimum threshold voltage level below which no optical effect occurs. By choosing $V_{offset}$ in such a way as to take up some, or all, of this offset the full range of voltage available at the pixel electrode is available for electro-optic modulation.

The present application hereby incorporates herein by reference the parent U.S. patent application filed on Dec. 19, 1996, Ser. No. 08/770,233.

Figure 19A:
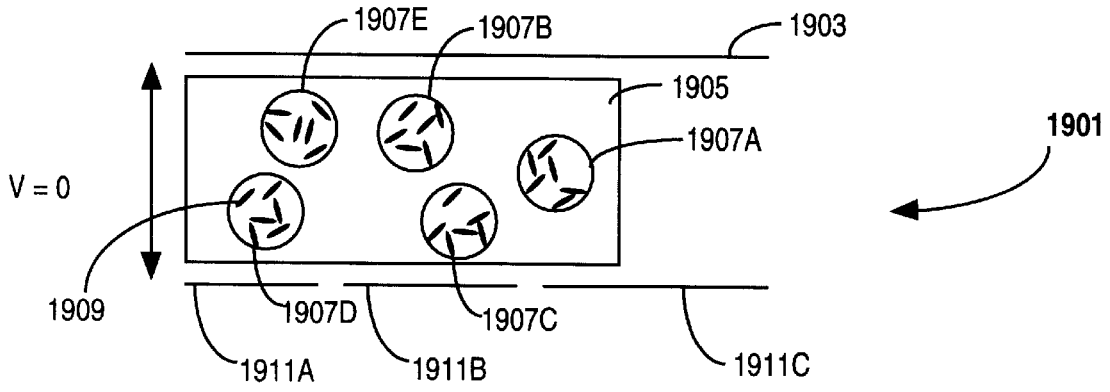
FIG. 19A illustrates one mode of an example of a display system which uses an electro-optic layer that comprises a polymer dispersed liquid crystal (PDLC) material.
Figure 19B:
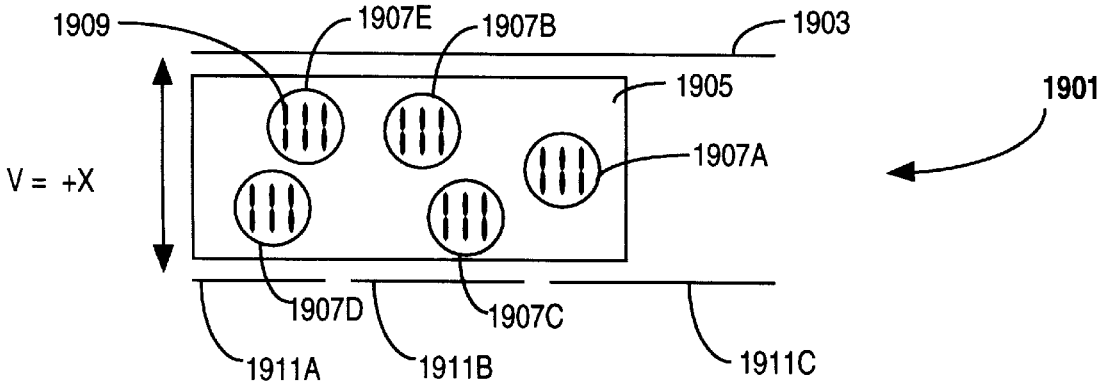
FIG. 19B shows another mode of an example of a display system as in FIG. 19A.

Several examples of an alternative embodiment of the present invention which utilizes PDLC material as the electro-optic layer will now be described. Examples of two light altering states for the PDLC material are shown in FIGS. 19A and 19B and have been explained above. In one light altering state, a sufficiently high voltage is applied across the material to create an electric field that causes the PDLC material to align throughout the layer such that the directors of each inclusion align parallel to each other. When light passes through this PDLC material, scattering is substantially reduced relative to the scattering that occurs in the state shown in FIG. 19A when no voltage is applied across the material. A control electrode such as a cover glass electrode and the first substrate form a structure around the PDLC material such that the first substrate is below the liquid crystal material and the common cover glass electrode is above the PDLC material.

Figure 20:
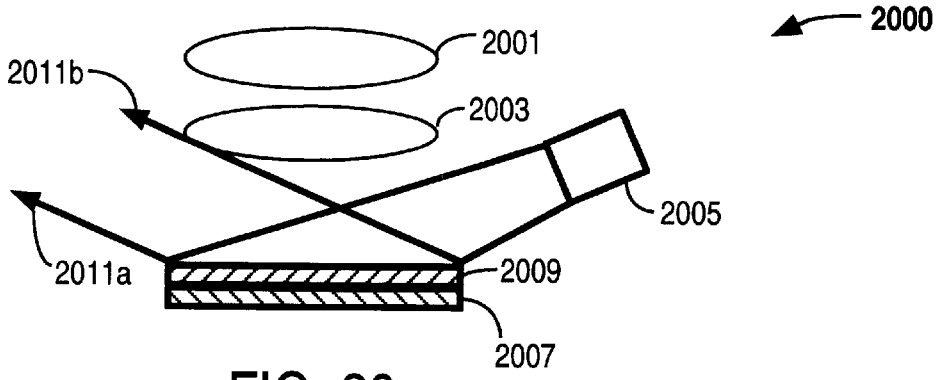
FIG. 20 shows a mode of a display system employing PDLC material according to one embodiment of the present invention.
Figure 21:
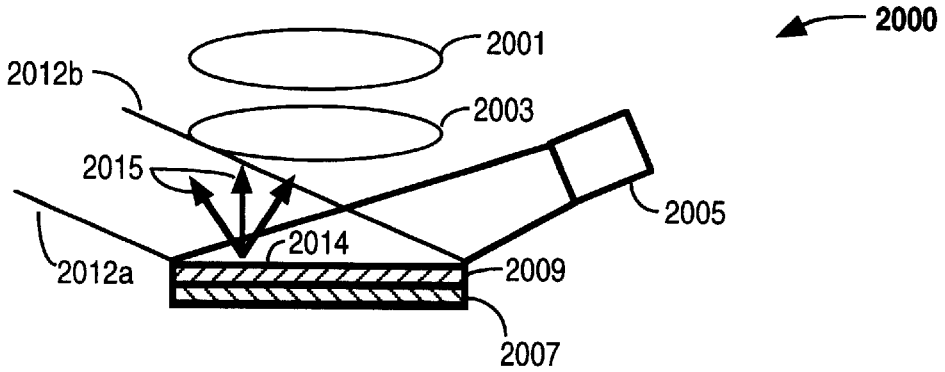
FIG. 21 shows another mode of a display system employing PDLC material according to one embodiment of the present invention.

The advantages of applying a first control voltage to the common cover glass electrode or to some other control electrode prior to the display of new pixel data and then releasing that control voltage may be obtained with PDLC material as the electro-optic layer by arranging the geometry of the illumination and the viewing/imaging optics relative to the PDLC material. The optical system is arranged so that the non-scattering state achieved by the application of a voltage reflects illumination light out of the collection angle of the viewing/imaging optics. This is shown in FIG. 20 in which the display system 2000 has an illuminator 2005 which is arranged at an angle relative to the electro-optic layer 2009 and the substrate 2007. It will be appreciated that the substrate 2007 includes a plurality of pixel electrodes as described herein, such as the pixel electrodes 1911*a*, 1911*b*, and 1911*c* shown in FIGS. 19A and 19B. It will also be appreciated that the electro-optic layer 2009 includes the polymer material 1905 and small inclusions of liquid crystal material as shown in FIGS. 19A and 19B. When a sufficiently large voltage is applied across the PDLC material, the light altering state shown in FIG. 19B is produced. When the illuminator 2005 is arranged at an angle relative to the viewing/imaging optics as shown in FIG. 20, light for all the pixels is directed out of the collection angle of the viewing/imaging optics. In the case of the display system 2000 shown in FIG. 20, the light rays 2011*a* and 2011*b* are directed out of the collection angle of the lenses 2001 and 2003 such that this light for all pixels does not reach the viewer's eyes. In this manner, the display system produces a dark state for all pixels which is similar to the dark state described above (see for example the dark portion represented by curve 162 of the pixel intensity waveform 160 shown in FIG. 2D). Thus a reset of a display which utilizes PDLC material may be performed before new pixel data is loaded onto the pixel electrodes. After the loading of new pixel data onto the pixel electrodes (for either the next fill color frame or the next color subframe in the case of a time-sequential display) the voltage applied to the control electrode, such as the cover glass electrode 1903, is released as described above and this allows the pixel electrodes to control the light altering state of the PDLC material such that each pixel is controlled by the PDLC material in the vicinity of the associated pixel electrode to thereby generate an image. FIG. 21 shows the display 2000 after the control voltage has been released (e.g. changed to a second control voltage) on the cover glass electrode to thereby allow the pixel electrodes to drive selectively the light altering state of the PDLC material to thereby generate an image. An image is generated by allowing the light to scatter at each pixel. Thus, rather than having all pixels direct light between the rays 2012*a* and 2012*b,* at least some pixels in the image will direct light by a scattering effect. An example is shown as rays 2015 from the pixel 2014. These rays will be directed into the collection angle of the viewing/imaging optics to cause light to be directed to the viewer's eye. For those pixels for which the PDLC material relaxes to a state such as that shown in FIG. 19A, then light will be directed from those pixels to the viewer so that the viewer sees the pixel as bright (e.g. a non-black or dark color). It is noted that the viewer can either be looking into the lens directly at the reflective display device or the light may be projected onto a screen. It is also noted that the illumination light does not have to be polarized and could be from a time-sequential color source.

Figure 22:
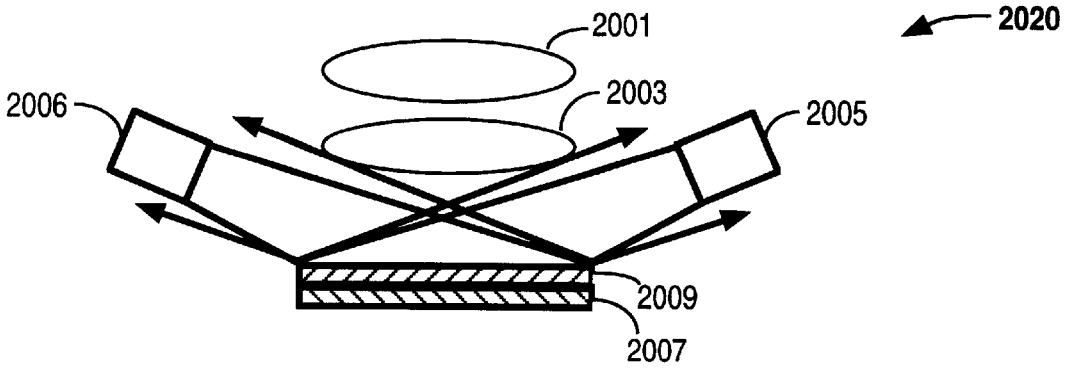
FIG. 22 shows another example of a display system which employs PDLC material according to another embodiment of the present invention.

FIG. 22 shows a cross-sectional view of an alternative embodiment (in the reset of the display state) which utilizes an illuminator 2005 and 2006 which may be a rectangular illuminator or a ring illuminator which is designed to improve the uniformity of illumination. In one embodiment, the illuminator may be a rectangle having the same width/length ratio as the active display device on the first substrate 2007 or it may have a circular geometry or it may be two separate illuminator bars which illuminate from two sides of the substrate.

It will be appreciated that the miniature display system shown in FIGS. 20 through 22 has a number of advantages over other types of miniature display systems which utilize reflective substrates, such as nematic liquid crystal on silicon display devices. One advantage is that these PDLC displays do not require polarized light and thus make more efficient use of the light from the illuminator or illuminators. Moreover, the layers on the substrate may not need to be as flat as the layers on a liquid crystal on silicon miniature display device. However, traditionally PDLC material has slow response times, but this response time may be improved by the present invention which utilizes a reset state prior to loading new pixel data as described above. It may be possible to improve the light efficiency of the system further by recycling light in the manner which is known in the art relating to TFT liquid crystal displays. See for example, the product literature from the 3M Corporation concerning the BEF material.

In the foregoing specification, the invention has been described with reference to specific exemplary embodiments thereof. It will, however, be evident that various modifications and changes may be made thereto without departing from the broader spirit and scope of the invention as set forth in the pending claims. The specification and drawings are, accordingly, to be regarded in an illustrative sense rather than a restrictive sense.

What is claimed is:

1. A method for operating a display system, said display system comprising a first substrate having a plurality of pixel electrodes, an electro-optic layer operatively coupled to said pixel electrodes and an electrode operatively coupled to said electro-optic layer, said electro-optic layer comprising a polymer dispersed liquid crystal material, said method comprising:

applying a first plurality of pixel data values to said plurality of pixel electrodes such that a first pixel data represented by said first plurality of pixel data values is displayed;

applying a first control voltage to said electrode to alter a state of said electro-optic layer such that said first pixel data is substantially not displayed;

applying a second plurality of pixel data values to said plurality of pixel electrodes, said second plurality of pixel data values representing a second pixel data, said second plurality of pixel data values being applied while a voltage applied to said electrode causes no pixel data values to be displayed;

displaying said second pixel data.

2. A method as in claim 1 wherein said displaying said second pixel data comprises:

applying a second control voltage to said electrode to alter said state of said electro-optic layer such that said second pixel data is displayed, and wherein a first image is represented by said first pixel data and a second image is represented by said second pixel data.

3. A method as in claim 2 wherein said first image comprises a first color subframe and said second image comprises a second color subframe.

4. A method as in claim 2 wherein said polymer dispersed liquid crystal material has at least a first light altering state and a second light altering state and wherein said first control voltage sets said liquid crystal in said first light altering state such that light is not substantially scattered when passing through said electro-optic layer.

5. A method as in claim 4 wherein said second control voltage sets said polymer dispersed liquid crystal material in said second light altering state such that light is capable of being scattered when passing through said electro-optic layer.

6. A method as in claim 5 wherein said light passing through said electro-optic layer is not polarized.

7. A method as in claim 6 wherein said applying a first control voltage and said applying a second plurality of pixel data values overlap at least partially in time.

8. A method as in claim 7 wherein said applying a first control voltage and said applying a second plurality of pixel data values occur substantially contemporaneously in time.

9. A method as in claim 7 wherein said electrode is a common cover glass electrode which receives a DC balanced signal over time.

10. A method as in claim 5 wherein when said first control voltage is applied light from an illumination source is reflected, for all pixels in said display system, out of a collection angle of an imaging optical system, said display system comprising said imaging optical system.

11. A method as in claim 10 wherein when said second control voltage is applied light from at least some of said pixels is reflected within said collection angle.

12. A method as in claim 5 wherein said first control voltage is an AC (alternating current) voltage.

13. A method as in claim 5 wherein said first control voltage is approximately equal to one of a maximum voltage and a minimum voltage which can be applied to said plurality of pixel electrodes.

14. A method as in claim 5 wherein said first control voltage is approximately equal to one of a maximum voltage plus a first offset voltage and a minimum voltage minus a second offset voltage, wherein said maximum voltage and said minimum voltage are the maximum and minimum voltages which can be applied to said plurality of pixel electrodes.

15. A method as in claim 5 wherein said electrode is an electrode disposed in said first substrate with said plurality of pixel electrodes.

16. A method as in claim 7 wherein said applying a first control voltage further comprises applying a third control voltage after said first control voltage and before said applying said second control voltage, wherein said third control voltage holds said liquid crystal in said first light altering state and said first control voltage rapidly places said liquid crystal in said first light altering state.

17. A method as in claim 10 wherein said second plurality of pixel data values is stored in a plurality of buffers on said first substrate while said first pixel data is displayed.

18. A method as in claim 5 further comprising:

applying a first compensating voltage to a plurality of compensating electrodes disposed on said first substrate.

19. A method as in claim 18 wherein said applying a first compensating voltage and said step of applying a first control voltage overlap at least partially in time.

20. A method as in claim 19 wherein said applying a first compensating voltage and said step of applying a first control voltage occur substantially contemporaneously in time.

21. A method for operating a display system, said display system comprising a first substrate having a first plurality of pixel electrodes and a second plurality of pixel electrodes, an electro-optic layer operatively coupled to said first and said second plurality of pixel electrodes, said electro-optic layer comprising a polymer dispersed liquid crystal material, and a first electrode and a second electrode, said method comprising:

(a) applying a first plurality of pixel data values to said first plurality of pixel electrodes, said first plurality of pixel data values representing a first portion of an image;

(b) applying a first control voltage to said first electrode to alter a state of a first portion of said electro-optic layer such that said first portion of said image is not displayed, said first control voltage being applied to said first electrode while applying said first plurality of pixel data values to said first plurality of pixel electrodes such that said first portion of said image is not displayed;

(c) displaying said first portion of said image;

(d) applying a second plurality of pixel data values to said second plurality of pixel electrodes, said second plurality of pixel data values representing a second portion of said image;

(e) applying a second control voltage to said second electrode to alter a state of a second portion of said electro-optic layer such that said second portion of said image is not displayed, said second control voltage being applied to said second electrode while applying said second plurality of pixel data values to said second plurality of pixel electrodes such that said second portion of said image is not displayed;

(f) displaying said second portion of said image.

22. A method as in claim 21 wherein said applying said first plurality of pixel data values and said applying said first control voltage overlap at least partially in time and wherein said applying said second plurality of pixel data values and said applying said second control voltage overlap at least partially in time.

23. A method as in claim 22 wherein said first control voltage and said second control voltage are approximately equal.

24. A method as in claim 22 wherein said image is at least a portion of a color subframe and wherein said display system is a time sequential color system.

25. A method as in claim 24 wherein said first portion is one-half of said image and said second portion is the other half of said image.

26. A method as in claim 25 wherein said color subframe is one of a red subframe, a green subframe or a blue subframe.

27. A method as in claim 22 wherein said image is at least a portion of a color frame and wherein said display system is a spatial color system having for each pixel of said display system a first color component subpixel, a second color component subpixel and a third color component subpixel.

28. A method as in claim 22 wherein said displaying said first portion comprises:

applying a third control voltage to said first electrode, after said applying said first plurality of pixel data values and after said applying said first control voltage, to alter said state of said first portion of said electro-optic layer such that said first portion is displayed.

29. A method as in claim 28 wherein said displaying said second portion comprises:

applying a fourth control voltage to said second electrode, after said applying said second plurality of pixel data values and after said applying said second control voltage, to alter said state of said second portion of said electro-optic layer such that said second portion is displayed.

30. A method as in claim 29 wherein said applying said first plurality of pixel data values and said applying said first control voltage overlap at least partially in time and wherein said displaying said first portion and said applying said second plurality of pixel data values and said applying said second control voltage overlap at least partially in time.

31. A method as in claim 30 wherein said polymer dispersed liquid crystal material has at least a first light altering state and a second light altering state and wherein said first and said second control voltages set said liquid crystal in said first light altering state such that light is not substantially scattered when passing through said electro-optic layer.

32. A method as in claim 31 wherein said third and said fourth control voltages set said polymer dispersed liquid crystal material in said second light altering state such that light is capable of being scattered when passing through said electro-optic layer.

33. A method as in claim 31 wherein said first electrode is a first portion of a cover glass electrode disposed on a second substrate and said second electrode is a second portion of said cover glass electrode, said first portion and said second portion of said cover glass electrode not being electrically coupled.

34. A method as in claim 31 wherein said first electrode comprises at least an electrode disposed in said first substrate with said first plurality of pixel electrodes and said second electrode comprises at least another electrode disposed in said first substrate with said second plurality of pixel electrodes.

35. A method as in claim 22 wherein said displaying said first portion comprises illuminating said display system with at least one first pulse of illumination.

36. A method as in claim 35 wherein said displaying said second portion comprises illuminating said display system with at least one second pulse of illumination.

37. A method as in claim 36 wherein said first pulse and said second pulse do not provide continuous illumination.

38. A display system comprising:

a first substrate having a first plurality of pixel electrodes for receiving a first plurality of pixel data values representing a first image to be displayed;

an electro-optic layer operatively coupled to said pixel electrodes, said electro-optic layer comprising a polymer dispersed liquid crystal material;

an electrode operatively coupled to said electro-optic layer, said display system displaying said first image and then applying a first control voltage to said electrode to alter a state of said electro-optic layer such that said first image is substantially not displayed while loading a second plurality of pixel data values onto said first plurality of pixel electrodes and then said display system displaying a second image represented by said second plurality of pixel data values after said electrode receives a second control voltage.

39. A display system as in claim 38 further comprising an electrode control driver coupled to said electrode to provide said first control voltage to said electrode.

40. A display system as in claim 39 wherein said electrode control driver provides said first control voltage in a phase controlled relationship relative to ending the display of said first image and provides said second control voltage in a phase controlled relationship relative to beginning the display of said second image.

41. A display system as in claim 40 wherein when said first control voltage is applied to said electrode, said first image cannot be substantially displayed even if said first plurality of pixel electrodes retain said first plurality of pixel data values.

42. A display system as in claim 41 wherein upon said second control voltage being applied to said electrode, said second image is displayed such that substantially all of said first plurality of pixel electrodes cause a corresponding plurality of pixels in said second image to be simultaneously updated.

43. A display system as in claim 42 wherein said corresponding plurality of pixels include pixels on a plurality of rows of pixels of said display system.

44. A display system as in claim 43 wherein said first image comprises a first color subframe and said second image comprises a second color subframe.

45. A display system as in claim 43 wherein said polymer dispersed liquid crystal material has at least a first light altering state and a second light altering state and wherein said first control voltage sets said liquid crystal in said first light altering state such that light is not substantially scattered when passing through said electro-optic layer and wherein said second control voltage sets said liquid crystal in said second light altering state such that light is capable of being scattered when passing through said electro-optic layer.

46. A display system as in claim 45 wherein said electrode is a common cover glass electrode which receives a DC balanced signal over time.

47. A display system as in claim 45 further comprising:

an illumination source which provides a source of light which is directed toward said first substrate;

an imaging optical system having a collection angle for receiving light from said first substrate, wherein when said first control voltage is applied, light from said illumination source is reflected, for all pixels in said display system, out of said collection angle, and wherein when said second control voltage is applied light from at least some of said pixels is reflected within said collection angle.

* * * * *